US006906677B2

(12) United States Patent
Yamamoto et al.

(10) Patent No.: US 6,906,677 B2
(45) Date of Patent: Jun. 14, 2005

(54) ANTENNA, ANTENNA DEVICE, AND RADIO EQUIPMENT

(75) Inventors: Atsushi Yamamoto, Moriguchi (JP); Hiroshi Iwai, Neyagawa (JP); Koichi Ogawa, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 18 days.

(21) Appl. No.: 09/866,996

(22) Filed: May 25, 2001

(65) Prior Publication Data

US 2002/0044099 A1 Apr. 18, 2002

(30) Foreign Application Priority Data

May 26, 2000 (JP) ..... 2000-155870

(51) Int. Cl.[7] ..... H01Q 1/42

(52) U.S. Cl. ..... 343/789; 343/700 MS; 343/768

(58) Field of Search ..... 343/767, 769, 343/770, 789, 700 MS, 796, 797, 702, 768

(56) References Cited

U.S. PATENT DOCUMENTS

| | | | | |
|---|---|---|---|---|
| 3,534,376 A | | 10/1970 | Webb | 343/786 |
| 3,568,206 A | | 3/1971 | Sisson | 343/750 |
| 4,086,598 A | * | 4/1978 | Bogner | 343/768 |
| 4,147,912 A | | 4/1979 | Uyeda | 219/10.55 F |
| 4,371,877 A | | 2/1983 | Doussot et al. | 343/770 |
| 4,668,956 A | * | 5/1987 | Mahnad | 343/789 |
| 4,675,685 A | | 6/1987 | Finken | 343/708 |
| 4,821,040 A | | 4/1989 | Johnson et al. | 343/700 MS |
| 4,897,664 A | | 1/1990 | Killackey et al. | 343/78 |
| 4,924,237 A | | 5/1990 | Honda et al. | 343/702 |
| 5,233,364 A | | 8/1993 | Lefeuvre et al. | 343/789 |
| 5,465,100 A | | 11/1995 | Remondiere et al. | 343/769 |
| 5,539,418 A | | 7/1996 | Egashira et al. | 343/712 |
| 5,874,924 A | | 2/1999 | Csongor et al. | 343/789 |
| 5,905,471 A | | 5/1999 | Biebl et al. | 343/769 |
| 6,160,522 A | * | 12/2000 | Sanford | 343/769 |
| 6,317,097 B1 | * | 11/2001 | Smith | 343/789 |
| 6,486,847 B1 | * | 11/2002 | Yamamoto et al. | 343/789 |

FOREIGN PATENT DOCUMENTS

| | | |
|---|---|---|
| EP | 0 738 023 | 10/1996 |
| EP | 1 033 782 | 9/2000 |
| JP | 08 293717 | 11/1996 |
| JP | 10 200327 | 7/1998 |

OTHER PUBLICATIONS

European Search Report corresponding to application No. EP 01 11 2707 dated Apr. 5, 2004.

* cited by examiner

*Primary Examiner*—Hoang V Nguyen
(74) *Attorney, Agent, or Firm*—RatnerPrestia

(57) ABSTRACT

An antenna has a conductive bottom member;

a conductive side member; and a conductive member arranged in a space surrounded by the bottom member and the side member, wherein the conductive member is connected to a signal line for transmission and/or reception.

24 Claims, 52 Drawing Sheets

($f_0$: Center frequency)

Wr<Wc

CIRCUIT ON A METAL PLATE IN THE CENTER OF THE UPPER SURFACE OF A METAL CABINET

CIRCUIT ON A BOTTOM METAL PLATE UNDER A METAL PLATE IN THE EDGE SIDE OF THE UPPER SURFACE OF A METAL CABINET

CIRCUIT ON A METAL PLATE (INSIDE A CABINET) IN THE EDGE SIDE OF THE UPPER SURFACE OF THE METAL CABINET

ANTENNA, ANTENNA DEVICE, AND RADIO EQUIPMENT

DETAILED DESCRIPTION OF THE INVENTION

1. Field of the Invention

The present invention relates to an antenna, an antenna device, and a radio equipment that are used mainly in mobile communications, and in particular, to an antenna, which is optimal for an antenna for a base station, an antenna device, and a radio equipment.

2. Related Art of the Invention

Conventional technologies are shown in FIGS. 36 and 37.

First, a first conventional example shown in FIG. 36 will be described. FIG. 36 shows an example of techniques with which the directivity of an antenna on a vertical plane is changed, and FIGS. 37A, 37B, and 37C each show an example of radiation directivity of a monopole antenna.

FIG. 36 illustrates a ground conductor 211, a coaxial power supply part 212, and an antenna element 213. The antenna element 213 is connected to the coaxial power supply part 212 on the ground conductor 211. As an example, a case is shown, the case that a monopole antenna has axis-symmetric structure, that is, the structure that the ground conductor 211 is disc-shaped, the coaxial power supply part 212 is located in a center position of a surface of the ground conductor 211, and the antenna element 213 is connected to the coaxial power supply part 212 so as to be perpendicular to the ground conductor 211. At this time, radiation waves of the antenna are non-directional on a horizontal plane of the antenna.

In a monopole antenna, there is a method of changing the size of the ground conductor 211 as a method of changing the directivity of radio waves on a vertical plane. When the ground conductor 211 has a finite size in a monopole antenna, the diffraction of radio waves happens from the edge of the ground conductor 211. The size of the diffraction depends on the size of the ground conductor 211; the larger the ground conductor 211 is, the smaller the diffraction becomes, and vice versa. The entire radiation waves of the monopole antenna are the sum of the radiation waves from the antenna element 213 and the diffraction waves from the edge of the ground conductor 211. If the antenna is divided into two sides: a top side having the antenna element 213 and a bottom side not having the antenna element 213, fewer radio waves flow to the bottom side and more radio waves are applied to the top side with increasing the ground conductor 211 in size. Also, the maximum radiation direction approaches the horizontal plane of the antenna. On the other hand, as the ground conductor 211 becomes smaller, more radio waves flow to the bottom side, making the maximum radiation direction approach the upright direction of the antenna. However, when the diameter of the ground conductor 211 is equal to or below ½ wavelength, the radiation waves flow equally to the top and bottom sides, exhibiting directivity in the form of the number 8 on the vertical plane of the antenna. At this moment, the maximum radiation direction is the horizontal plane of the antenna. FIGS. 37A, 37B, and 37C show the radiation directivity when the ground conductor 211 has respective diameters of about ½ wavelength (FIG. 37A), about 0.8 wavelength (FIG. 37B), and about 3 wavelengths (37C). In FIGS. 37A, 37B, and 37C, X and Y indicate the directions parallel to a surface of the ground conductor 211 and Z indicates a direction perpendicular to the ground conductor 211 as shown in FIG. 37D. The radiation directivity is calibrated in 10 dB, and the unit used is dBd, referred to the gain of a dipole antenna.

Thus a monopole antenna can change the directivity of the radio waves on the vertical plane of the antenna by changing the ground conductor 211 in size.

A second prior art antenna will be described with reference to FIG. 38 showing a technique to change the directivity of an antenna. FIG. 38 shows a monopole antenna array provided with two antenna elements, and FIG. 39 shows an example of radiation directivity.

In FIG. 38, the antenna array comprises a ground conductor 221, coaxial power supply parts 222 and 223, antenna elements 224 and 225, power supply paths 226 and 227, and a power distribution/composition circuit 228. The antenna elements 224 and 225 are connected to the coaxial power supply parts 222 and 223, respectively on the ground conductor 221. The coaxial power supply parts 222 and 223 are connected to the power distribution/composition circuit 228 via the power supply paths 226 and 227, respectively. The ground conductor 221 is provided on an X-Y plane.

The following will describe a case that there are two antenna elements 224 and 225, and radiation waves become strong in the X-axis direction.

The antenna elements 224 and 225 are arranged ½ wavelength apart from each other on the X-axis to be symmetric with respect to the origin point, and currents to be supplied have a phase difference of 180 degrees. At this moment, the array factors become co-phase in the +X and −X directions to reinforce each other. Particularly, when the antenna is symmetric with respect to the Z-X plane and the Z-Y plane, the radiation waves become symmetric with respect to the Z-X plane and the Z-Y plane. The waves to be radiated become strong in the +X direction and the −X direction where the radiation waves from the antenna elements 224 and 225 have the same phase. Furthermore, changing the size of the ground conductor 221 or the distance between the antenna elements allows the directivity of the radio waves on the vertical plane of the antenna to change.

FIG. 39 shows as an example the radiation directivity when the antenna elements each are made of a ¼ wavelength metallic wire, the antenna elements are supplied with power at a one to one ratio, and the ground conductor is a rectangle having one side of 2.75 wavelengths parallel to the X-axis and the other side of 2.25 wavelengths parallel to the Y-axis. In FIG. 39, X and Y indicate the direction parallel to the plane of the ground conductor 221, and Z indicates the direction perpendicular to the ground conductor 221. The radiation directivity is calibrated in 10 dB, and the unit is dBd, referred to the gain of a dipole antenna.

Thus, an antenna capable of changing the directivity of radiation waves is achieved by arranging the antenna elements so as to form an array at an appropriate interval and by providing the antenna elements with an appropriate phase difference and an appropriate power distribution ratio.

However, the first prior art antenna has the following drawback; intensifying the radiation in the horizontal direction of the antenna requires a two-dimensionally large ground conductor 211, which is against miniaturization of the monopole antenna. A monopole antenna is not allowed to occupy so large an area on a ceiling, which is one of the best sites indoors for the monopole antenna. Hence the first prior art antenna, which must be large in size because of its being difficult to be small two-dimensionally, is unsuitable.

On the other hand, the second prior art antenna can intensify radiation waves by providing directivity in the horizontal direction of the antenna. However, it requires to have the power supply paths 226 and 227 and the power distribution/composition circuit 228, which intrinsically causes an intrinsic loss in these components 226, 227, and 228 due to the structure of the circuit.

Another loss is caused when the waves radiated from one antenna element 224 (225) are undesirably received by the other antenna element 225 (224) due to poor isolation between the antenna elements. These losses deteriorate the radiation efficiency. The latter loss in particular leads to a reflection loss as the entire antenna array, and the reflected signal may reversely flow to each device connected to the antenna, thereby badly affecting the characteristics of each device.

In order to secure excellent antenna characteristics, the former loss should be reduced in the power supply paths and the power distribution/composition circuit 228, and the latter case requires establishing good isolation between the antenna elements. In the former case, components having a fewer loss can be employed as the power supply paths 226 and 227 and the power distribution/composition circuit 228. The latter case needs to extend the distance between the antenna elements. Hence, the antenna array in the second prior art is unsuitable for miniaturization of an antenna.

When there are more than two antenna elements, the distance between them is considered to become larger than in the second prior art antenna that have two antenna elements. The large-scale antenna array is unsuitable for the miniaturization of an antenna. A monopole antenna is not allowed to occupy so large an area on the ceiling, which is one of the best sites indoors for a monopole antenna.

Hence the second prior art antenna, which must be large in size because of its being difficult to be small two-dimensionally, is also unsuitable.

When an antenna is installed on a ceiling, in order to enhance the efficiency of wave radiation, it is preferable to hang the antenna elements upside down from the ceiling so as to make them face the space into which radio waves are radiated.

It is further preferable that there is nothing to disturb the propagation of the radio waves between the antenna and the entire radiation space, and that the space including the entire radiation targets can be seen from the antenna elements. It is further desired to install a monopole antenna inconspicuously not to be an eyesore; however, in the prior art antennas shown in FIGS. 36 through 39 the antenna elements project from the ceiling unsightly, and the structure of the first and second prior art antennas cannot satisfy the demand due to their failure to be miniaturized.

SUMMARY OF THE INVENTION

In view of the above problems, the main object of the present invention is to provide an antenna, which is small in size, particularly its top side, and capable of changing the directivity of radio waves, and an antenna device and a radio equipment that use the antenna.

One aspect of the present invention is an antenna comprising:

a conductive bottom member;

a conductive side member; and a conductive member arranged in a space surrounded by the bottom member and the side member, wherein the conductive member is connected to a signal line for transmission and/or reception.

Another aspect of the present invention is the antenna, wherein the bottom member is grounded as a ground conductor.

Still another aspect of the present invention is the antenna, wherein the bottom member has a feeding point on a surface thereof.

Yet another aspect of the present invention is the antenna, wherein the conductive member and the bottom member are connected to each other in a place other than the signal line the feeding point.

Still yet another aspect of the present invention is the antenna, wherein the conductive member and the side member are connected to each other.

A further aspect of the present invention is the antenna further comprising:

a conductive ceiling member covering all or part of the space.

A still further aspect of the present invention is the antenna, wherein the conductive member and the ceiling member are connected to each other electrically and/or mechanically.

A yet further aspect of the present invention is the antenna, wherein the ceiling member and the side member are connected to each other electrically.

A still yet further aspect of the present invention is the antenna, wherein the ceiling member has a periphery having a curved shape.

An additional aspect of the present invention is the antenna, wherein the bottom member and/or the side member have openings.

A still additional aspect of the present invention is the antenna, wherein the ceiling member has openings.

A yet additional aspect of the present invention is the antenna, wherein the openings have means of adjusting their size.

A still yet additional aspect of the present invention is the antenna, wherein, if it is assumed that a projection of the conductive member onto the bottom member is an origin point and the bottom member is arranged in an X-Y plane, the bottom member and the side member are symmetric with respect to a Z-Y plane, and the openings are symmetrically arranged with respect to a Z-Y plane.

A supplementary aspect of the present invention is the antenna, wherein the bottom member and the side member are symmetric with respect to a Z-X plane, and the openings are symmetrically arranged with respect to a Z-X plane.

A still supplementary aspect of the present invention is the antenna, comprising a dielectric member that has a permittivity higher than air and is provided in the space.

A yet supplementary aspect of the present invention the antenna, wherein the dielectric member is provided at least so as to cover a part of the space which is not covered with the ceiling conductor.

A still yet supplementary aspect of the present invention is the antenna, wherein the dielectric member fills the entire inside of the space.

One aspect of the present invention the antenna, wherein the dielectric member has a via hole, and the side member consists of the via hole.

Another aspect of the present invention is the antenna, further comprising at least one matching element which is arranged apart by a predetermined distance from the conductive member, wherein the matching element and the bottom member are connected to each other electrically.

Still another aspect of the present invention is the antenna, wherein at least one of the matching elements is electrically connected to the conductive member.

Yet another aspect of the present invention is the antenna, wherein at least one of the matching elements is electrically connected to the ceiling member and/or the side member.

Still yet another aspect of the present invention is an arrangement method of antennas that is an arrangement method of the antennas, comprising a step of aligning and arranging the plural antennas in a manner to conform a direction for minimizing directivity of each of the antennas on a horizontal plane.

A further aspect of the present invention is an antenna device comprising:

all or part of a circuit for transmission and/or reception which is connected to the signal line while being arranged in the space.

A still further aspect of the present invention is the antenna device, further comprising a shielding member of covering all or part of the circuit, wherein the shielding member does not contact to the conductive member electrically.

A yet further aspect of the present invention is the antenna device, wherein the shielding member is formed as a concave portion that is each part of the bottom member and/or the side member; and wherein all or part of the circuit is arranged in the concave portion.

A still yet further aspect of the present invention is the antenna device, further comprising a lid member which covers the concave portion and stores all or part of the circuit, wherein the lid member is electrically connected to the bottom member and/or the side member.

An additional further aspect of the present invention is the antenna device, wherein the circuit is constituted with a passive circuit.

A still additional further aspect of the present invention is the antenna device, wherein an active element is contained in the circuit.

A yet additional further aspect of the present invention is the antenna device, wherein a microwave circuit is contained in the circuit.

A still yet additional aspect of the present invention is the antenna device, wherein an optical passive element is contained in the circuit.

A supplementary aspect of the present invention is the antenna device, wherein an optical active element is contained in the circuit.

A still supplementary aspect of the present invention is the antenna device, wherein the circuit has an IC.

A yet supplementary aspect of the present invention is the antenna device wherein the circuit has such size that the circuit is hidden behind the ceiling member, when viewing the antenna device from the ceiling member, side in the direction perpendicularly to the ceiling member.

A still yet supplementary aspect of the present invention is an array antenna device that is an array antenna device where the plural antenna devices are arrayed, wherein the circuits in the plural antenna devices each input or output the same signal.

Another aspect of the present invention is the array antenna device, wherein the circuit has a cartridge form so as to be detachable from the antenna.

Still another aspect of the present invention is the antenna device, wherein the circuit comprises plural sub-circuits having radio systems different from each other, and switching means of switching the connection between anyone of the sub-circuits an the antenna.

Yet another aspect of the present invention is the antenna device, wherein the circuit is arranged in the position that hides the circuit behind the ceiling member, when viewing the antenna device from the ceiling member side in the direction perpendicularly to the ceiling member.

Still yet another aspect of the present invention is the antenna device, wherein the circuit comprises: amplification means of amplifying the signal for the transmission and/or reception; and frequency selection means of selecting a frequency of the signal for transmission or the signal for reception.

A further aspect of the present invention is a radio equipment comprising the antenna device, and a power supply circuit provided in the circuit.

| [Description of Symbols] | |
|---|---|
| 11 | Ground conductor |
| 12 | Coaxial power supply part |
| 13 | Antenna element |
| 14 | Side conductor |
| 15 | Ceiling conductor |
| 16, 17 | Opening space |
| 18, 19 | Matching conductor |
| 20 | Opening control unit |
| 111 | Ground conductor |
| 112 | Antenna element |
| 113 | Side conductor |
| 114 | Circuit |
| 115 | Shielding conductor |
| 116 | Power supply part |
| 117 | Ceiling conductor |
| 118 | Opening |
| 119 | Connection point |
| 120 | High frequency filter |
| 121 | Amplification circuit |
| 122 | Laser diode |
| 123 | Optical fiber |
| 124 | Photo diode |
| 125 | Concave portion |
| 126 | Lid conductor |
| 131a | Transmitting antenna |
| 131b | Receiving antenna |
| 132a, 132b | Signal transmission cable |
| 133 | Radio circuit |

EMBODIMENTS OF THE INVENTION

Hereafter, the present invention will be described in detail with reference to drawings.

(Embodiment 1)

Figure 1A:
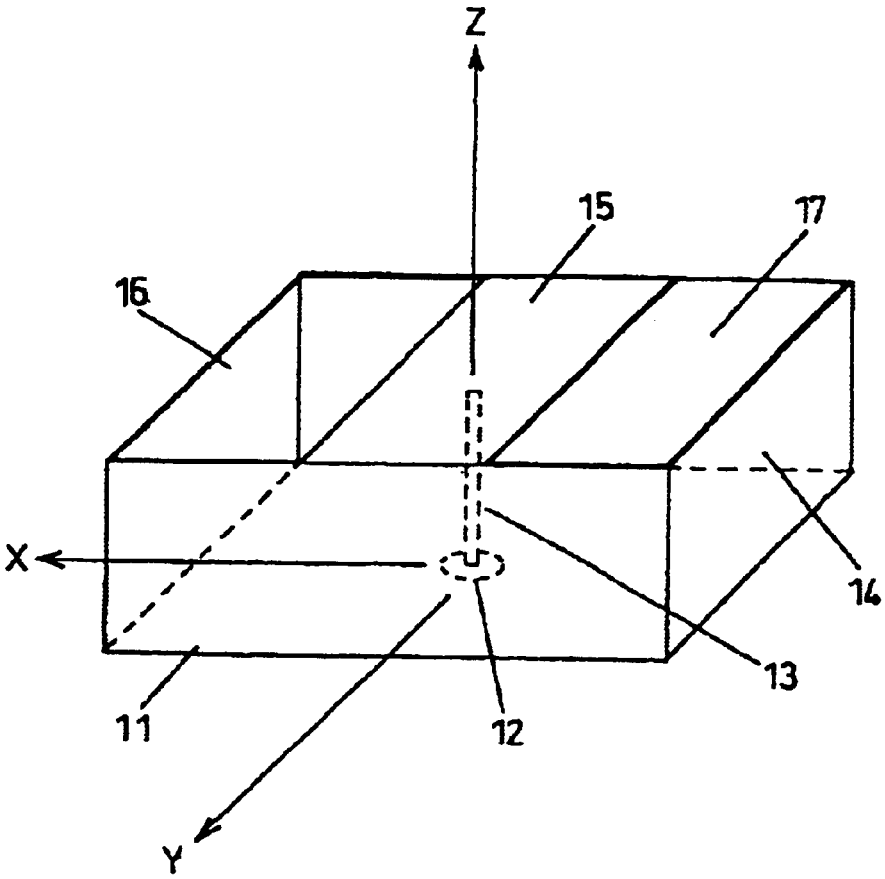
FIG. 1A is a schematic perspective view of a monopole antenna in a first embodiment of the present invention.
Figure 1B:
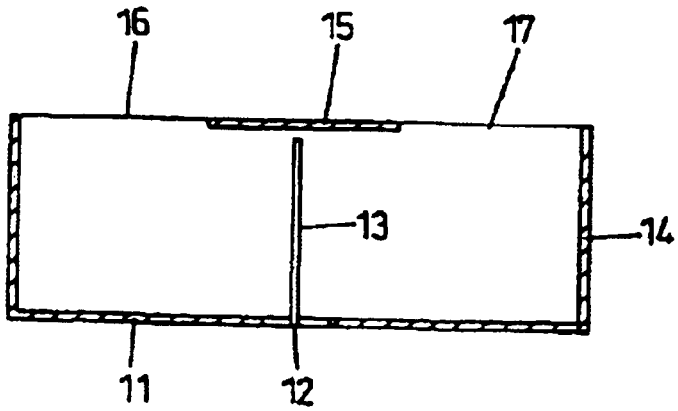
FIG. 1B is a cross section of the monopole antenna in the first embodiment of the present invention.

A monopole antenna according to a first embodiment of the present invention is shown in FIGS. 1A and 1B. FIG. 1A shows a schematic perspective view of a monopole antenna and FIG. 1B shows its sectional view. FIGS. 1A and 1B show a ground conductor 11, a coaxial power supply part 12 as an example of a feeding point according to the present invention, an antenna element 13, a side conductor 14, a ceiling conductor 15, and openings 16 and 17. In addition, in FIG. 1A, an X-axis, a Y-axis, and a Z-axis are set by making the coaxial power supply part 12 be an origin point, and the structure of each part of the monopole antenna is performed on the basis of these coordinates. This is the same also in the figures referred to in the following embodiments.

The monopole antenna having the above components has the following structure. The ground conductor 11 is arranged on the X-Y plane (a plane formed by the X-axis and Y-axis; this is also similar to the following embodiments). The ground conductor 11, the side conductor 14, and the ceiling conductor 15 are electrically connected to each other so as to constitute a cuboid symmetric with respect to both the Z-Y plane (a plane formed by the Z-axis and Y-axis; this is also similar to the following embodiments) and the Z-X plane (a plane formed by the Z-axis and X-axis; this is also similar to the following embodiments).

The ceiling conductor 15 does not cover the entire opening above the ground conductor 11 surrounded by the side conductor 14; a pair of openings 16 and 17 having the same rectangular shape are formed between the side conductor 14 and a side edge of the ceiling conductor 11 in the X direction. The openings 16 and 17 are symmetric with respect to the Z-Y plane. The coaxial power supply part 12 is arranged on the origin point. The antenna element 13 is made of a conductive wire arranged inside the monopole antenna along the + axis (a forward direction shown by an arrow) in the Z direction, and one end of the element 13 is connected to the coaxial power supply part 12. As a result, the openings 16 and 17 are arranged symmetrically with respect to the antenna element 13. At this time, the antenna element 13 and the ground conductor 11 are not connected electrically.

Behaviors of the antenna will be described with reference to FIG. 2.

Figure 2A:
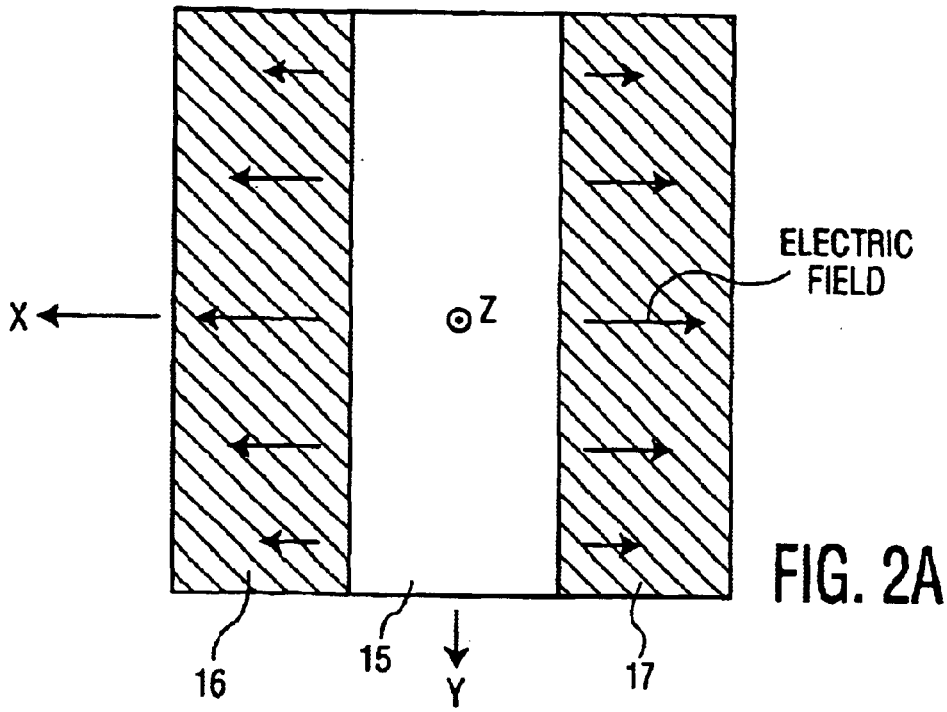
FIG. 2 is a drawing showing the operation principle of the first embodiment.
Figure 2B:
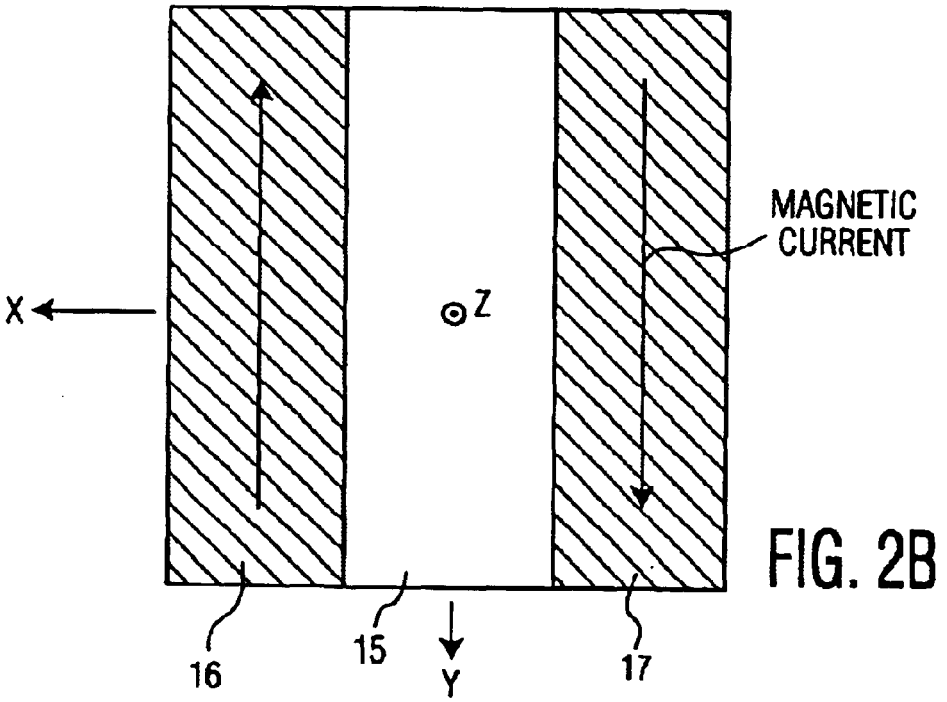

A radio wave having the frequency of $f_0$ is radiated from the antenna element 13. The wave is radiated out into an external space through the openings 16 and 17. In the present embodiment, the openings 16 and 17 are arranged to be symmetric with respect to the antenna element 13, which is the wave radiation source, and the electric fields excited to the openings 16 and 17 by the antenna element 13 are formed in the opposite directions to each other as shown in FIG. 2A. The electric fields excited to the openings 16 and 17 are explained as follows by being replaced by magnetic currents. As shown in FIG. 2B, linear magnetic current sources having the same amplitude are caused in the directions opposite to each other and parallel to the Y-axis in the openings 16 and 17 respectivelly.

The radiation of waves in this monopole antenna is considered to come from these two magnetic current sources. To be more specific, the radiation of radiowaves in the monopole antenna can be regarded as mixture radiation due to an antenna array having these two magnetic current sources arranged in parallel.

In a general antenna array, the direction to intensify radiation waves depends on an array factor determined by the phase difference of the currents supplied to the antenna elements and the distance between the antenna elements. The radiation waves for the antenna array as a whole are the product of the array factor and the radiation pattern of a single antenna element. The approximate radiation pattern of the antenna will be found by replacing the radiation pattern of the single antenna element by the radiation pattern due to a single linear magnetic current source.

To be more specific, since magnetic current sources are arranged symmetrically with respect to the Z-Y plane, the radio waves radiated from the two magnetic current sources have reversed phases to each other and are compensated with each other with the same amplitude on the plane parallel to the Z-Y plane. Thus, the radio waves are hardly radiated in the direction parallel to the Z-Y plane. The plane parallel to the Z-X plane has a direction in which the radio waves radiated from the two magnetic current sources have the same phase, and the radio waves are intensified in that direction. For example, when the distance between the magnetic current sources is ½ wavelength in a free space, the radiation waves are intensified in the +X direction and the −X direction because they have the same phase in the X-axis direction.

Thus, this structure of the monopole antenna can bring the effects of an antenna array out of a single antenna element, thereby changing the directivity of the monopole antenna.

Furthermore, extending the length of the openings 16 and 17 in the Y direction makes the magnetic current sources longer, thereby narrowing the radiation in the X direction so as to increase the gain. In short, the gain can be adjusted by the length of the openings 16 and 17.

A monopole antenna having a finite-size ground conductor generally has a radio wave diffraction at the edge of the ground conductor; the radio wave radiated from the monopole antenna having a finite-size ground conductor is the sum of the radiation waves from the antenna elements and the diffraction waves at the edge of the ground conductor.

This holds true in the monopole antenna of the present embodiment. Diffraction occurs at all the edges and folded positions of the ceiling conductor 15, the side conductor 14, and the ground conductor 11. The influence of the diffraction waves becomes greater particularly at the edge of the ceiling conductor 15 when the ceiling conductor 15 has the openings 16 and 17 like in the present embodiment.

As described hereinbefore, in the monopole antenna of the present embodiment, the directivity of the radiation waves can be changed according to the size and shape of each of the ceiling conductor 15, the side conductor 14, and the ground conductor 11, in addition to the position, number, and size of the openings 16 and 17.

Figure 3:
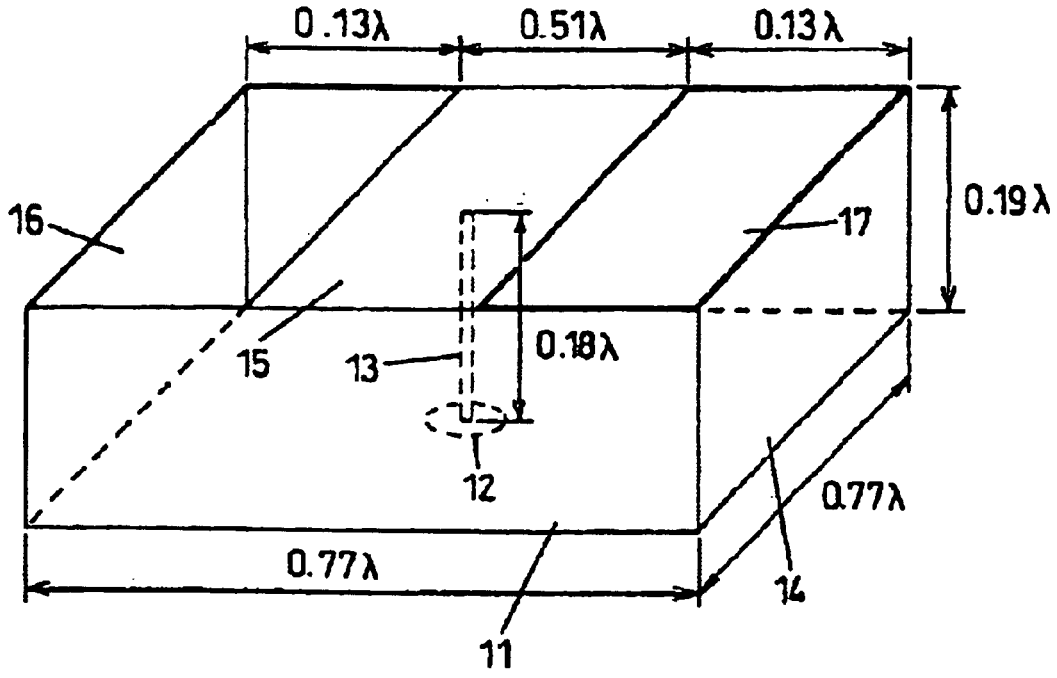
FIG. 3 is a schematic perspective view showing a working prototype of the first embodiment.
Figure 4:
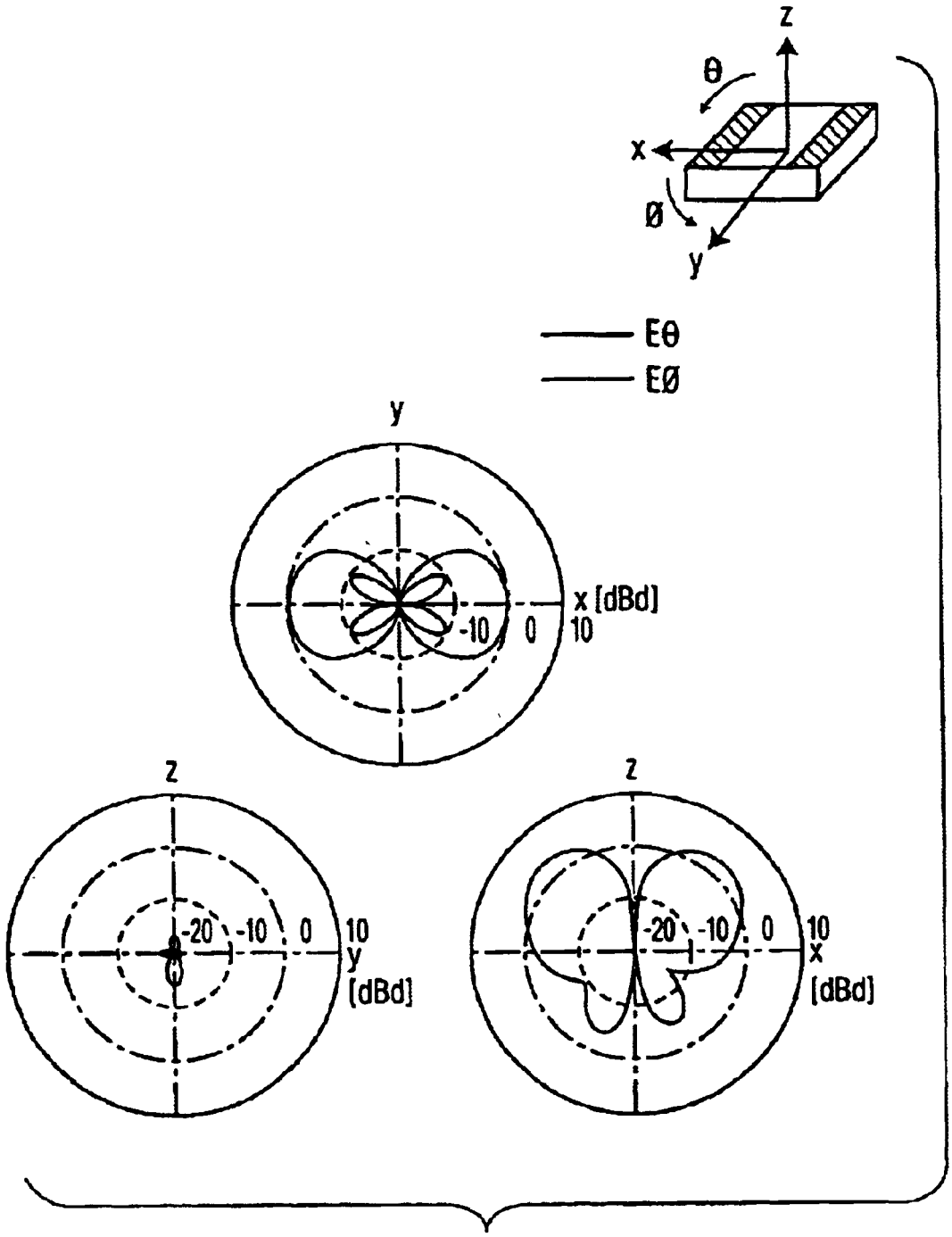
FIG. 4 is a diagram showing the radiation directivity of the working prototype of the first embodiment.
Figure 5:
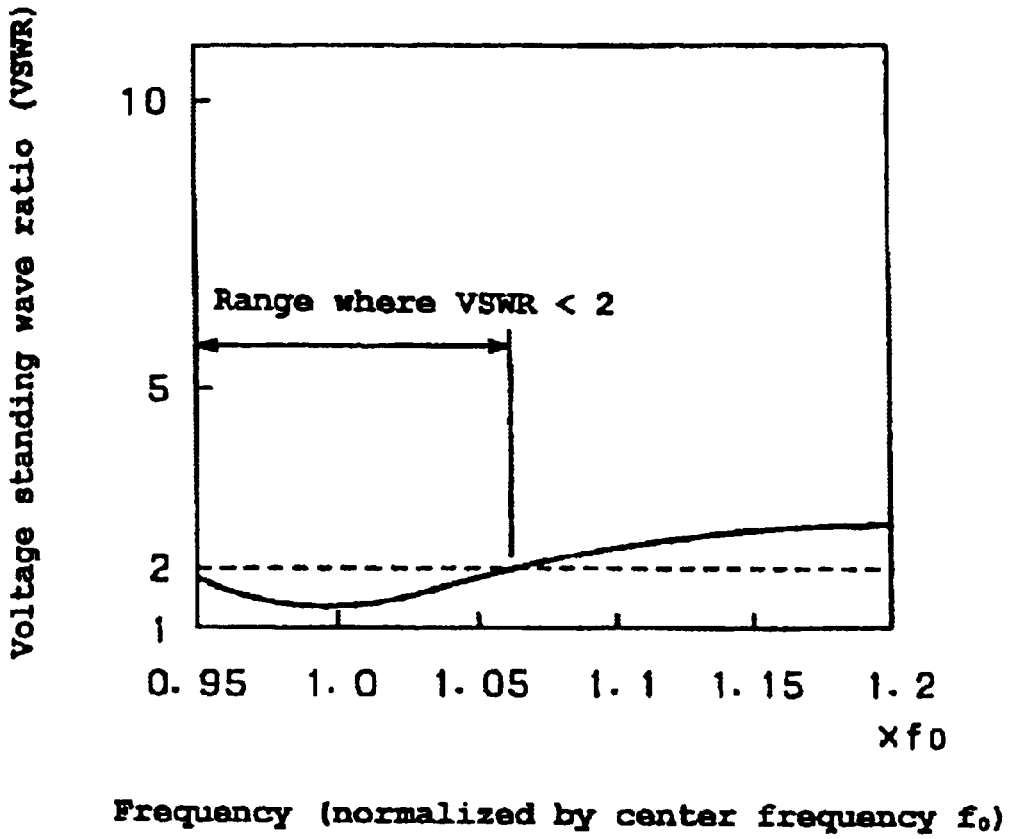
FIG. 5 is a graph showing the impedance characteristics of the working prototype of the first embodiment.

A working prototype of an antenna, its radiation directivity, and input impedance characteristics are shown in FIGS. 3, 4, and 5, respectively.

The prototype is as follows. The ground conductor 11 was made to be a square of 0.76×0.76 wavelength, referred to the free space wavelength (λ). The height of the side conductor 14 was made 0.19 wavelength. The ceiling conductor 15 was made to be a rectangle having one side with the length of 0.50 wavelength parallel to the X-axis and the other side with the length of 0.76 wavelength parallel to the Y-axis. The openings 16 and 17 each were made to be a rectangle having one side with the length of 0.13 wavelength parallel to the X-axis and the other side with the length of 0.76 wavelength parallel to the Y-axis.

The openings 16 and 17 thus structured were arranged at both edges of the ceiling conductor 15 in the X-axis direction to be symmetric with respect to the Z-Y plane. The coaxial power supply part 12 was arranged on the origin point. The antenna element 13 was made of a conductive wire arranged along the Z-axis to have the length of 0.18 wavelength. The monopole antenna thus structured becomes symmetric with respect to the Z-X plane and the Z-Y plane.

FIG. 4 shows the radiation directivity of the monopole antenna with the above-mentioned structure. The radiation directivity is calibrated in 10 dB, and the unit is dBd, referred to the gain of a dipole antenna.

Figure 37A:
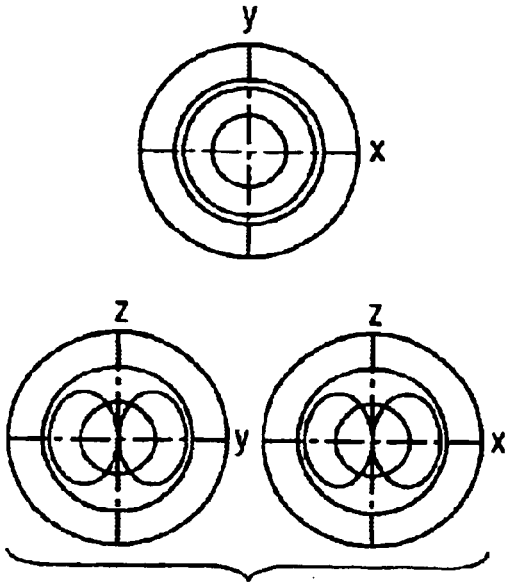
FIG. 37A is a diagram showing the radiation directivity of the monopole antenna of a first conventional example.
Figure 37B:
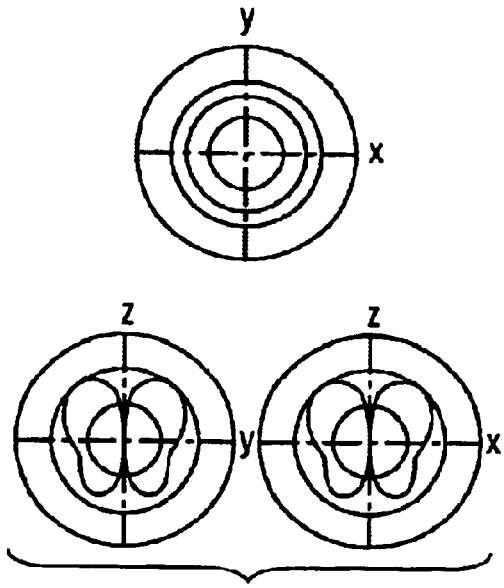
FIG. 37B is a diagram showing the radiation directivity of the monopole antenna of the first conventional example.
Figure 37C:
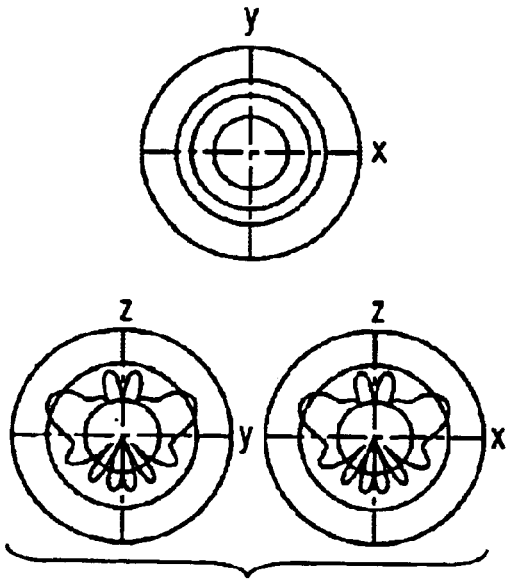
FIG. 37C is a diagram showing the radiation directivity of the monopole antenna of the first conventional example.
Figure 37D:
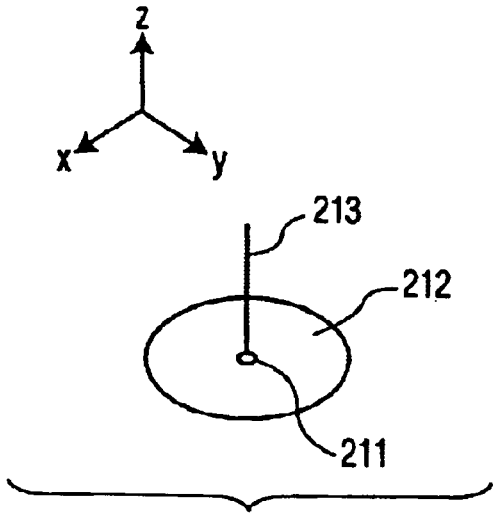
FIG. 37D is a diagram showing the radiation directivity of the monopole antenna of the first conventional example.
Figure 38:
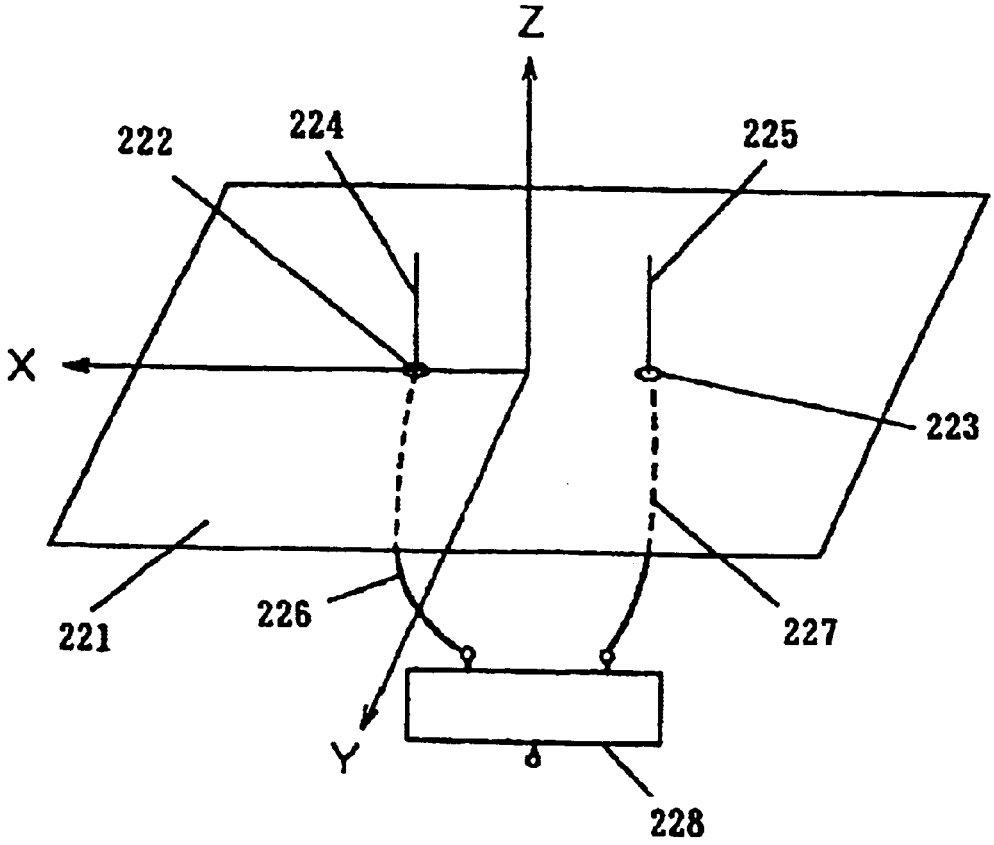
FIG. 38 is a perspective view showing the structure of a second conventional monopole antenna.
Figure 39:
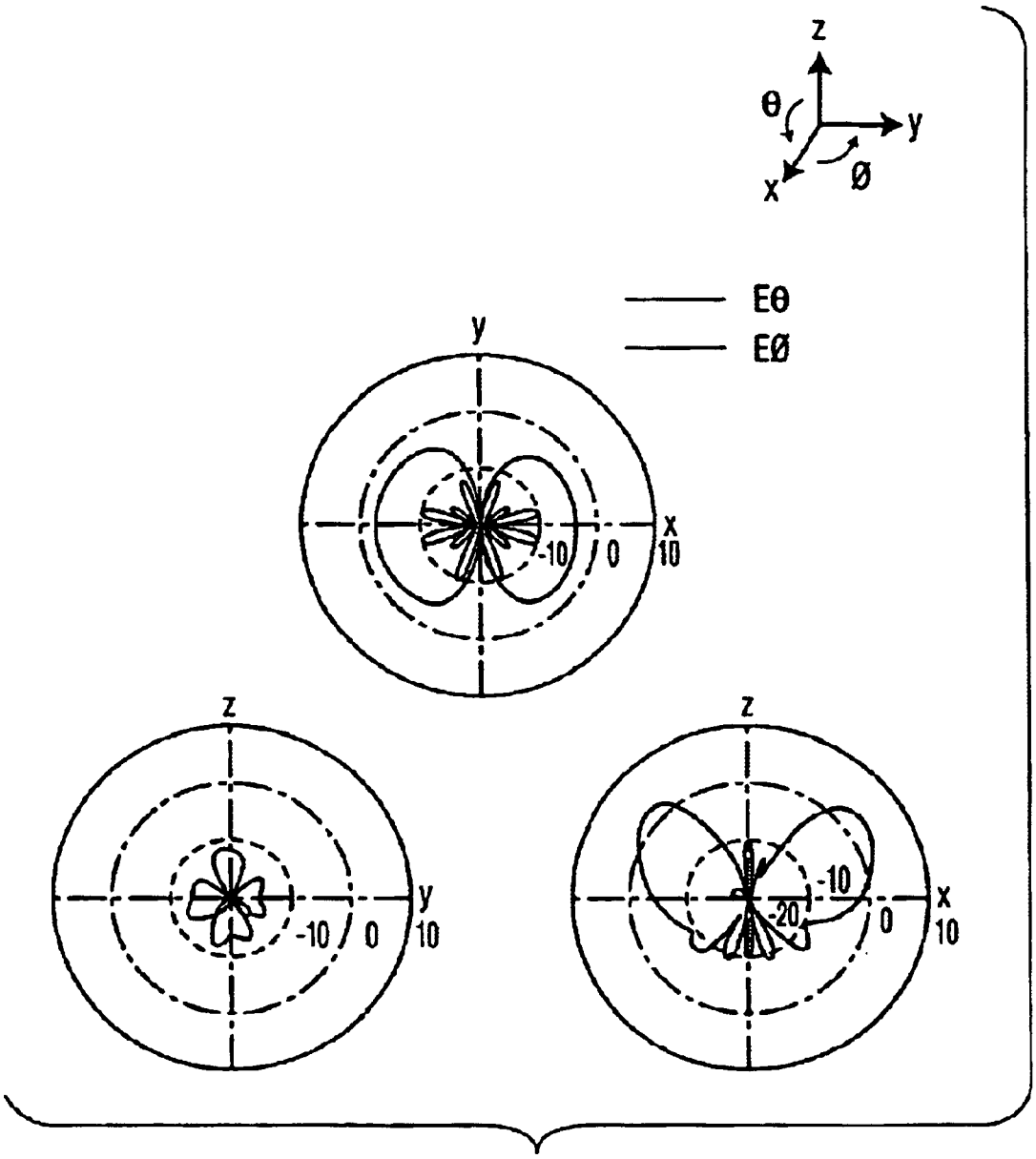
FIG. 39 is a diagram showing the radiation directivity of the monopole antenna of the second conventional example.

As shown in the radiation directivity on the Y-X plane and Z-Y plane in FIG. 4, in this monopole antenna, radio wave radiation is reduced in the Y direction, and as shown in the radiation directivity on the Y-X plane and Z-X plane, radio wave radiation is intensified in the X direction. A comparison with the characteristics of the prior art monopole antenna shown in FIG. 37B indicates that the radiation is intensified by about 2.4 dB in the maximum radiation direction. Furthermore, this antenna does not radiate waves to the bottom side (the −Z direction) and radiates strong waves to the top side (the +Z direction). Particularly strong waves are radiated in the diagonally horizontal direction of the antenna, showing strong directivity in this direction.

The side conductor 14 surrounding the antenna element 13 and the ground conductor 11 together reduce the radiation to the bottom side, that is, in the −Z direction. Hence, this monopole antenna is suitable to be installed in a narrow indoor space like a corridor.

Since the monopole antenna has the openings 16 and 17 for wave radiation arranged on the antenna ceiling portion, and the antenna element 13 as a radiation source is surrounded by the ground conductor 11 and the side conductor 14, the radiation waves are not strongly affected by the antenna arrangement environment in the antenna side and bottom directions. This makes it possible that, when the monopole antenna is installed on the indoor ceiling, the antenna is embedded in the indoor ceiling with the antenna ceiling portion downwards in such a manner that the ceiling conductor 15 forms the same plane with the ceiling of the room that is radiation space. As a result, the antenna becomes inconspicuous without projecting from the ceiling to be an eyesore.

FIG. 5 shows the VSWR (voltage standing wave ratio) characteristics of the monopole antenna when input impedances are matched with 50 Ω. As shown in FIG. 5, the monopole antenna resonates at the frequency of $f_0$, and has an about 10% frequency band where the VSWR is two or below. Thus, the monopole antenna has excellent characteristics also in terms of impedance characteristics.

In the monopole antenna, the height of the antenna element 13 (hereafter, this is called antenna element height; this is also similar to the following embodiments) is 0.18 wavelength, which is lower than the ordinary ¼ wavelength monopole antenna element. The reason for this is as follows. The ceiling conductor 15 is arranged at the height of 0.19 wavelength very close to the end portion of the antenna element 13, so that the capacitive coupling is caused between them, which becomes equivalent to having a capacitive load at the end portion of the antenna element 13. This brings about top loading effects, thereby decreasing the antenna element height.

This monopole antenna is characterized in that the antenna element 13 and the ceiling conductor 15 are arranged very closely to each other, so that a minor increase or decrease in the distance between them can make the input impedances unstable. It becomes possible to stabilize the input impedance characteristics by disposing a spacer made of an insulator, a dielectric member, or the like and mechanically fixing the distance between the antenna element 13 and the ceiling conductor 15.

As described hereinbefore, the structure of this monopole antenna can make the antenna element 13 low-profile, which makes the antenna inconspicuous and far from being an eyesore when it is embedded in an indoor ceiling.

In the case where the monopole antenna is symmetric with respect to the Z-Y plane and the Z-X plane like the present embodiment, the directivity of the radiation waves from the antenna becomes symmetric with respect to the Z-Y plane and the Z-X plane.

Hence, the first embodiment achieves a compact and excellent monopole antenna having a simple structure and desired directivity.

(Embodiment 2)

Figure 6A:
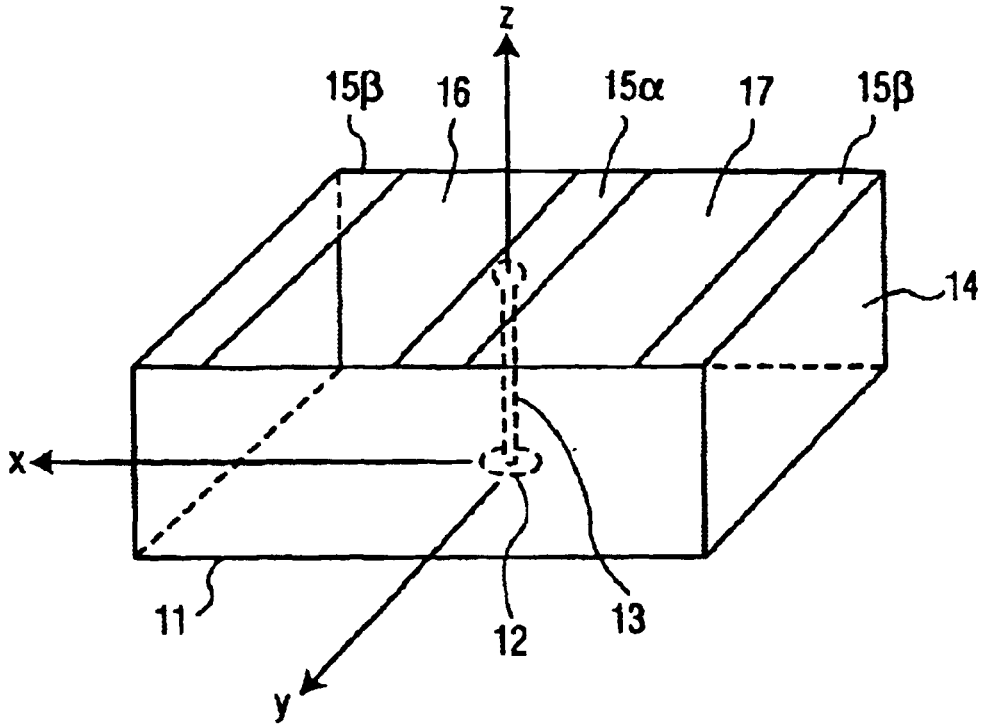
FIG. 6A is a schematic perspective view of a monopole antenna according to a second embodiment of the present invention.
Figure 6B:
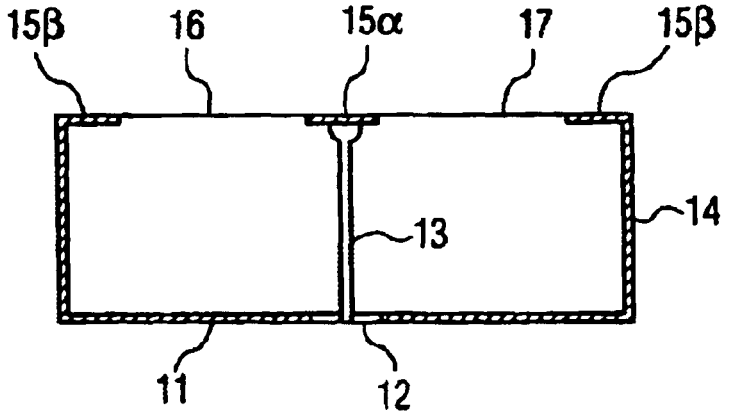
FIG. 6B is a cross section of the monopole antenna in the second embodiment of the present invention.

A second embodiment of the present invention will be described as follows with reference to FIGS. 6A and 6B, where like components are labeled with like reference numerals with respect to FIG. 1. Moreover, the ceiling conductor 15 comprises a ceiling conductor 15α that is divided by the Z-Y plane, and two ceiling conductors 15β connected respectively with two side conductors 14 that are arranged on the X-axis.

The monopole antenna of the present embodiment is characterized by the antenna element 13. Thus, one end of the antenna element 13 is electrically connected to the coaxial power supply part 12, and the other end to the ceiling conductor 15α mechanically and electrically.

The monopole antenna behaves in the same manner as that of the first embodiment.

In the monopole antenna of the first embodiment, the ceiling conductor 15 and the end portion of the antenna element 13 may be arranged very close to each other. In this case, a change in the distance between them is likely to vary the input impedances of the antenna, thereby deteriorating the matching conditions with the coaxial power supply part 12. As a result, less power is supplied to the antenna element 13, which reduces the radiation efficiency of the antenna.

In contrast, in the present embodiment, the ceiling conductor 15α and the antenna element 13 are combined with soldering or the like so as to stabilize the electric and mechanical relation between the ceiling conductor 15 and the antenna element 13. This enhances the stability of the structure and impedance characteristics of the antenna and improves the characteristics.

Although it is possible to dispose a spacer made of an insulator or a dielectric member as described in the first embodiment, the structure in the second embodiment is superior in some cases in terms of production easiness due to simplification of the structure.

Figure 7:
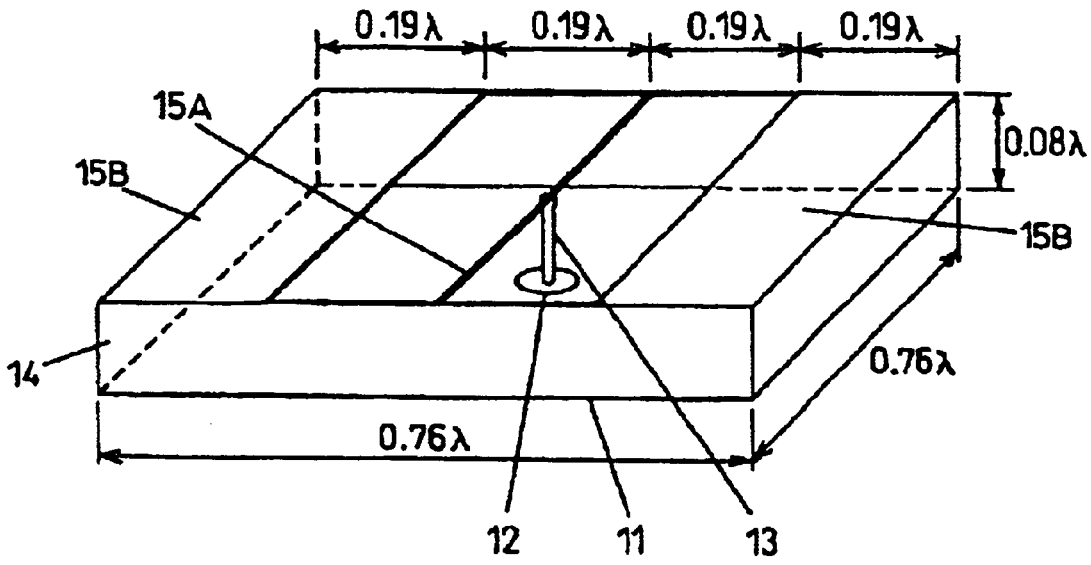
FIG. 7 is a schematic perspective view showing a working prototype of the second embodiment.
Figure 8:
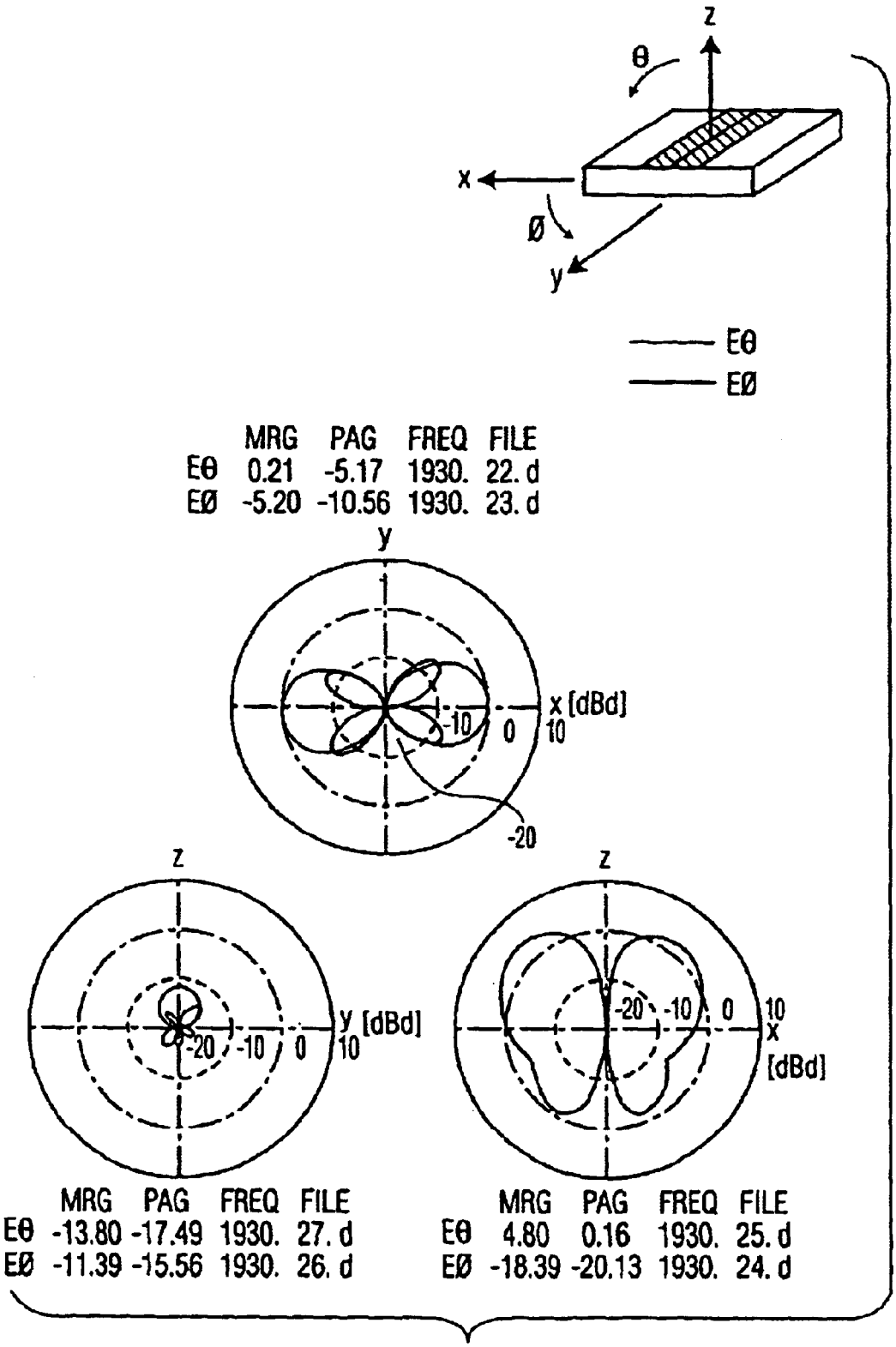
FIG. 8 is a diagram showing the radiation directivity of the working prototype of the second embodiment.
Figure 9:
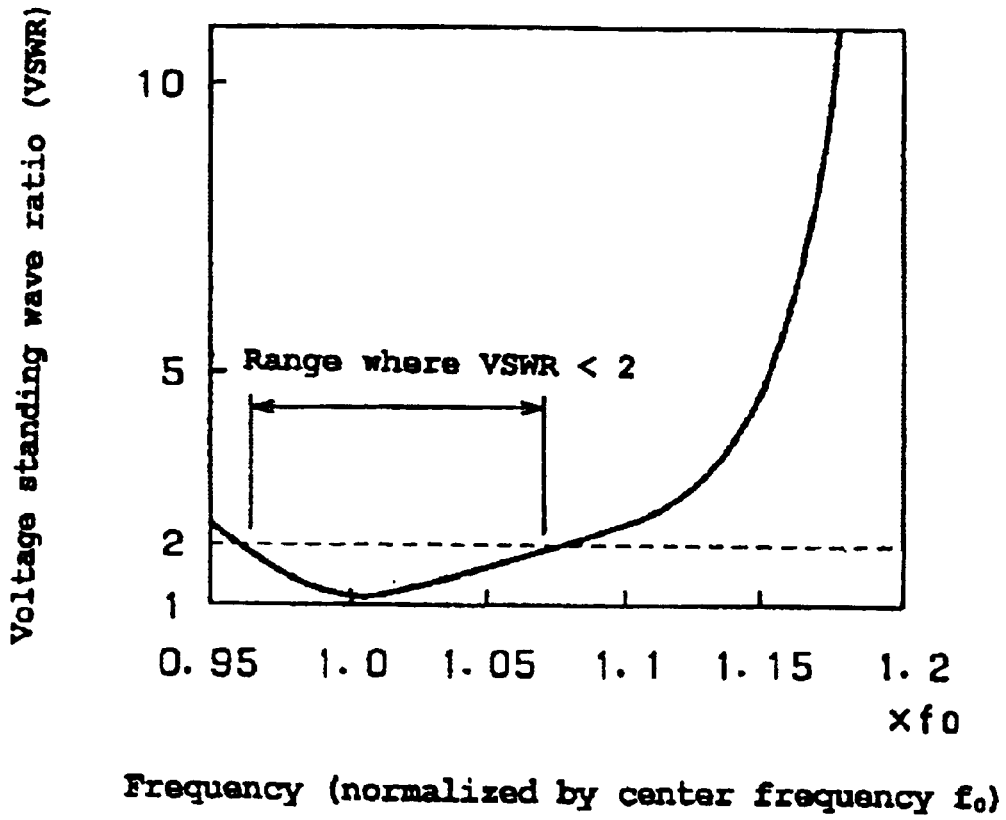
FIG. 9 is a graph showing the impedance characteristics of the working prototype of the second embodiment.

Next, the antenna actually made as an experiment is shown in FIG. 7, the radiation directivity is shown in FIG. 8, and the input impedance characteristic is shown in FIG. 9.

The prototype was as follows. The ground conductor 11 was made to be the square of 0.76×0.76 wavelength, referred to the free space wavelength. The height of the side conductor 14 was made 0.08 wavelength. The ceiling conductor 15*a* was composed of a linear conductor 15A and the ceiling conductor 15β was composed of two rectangular conductors 15B. The coaxial power supply part 12 was arranged on the origin point. The linear conductor 15A was made to have 0.76 wavelength and arranged to be parallel to the ceiling conductors 15A and 15B and also parallel to the Y-axis. Both ends of the linear conductor 15A were electrically connected to the side conductor 14. The rectangular conductors 15B each have the side of 0.19 wavelength parallel to the X-axis and the other side of 0.76 wavelength parallel to the Y-axis. These rectangular conductors 15B were arranged at both ends of the antenna ceiling portion in the X direction. The openings 16 and 17 were formed between the rectangular conductors 15B and the linear conductor 15A. The openings 16 and 17 each have the side of 0.19 wavelength parallel to the X-axis and the other side of 0.76 wavelength parallel to the Y-axis. The end portion of the antenna element 13 was electrically connected to the center in the longitudinal direction of the linear conductor 15A. The antenna element 13 was a conductive wire arranged in the Z-axis to have 0.08 wavelength. The monopole antenna thus structured becomes symmetric with respect to the Z-X plane and the Z-Y plane.

FIG. 8 shows the radiation directivity of the above-structured monopole antenna. The radiation directivity is calibrated in 10 dB, and the unit is dBd, referred to the gain of a dipole antenna.

As shown in the radiation directivity on the Y-X plane and the Z-Y plane in FIG. 4, in this monopole antenna, radio wave radiation is reduced in the Y direction, and as shown in the radiation directivity on the Y-X plane and the Z-X plane, radio wave radiation is intensified in the X direction. A comparison with the characteristics of the prior art monopole antenna shown in FIG. 37B indicates that the radiation is intensified by about 4 dB in the maximum radiation direction. Furthermore, as shown in FIG. 8, the antenna hardly radiates waves to the bottom side (−Z direction) and radiates strong waves to the top side (+Z direction). Particularly strong waves are radiated in the diagonally horizontal direction of the antenna, showing strong directivity in this direction. The side conductor 14 surrounding the antenna elements 13 and the ground conductor 11 together reduce the radiation to the bottom side, or in the −Z direction. Hence, the monopole antenna is suitable to be installed in a narrow indoor space like a corridor.

Because of the same reason mentioned in the first embodiment, the radiation waves are not strongly affected by the antenna arrangement environment in the antenna side and bottom directions. This makes it possible that the monopole antenna is installed to form the same plane with the indoor ceiling so that the ceiling portion of the antenna faces the radiation space. As a result, the antenna becomes inconspicuous without projecting from the ceiling to be an eyesore.

FIG. 9 shows the VSWR characteristics of the monopole antenna when input impedances are matched with 50 Ω.

As shown in FIG. 9, the monopole antenna resonates at the frequency of $f_0$, and has an about 10% frequency band where the VSWR is two or below. Thus, the monopole antenna has excellent characteristics in terms of impedance characteristics.

In the monopole antenna, the antenna element height is 0.08 wavelength, which is lower than the ordinary ¼ wavelength monopole antenna element. This is due to the top loading effects like in the first embodiment.

Thus in the structure of the antenna of the present embodiment, when not allowed to be embedded in the indoor ceiling, the antenna can be inconspicuous without being an eyesore and shorter than projecting from the ceiling, partly because of the low-profile effects of the antenna element.

Similarly to the first embodiment, the second embodiment has an effect that the directivity of the radiation waves from the antenna becomes symmetric with respect to the Z-Y plane and the Z-X plane by making the monopole antenna be symmetric with respect to each plane parallel to the Z-Y plane and each plane parallel to the Z-X plane.

Hence, the second embodiment achieves a compact and excellent monopole antenna having a simple structure and desired directivity.

(Embodiment 3)

Figure 10A:
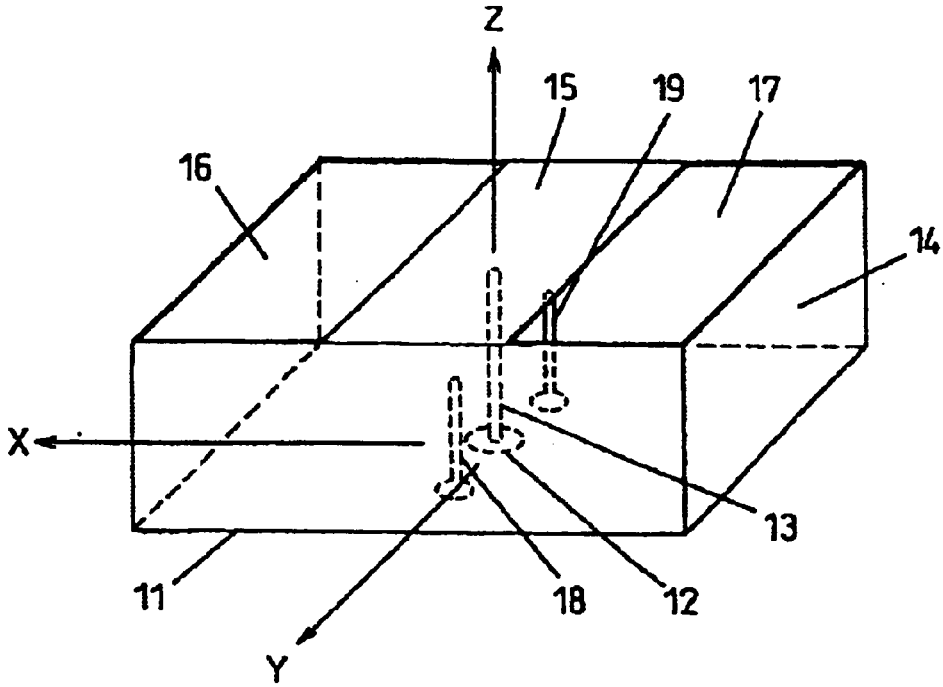
FIG. 10A is a schematic perspective view of a monopole antenna according to a third embodiment of the present invention.
Figure 10B:
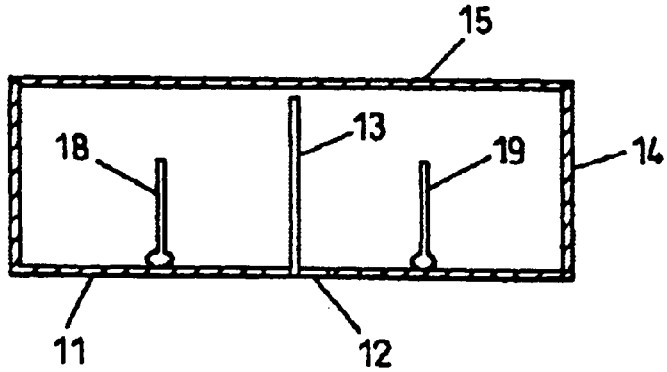
FIG. 10B is a cross section of the monopole antenna in the third embodiment of the present invention.

A third embodiment of the present invention will be described as follows with reference to FIGS. 10A and 10B where like components are labeled with like reference numerals with respect to FIG. 1.

The monopole antenna of the third embodiment is characterized by providing matching conductors 18 and 19, which are made of linear conductors and arranged in parallel to the Z-axis on the Z-Y plane. The matching conductors 18 and 19 are further arranged to be symmetric with respect to the antenna element 13 extending on the + direction of Z-axis. One end of each of the matching conductors 18 and 19 is electrically connected to the ground conductor 11, and the other end is arranged in a space that is surrounded by the ground conductor 11, the side conductor 14, and the ceiling conductor 15.

The monopole antenna behaves in the same manner as that of the first embodiment.

In the first and second embodiments, the matching between the coaxial power supply part 12 and the monopole antenna may be out of order. In that case, the antenna element 13 is supplied with less power, which deteriorates the radiation efficiency of the antenna.

In contrast, the monopole antenna of the present embodiment can make matching conditions with the coaxial power supply part 12 excellent by changing the impedances of the antenna by providing the matching conductors 18 and 19 with a distance between them near the antenna element 13. Enhancing the matching conditions improves the characteristics of the antenna.

Furthermore, arranging the matching conductors 18 and 19 so as not to affect the shape of the openings 16 and 17 allows the radiation directivity of the monopole antenna having the matching conductors 18 and 19 to be the same as the radiation directivity without them. This is because the substantial radiation source of the monopole antenna is mainly concentrated on the openings 16 and 17 as described in the first embodiment. Thus, this monopole antenna can establish excellent matching conditions of impedances with hardly changing desired radiation directivity.

Similarly to the first embodiment, in the third embodiment the directivity of the radiation waves from the antenna becomes symmetric with respect to the Z-Y plane and the Z-X plane by making the monopole antenna be symmetric with respect to the Z-Y plane and the Z-X plane.

Hence, the third embodiment achieves a compact and excellent monopole antenna having a simple structure and desired directivity.

(Embodiment 4)

Figure 11A:
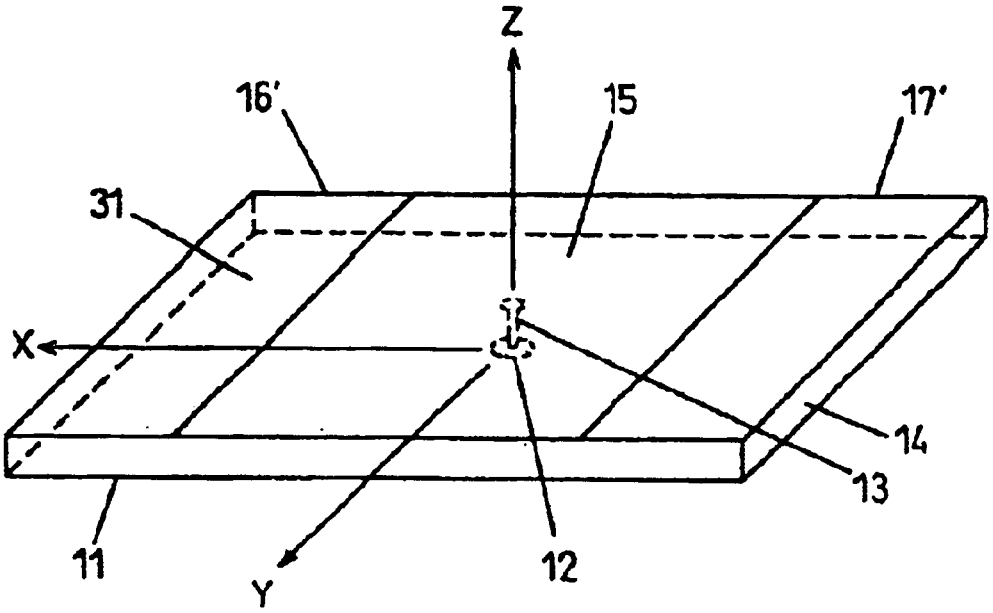
FIG. 11A is a schematic perspective view of a monopole antenna in a fourth embodiment of the present invention.
Figure 11B:
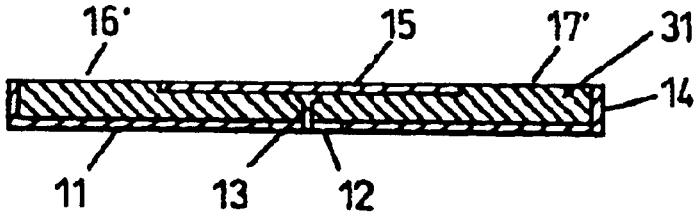
FIG. 11B is a cross section of the monopole antenna in the fourth embodiment of the present invention.

A fourth embodiment of the present invention will be described as follows with reference to FIGS. 11A and 11B where like components are labeled with like reference numerals with respect to FIG. 1. Moreover, reference numerals 16' and 17' denote openings.

The monopole antenna of the fourth embodiment is characterized in that a space inside the antenna surrounded by the ground conductor 11, the side conductor 14, and the ceiling conductor 15 is filled with a dielectric member 31. Therefore, the inside of the openings 16' and 17' is not hollow but the dielectric member layer 31 is exposed.

Assuming that the ratio (relative permittivity) of the permittivity of the dielectric member to the permittivity $\in 0$ in a vacuum is $\in\gamma$, the wavelength in the dielectric member becomes $(\in\gamma)^{-1/2}$ times the wavelength in a vacuum. Since $\in\gamma$ is not less than one, the wavelength becomes shorter inside the dielectric member. Therefore, integrating the dielectric member 31 to the antenna makes the antenna compact and low-profile.

Figure 12:
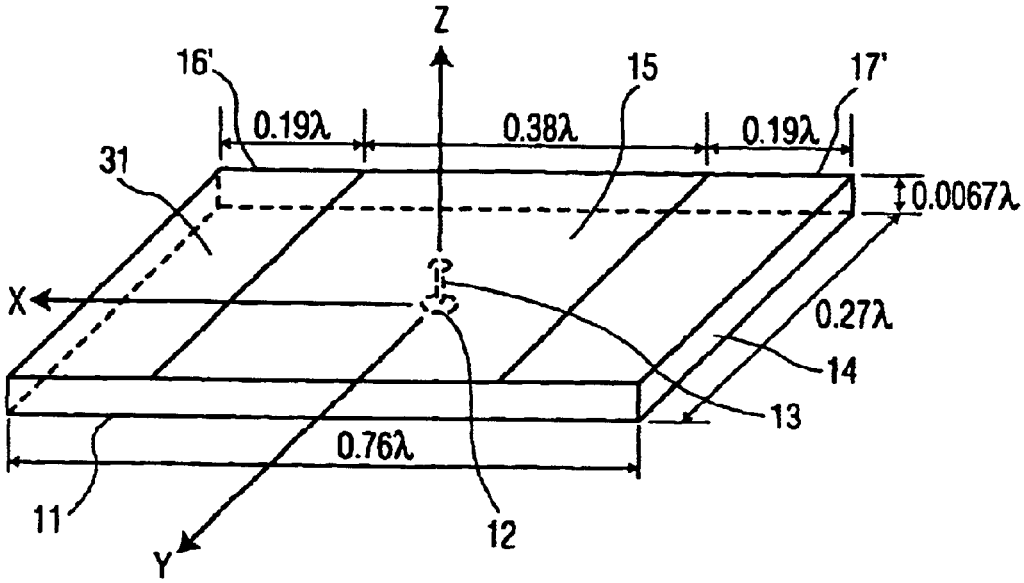
FIG. 12 is a schematic perspective view showing a working prototype of the fourth embodiment.
Figure 13:
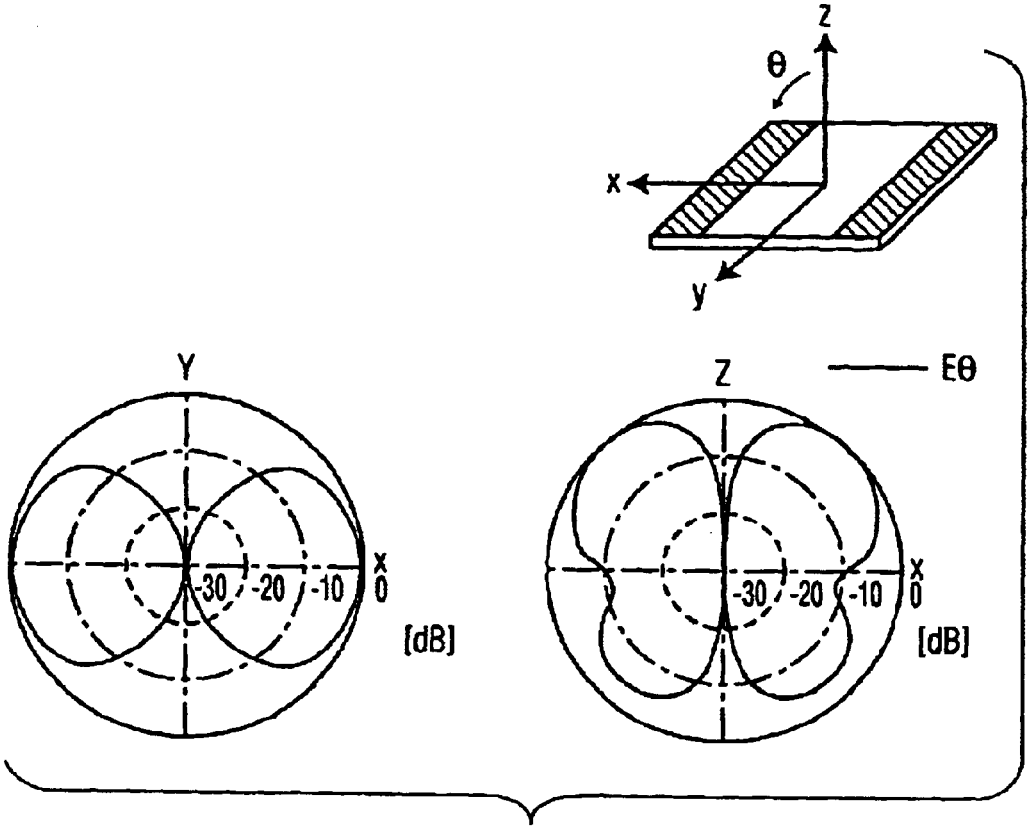
FIG. 13 is a diagram showing the radiation directivity of the working prototype of the fourth embodiment.
Figure 14:
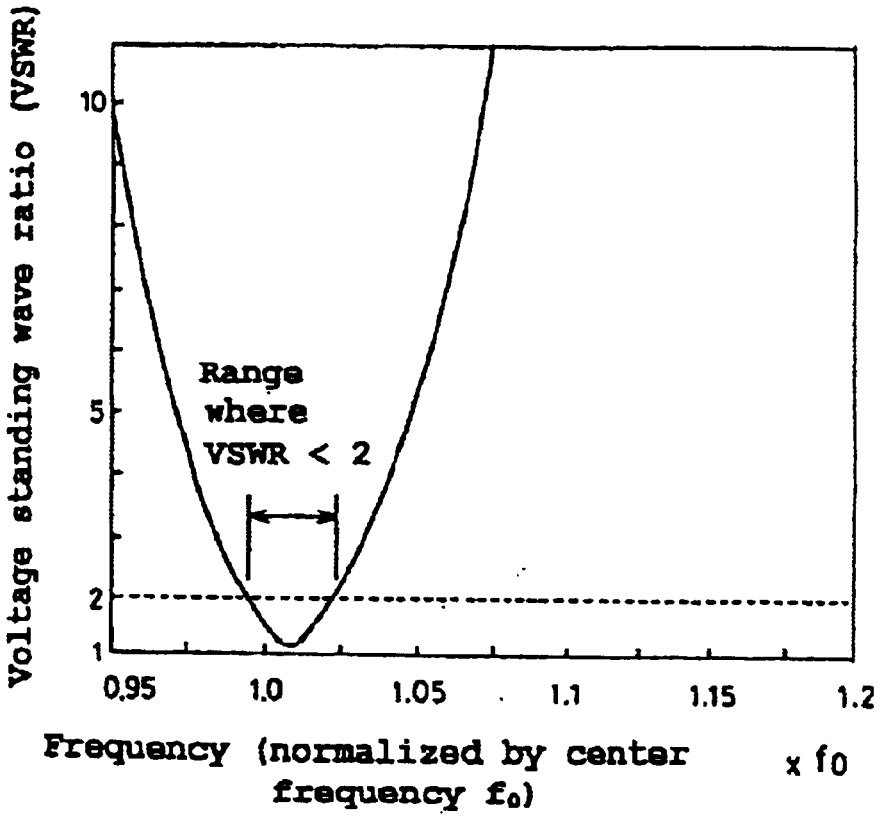
FIG. 14 is a graph showing the impedance characteristics of the working prototype of the fourth embodiment.

A working prototype antenna is shown in FIG. 12, and its radiation directivity and VSWR (voltage standing wave ratio) characteristics of input impedances matched with 50 Ω are shown in FIGS. 13 and 14, respectively.

The relative permittivity $\in\gamma$ of the dielectric member 31 was made 3.6. The ground conductor 11 was made to be a rectangle having a longer side with the length of 0.76 wavelength and the shorter side with the length of 0.27 wavelength, referred to the free space wavelength.

The height of the side conductor 14 was made 0.0067 wavelength. The ceiling conductor 15 was made to be a rectangle having a side with the length of 0.38 wavelength parallel to the X-axis and the other side with the length of 0.27 wavelength parallel to the Y-axis. The openings 16' and 17' were formed by peeling away from the dielectric member 31 the conductive film formed as the ceiling conductor 15 on the surface of the dielectric member 31. The openings 16' and 17' were each made to be a rectangle having a side with the length of 0.19 wavelength parallel to the X-axis and the other side with the length of 0.27 wavelength parallel to the Y-axis. The openings 16' and 17' thus formed are arranged at both ends of the ceiling conductor 15 along the X-axis so as to be symmetric with respect to the Z-Y plane. The antenna element 13 was a conductive wire having the length of 0.0067 wavelength. The coaxial power supply part 12 was arranged in the origin point, and one end of the antenna element 13 was electrically connected to the ceiling conductor 15. The monopole antenna thus structured becomes symmetric with respect to the Z-X plane and the Z-Y plane.

In FIG. 13, the radiation directivity is calibrated in 10 dB, which is normalized at the maximum value. This monopole antenna hardly radiates waves to the bottom side (−Z direction) and radiates strong waves to the top side (+Z direction) similarly to the above-mentioned embodiments. As shown in the radiation directivity on the Z-X plane, particularly strong waves are radiated in the diagonally horizontal direction of the antenna, showing characteristics suitable to be installed in a narrow indoor space like a corridor.

As shown in FIG. 14, the monopole antenna resonates at the frequency of $f_0$, and has an about 2% frequency band where the VSWR is two or below. Thus, the monopole antenna has excellent characteristics at the center frequency in terms of impedance characteristics.

In the monopole antenna, the antenna element height can be 0.0067 wavelength. This corresponds to 1 mm in transmitting or receiving the signal of 2 GHz, and is sufficiently lower in height than the prior art ¼ wavelength monopole antenna element, and further lower than those in the above-mentioned first to third embodiments. This can be done by filling the dielectric member 31 inside the antenna.

When an antenna is installed on a ceiling or wall in a room, if it is not allowed to be embedded there, the antenna capable of reducing its height is preferable because of being inconspicuous and not being an eyesore with its very low-profile projection from the ceiling or wall.

The monopole antenna of the present embodiment, which is symmetric with respect to the Z-Y plane and the Z-X plane, has an effect of making the directivity of the radiation waves from the antenna be symmetric with respect to each plane parallel to the Z-Y plane and each plane parallel to the Z-X plane.

The monopole antenna, which is filled with the dielectric member 31, can be manufactured using a dielectric substrate having a conductive foil such as a copper foil applied on both sides thereof as follows. A dielectric substrate having the thickness of 0.0067 wavelength and applied with a conductive foil such as a copper foil on both surfaces thereof is cut to form the rectangle of 0.76×0.27 wavelength. The rectangle is made the dielectric member 31. Then, one of the surfaces of the conductive foil is removed by etching or a mechanical process so as to form the ceiling conductor 15 and the openings 16' and 17'. The conductive foil on the other surface of the dielectric member 31 not removed becomes the ground conductor 11. An appropriate hole is formed in the fixed position of the ground conductor 11 (for example, a center position in the plane direction along the plane of the ground conductor) so as to form the coaxial power supply part 12. A through hole extending from the coaxial power supply part 12 up to the ceiling plane of the dielectric member 31 is formed by etching or a drill process. The end portion of a conductive wire extending from the internal conductor of the coaxial power supply part 12 is inserted into the through hole to be projected from the ceiling conductor 15 outside the substrate. The conductive wire is used as the antenna element 13, which is electrically connected to the ceiling conductor 15 by soldering or the like. A side of the dielectric member 31 is applied with a copper foil with an adhesive agent so as to form the side conductor 14.

According to the above-mentioned manufacturing method, the high precision process such as the etching process to form the openings 16' and 17' enhances the manufacturing accuracy of an antenna and achieves a cost reduction due to mass production.

In the monopole antennas of the first to third embodiments not provided with the dielectric member 31, the space inside the antenna leads outside through the openings 16 and 17. Depending on the installment environment of the antenna, the openings 16 and 17 may undesirably bring dust or humid air into the antenna, thereby deteriorating its characteristics. In the monopole antenna of the present embodiment; however, the provision of the dielectric member 31 prevents the deterioration of the characteristics of the antenna, thereby maintaining the reliability for the long term.

Hence, the fourth embodiment achieves a compact and excellent monopole antenna having a simple structure and desired directivity.

Figure 15:
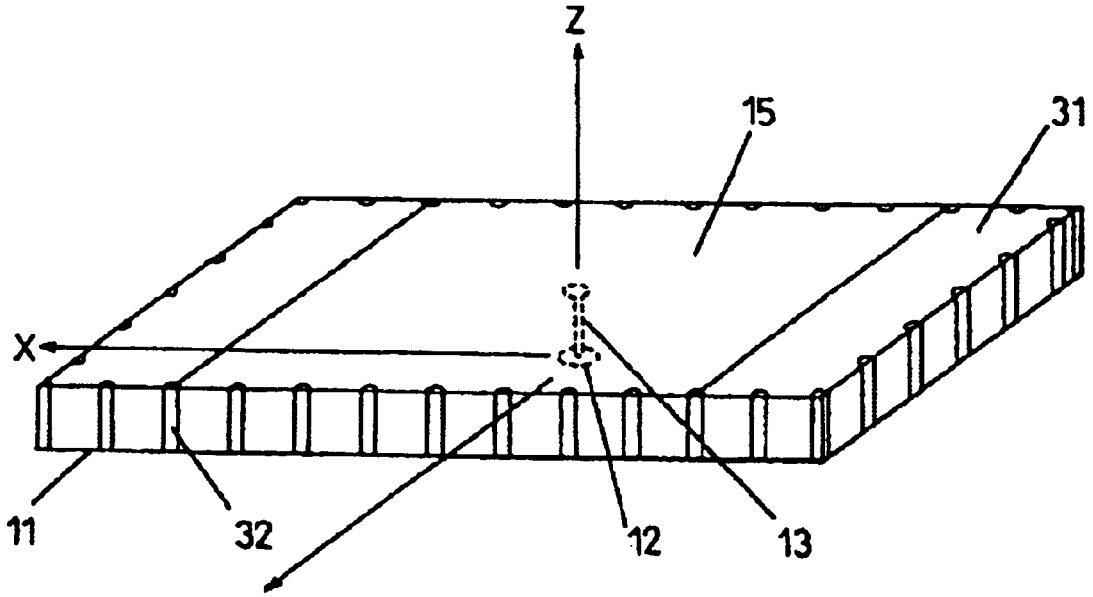
FIG. 15 is a schematic perspective view showing a modified working prototype of the fourth embodiment.

In the fourth embodiment, it would be possible to interrupt inside and outside the antenna electrically by employing plural conductive bars 32 instead of the side conductor 14, as shown in FIG. 15. The conductive bars 32 can be formed as follows. Conductive patterns for the ground conductor 11 and the ceiling conductor 15 are formed on a large dielectric substrate that is to be a mother substrate for the plural dielectric members 31. Plural holes are formed at regular intervals along the dividing lines of the dielectric members 31 in a manner to penetrate the dielectric substrate. The conductive bars 32 are inserted into these holes to connect the ground conductor 11 and the conductive bar 32 to each other, and the ceiling conductor 15 and the conductive bars 32 with each other electrically. After forming the conductive bars 32, the dielectric substrate is divided into the dielectric members 31. The conductive bars 32 can be made of via holes, which can be formed by applying a through hole etching to the holes or filling the holes with a conductive member.

In the structure shown in FIG. 15, the conductive bars 32 exert the same effects as the side conductor 14 when the distance between adjacent conductive bars 32 is sufficiently short compared with the wavelength. A combination of the structure of the conductive bars 32 and the technique to process the ceiling conductor 15 such as the above-mentioned etching process can achieve a monopole antenna with high process precision and capable of being mass produced.

In the fourth embodiment, the entire space inside the monopole antenna surrounded by the conductor is filled with the dielectric member 31. However, the present invention is not restricted to this structure; the dielectric member 31 cane put in apart inside the antenna. For example, monopole antenna can be formed by using a dielectric substrate applied with a conductive foil on its one surface and removing the foil by etching or a mechanical process so as to form and combine the followings:

a dielectric substrate having the ceiling conductor 15 and the openings 16' and 17';

another dielectric substrate having the side conductor 14; and further another dielectric substrate having the ground conductor 11.

In this case, the dielectric member is filled so that only the openings 16' and 17' may be closed. Hence, the space surrounded by the dielectric substrate having the ceiling conductor 15 and opening 16' and 17' the dielectric substrate having the conductor 14, and the dielectric substrate having the ground conductor 11 is hollow. In short, this embodiment is one embodiment of an antenna of the present invention where a part of space surrounded by the ceiling conductor 15 and the side conductor 14 is covered by the ceiling conductor 15, and the other part of space is covered with the dielectric member filled in the opening 16' and 17'. The dielectric substrate having the side conductor 14 can be a single dielectric substrate having the side conductor 14 on the entire side surface thereof. Alternatively, plural dielectric substrates each having the side conductor 14 thereon can be combined to form a frame.

Moreover, the dielectric member may have the structure that only the circumference of the antenna element 13 is filled up and openings 16 and 17 are not filled up with the dielectric member.

(Embodiment 5)

Figure 16A:
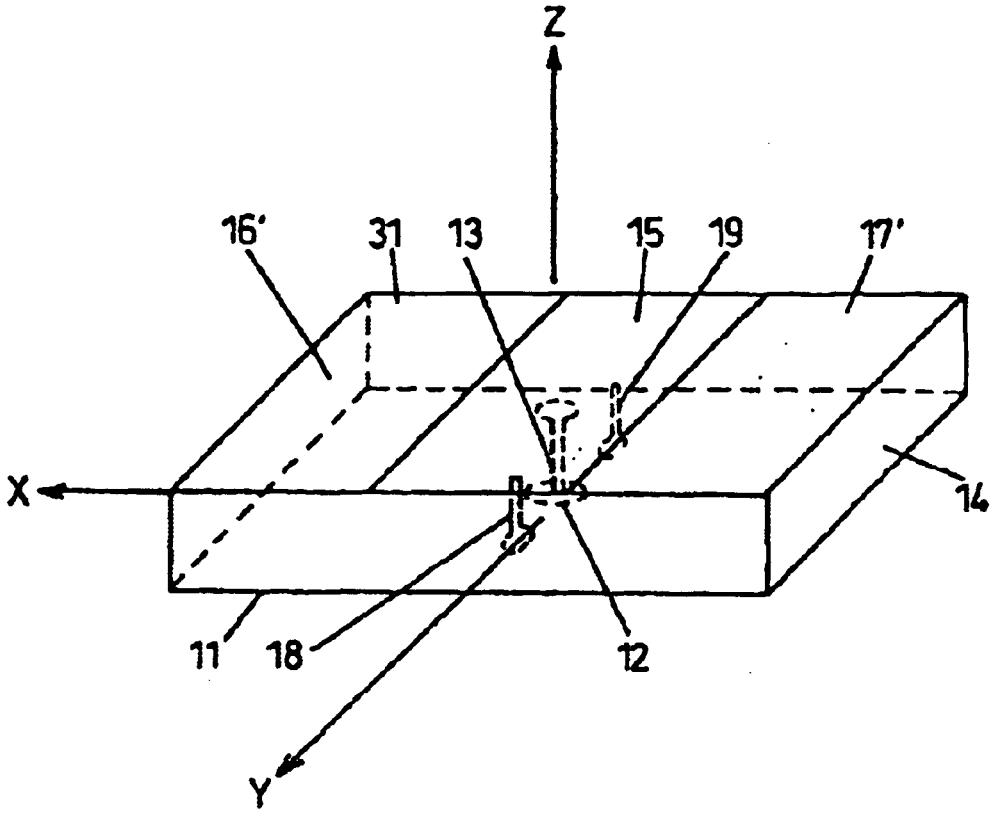
FIG. 16A is a schematic perspective view of a monopole antenna in a fifth embodiment of the present invention.
Figure 16B:
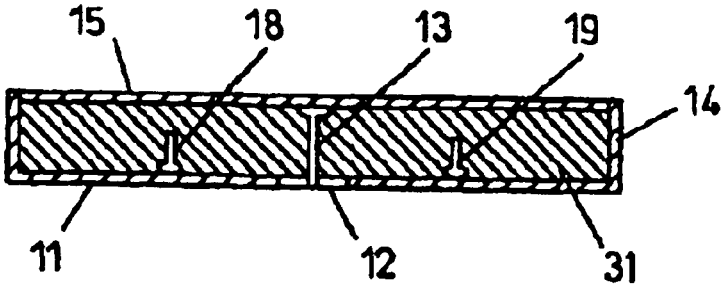
FIG. 16B is a cross section of the monopole antenna in the fifth embodiment of the present invention.

A fifth embodiment of the present invention will be described as follows with reference to FIGS. 16A and 16B. FIG. 16A is a schematic perspective view of the monopole antenna of the fifth embodiment, and FIG. 16B is a sectional view of the antenna taken along the Z-Y plane of FIG. 16A.

The antenna of the present embodiment, which basically has the same structure as that of the fourth embodiment, is characterized by being provided with matching conductors 18 and 19 electrically connected to the ground conductor 11 like in the third embodiment. The matching conductors 18 and 19 are arranged to be symmetric with respect to the antenna element 13 arranged on the +Z-axis on the Z-Y plane. One end of each of the matching conductors 18 and 19 is electrically connected to the ground conductor 11, and the other end is arranged in a space formed by the ground conductor 11, side conductor 14, and ceiling conductor 15.

In the fifth embodiment, the provision of the matching conductors 18 and 19 apart by a predetermined distance from each other close to the antenna element 13 can change the impedance of the antenna, thereby having excellent matching conditions with the coaxial power supply part 12. The excellent matching conditions can improve the characteristics of the antenna.

Similarly to the third embodiment, the matching conditions of the impedance can be improved while hardly changing desired radiation directivity.

As described hereinbefore, the fifth embodiment achieves a compact and excellent monopole antenna having good impedance matching conditions and desired directivity with a simple structure.

(Embodiment 6)

Figure 17A:
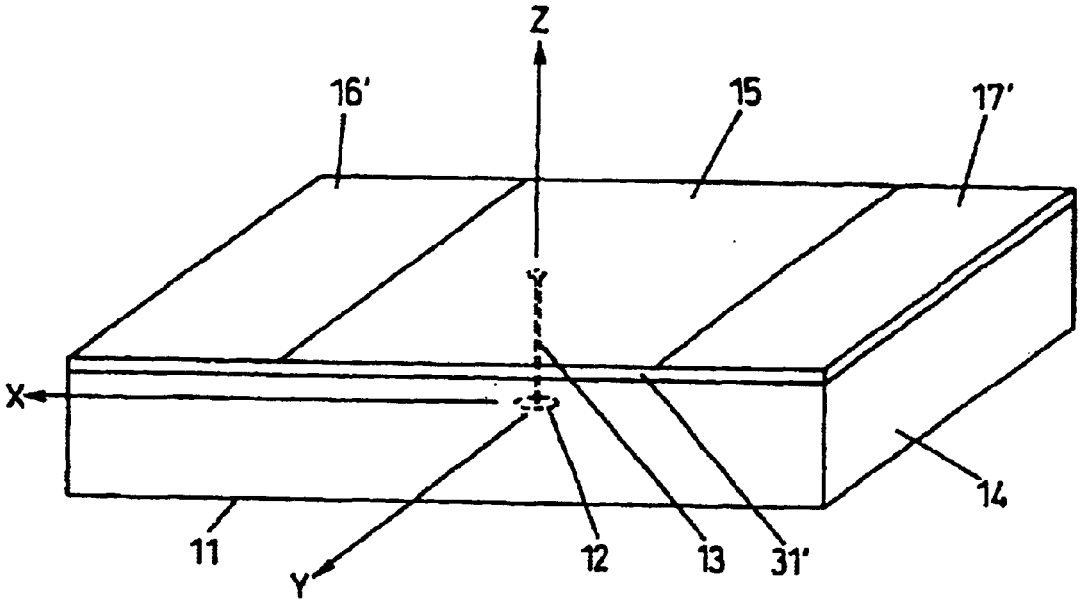
FIG. 17A is a schematic perspective view of a monopole antenna in a sixth embodiment of the present invention.
Figure 17B:
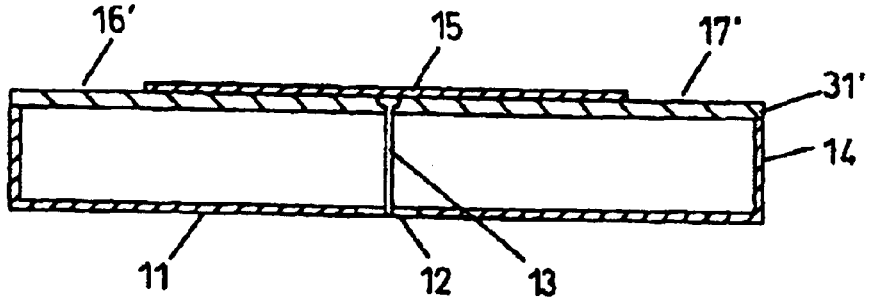
FIG. 17B is a cross section of the monopole antenna in the sixth embodiment of the present invention.

A sixth embodiment of the present invention will be described as follows with reference to FIGS. 17A and 17B. FIG. 17A is a schematic perspective view of the monopole antenna of the sixth embodiment, and FIG. 17B is a sectional view taken along the Z-Y plane of FIG. 17A.

The antenna of the present embodiment, which basically has the same structure as that of the fourth embodiment, is characterized by being provided with a plane-shaped dielectric member 31' filling not the entire space inside the antenna but a part of it. The surface of the dielectric member 31' is provided with the film ceiling conductor 15 made of a conductive film and the openings 16' and 17' formed by removing the conductive film. The dielectric member 31' is arranged at the end of the ceiling-side opening of the internal space surrounded by the side conductor 14. The internal space is sealed by the dielectric member 31' which functions as a lid.

Thus, the effects to block dust and moisture in the fourth embodiment structure can be fully exerted also by sealing the end of the ceiling-side opening of the internal space by means of the dielectric member 31' as shown in the present embodiment. The dielectric member 31', which is arranged at the ceiling side of the antenna in the present embodiment, can be provided at the bottom side. In that case, the ground conductor 11 is formed on the dielectric member 31'.

In addition, this embodiment is one embodiment of the antenna of the present invention that a part of a space surrounded and formed by the ceiling conductor 15 and the side conductor 14 is covered with the ceiling conductor 15, and that the remaining part of the space is covered with the dielectric member with which the opening 16' and 17' was filled. Nevertheless, the present invention is not restricted to this embodiment. It is also possible to obtain the effects to block dust and moisture by such structure that the dielectric member just under the ceiling conductor 15 is replaced with another member such as an insulator, or the ceiling conductor 15 is formed with a metal plate, and the dielectric member covers only the openings 16' and 17'.

(Embodiment 7)

Figure 18A:
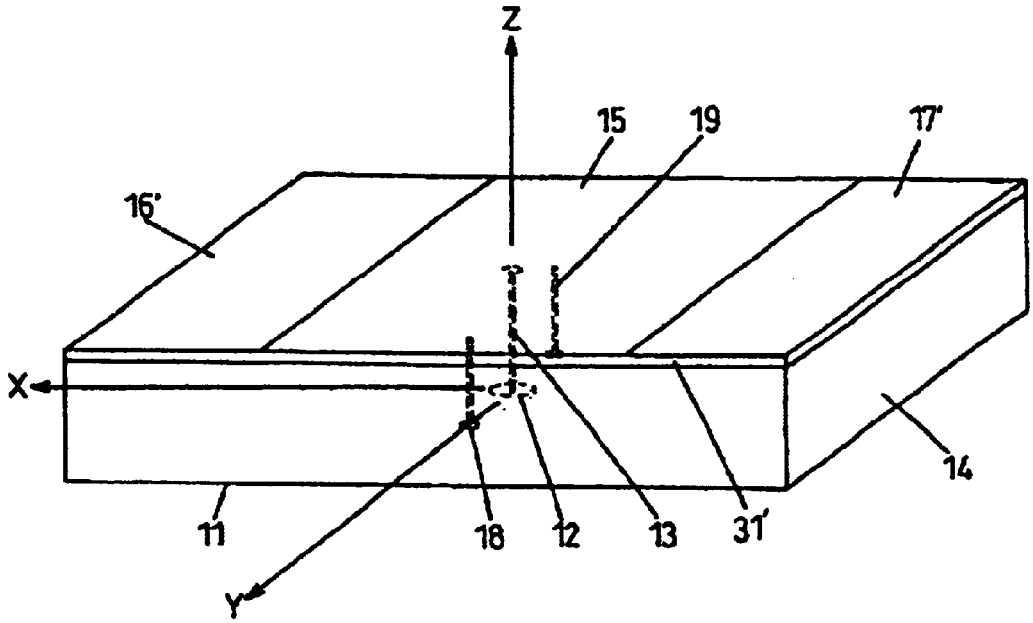
FIG. 18A is a schematic perspective view of a monopole antenna in a seventh embodiment of the present invention.
Figure 18B:
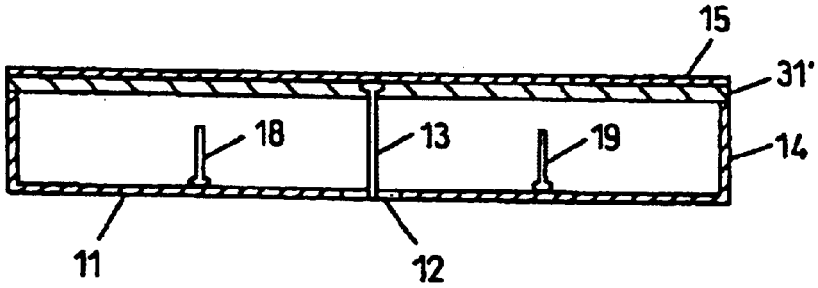
FIG. 18B is a cross section of the monopole antenna in the seventh embodiment of the present invention.

A seventh embodiment of the present invention will be described as follows with reference to FIGS. 18A and 18B. FIG. 18A is a schematic perspective view of the monopole antenna of the seventh embodiment, and FIG. 18B is a sectional view taken along the Z-Y plane of FIG. 18A. The antenna of the present embodiment has the structure of the sixth embodiment and also has the matching conductors 18 and 19 of the fifth embodiment in order to match the impedances in the same manner as in the fifth embodiment.

Figure 19A:
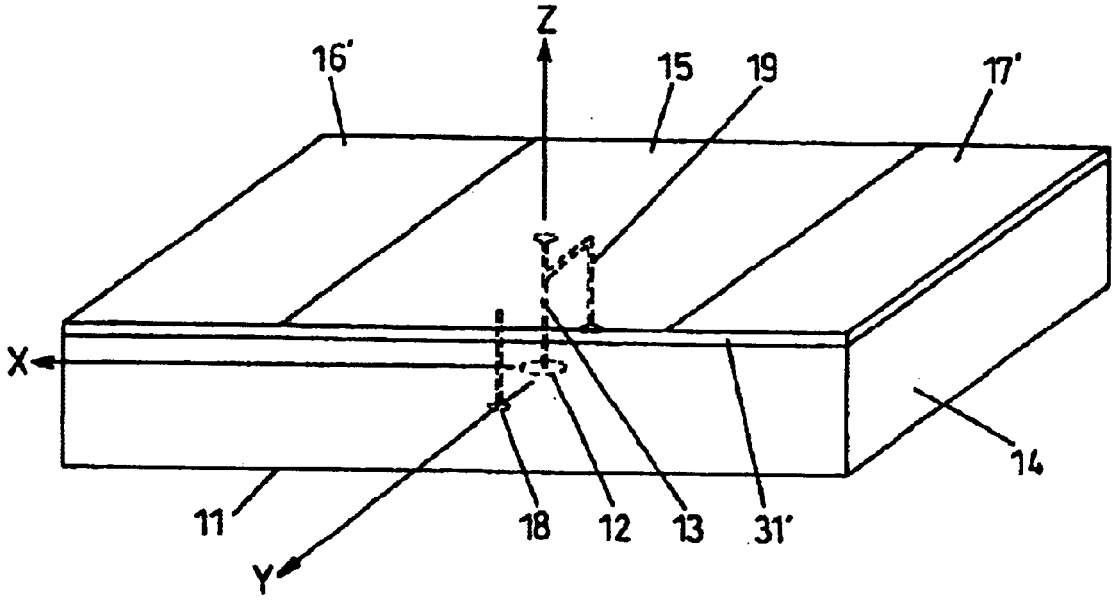
FIG. 19A is a schematic perspective view of a first modified example of the monopole antenna according to the seventh embodiment of the present invention.
Figure 19B:
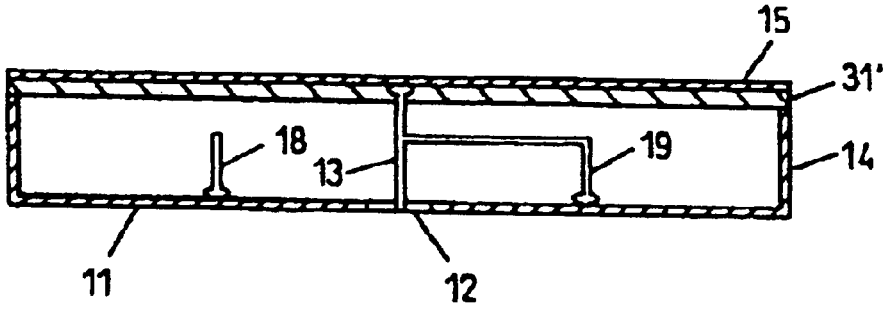
FIG. 19B is a cross section of the first modified example of the monopole antenna according to the seventh embodiment of the present invention.

In the monopole antenna of the present embodiment, the matching conductors 18 and 19 are arranged away by a predetermined distance from the antenna element 13; however, the present invention is not restricted to this structure. For example, it is possible to electrically connect one end of either or both of the matching conductors 18 and 19 to one end or the middle portion of the antenna element 13 as shown in FIGS. 19A and 19B. This structure enhances the impedance of the antenna, making it possible to obtain good matching conditions with the coaxial power supply part 12 particularly when the impedance of the antenna is low.

Figure 20A:
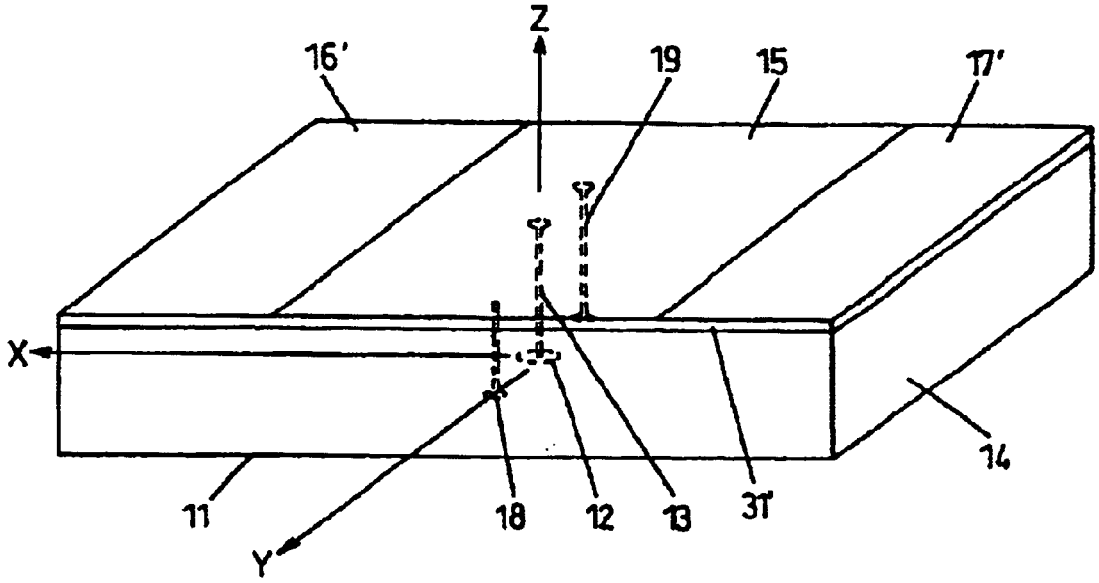
FIG. 20A is a schematic perspective view of a second modified example of the monopole antenna according to the seventh embodiment of the present invention.
Figure 20B:
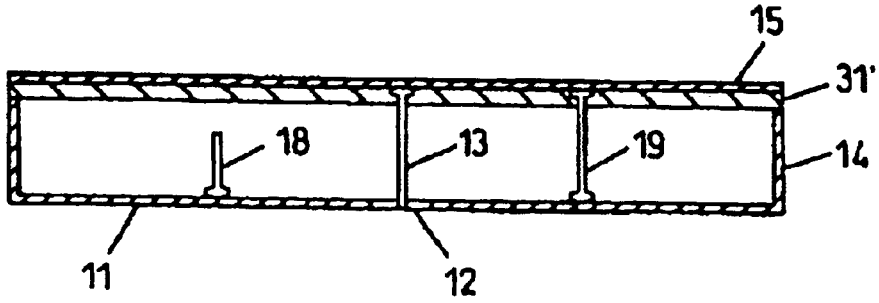
FIG. 20B is a cross section of the second modified example of the monopole antenna according to the seventh embodiment of the present invention.

In the monopole antenna of the present embodiment, the matching conductors 18 and 19 are arranged away by a predetermined distance from the antenna element 13; however, the present invention is not restricted to this structure. For example, it is possible to electrically connect one end of either or both of the matching conductors 18 and 19 to the ceiling conductor 15 as shown in FIGS. 20A and 20B. This structure can change the impedance of the antenna, thereby obtaining good matching conditions with the coaxial power supply part 12.

(Embodiment 8)

An eighth embodiment of the present invention will be described as follows with reference to FIGS. 21 to 26.

Figure 21:
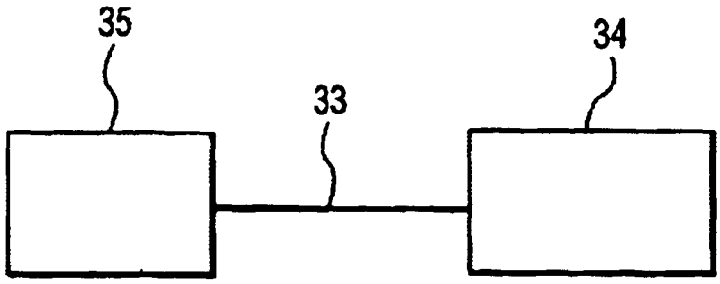
FIG. 21 is a block diagram showing an example of the system structure of a radio equipment described in an eighth embodiment of the present invention.

FIG. 21 shows the system structure of the radio equipment in the eighth embodiment of the present invention. FIG. 21 illustrates a radio equipment 35, a signal transmission cable 33, and a control unit 34. The radio equipment 35 and the control unit 34 exchange signals via the signal transmission cable 33. The control unit 34 performs signal processing, and the radio equipment 35 radiates and receives radio waves. Although the control unit 34 is connected to only one radio equipment 35 in FIG. 21, it is generally connected to plural radio equipments 35.

Figure 22:
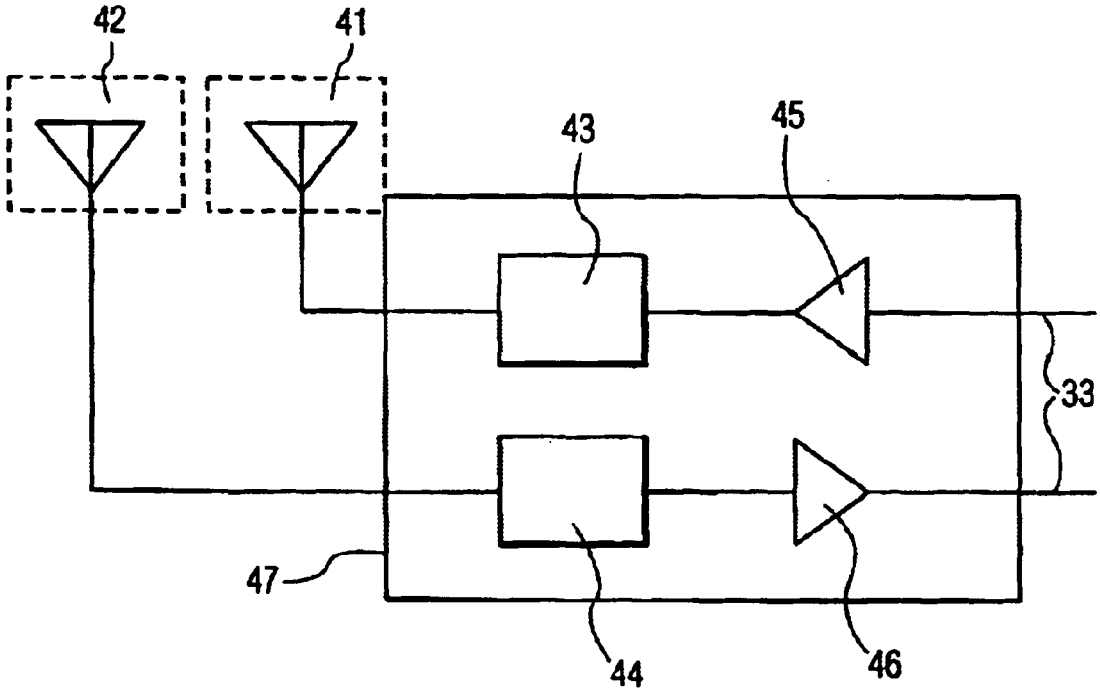
FIG. 22 is a block diagram showing an example of the structure of the radio equipment described in the eighth embodiment of the present invention.
Figure 23:
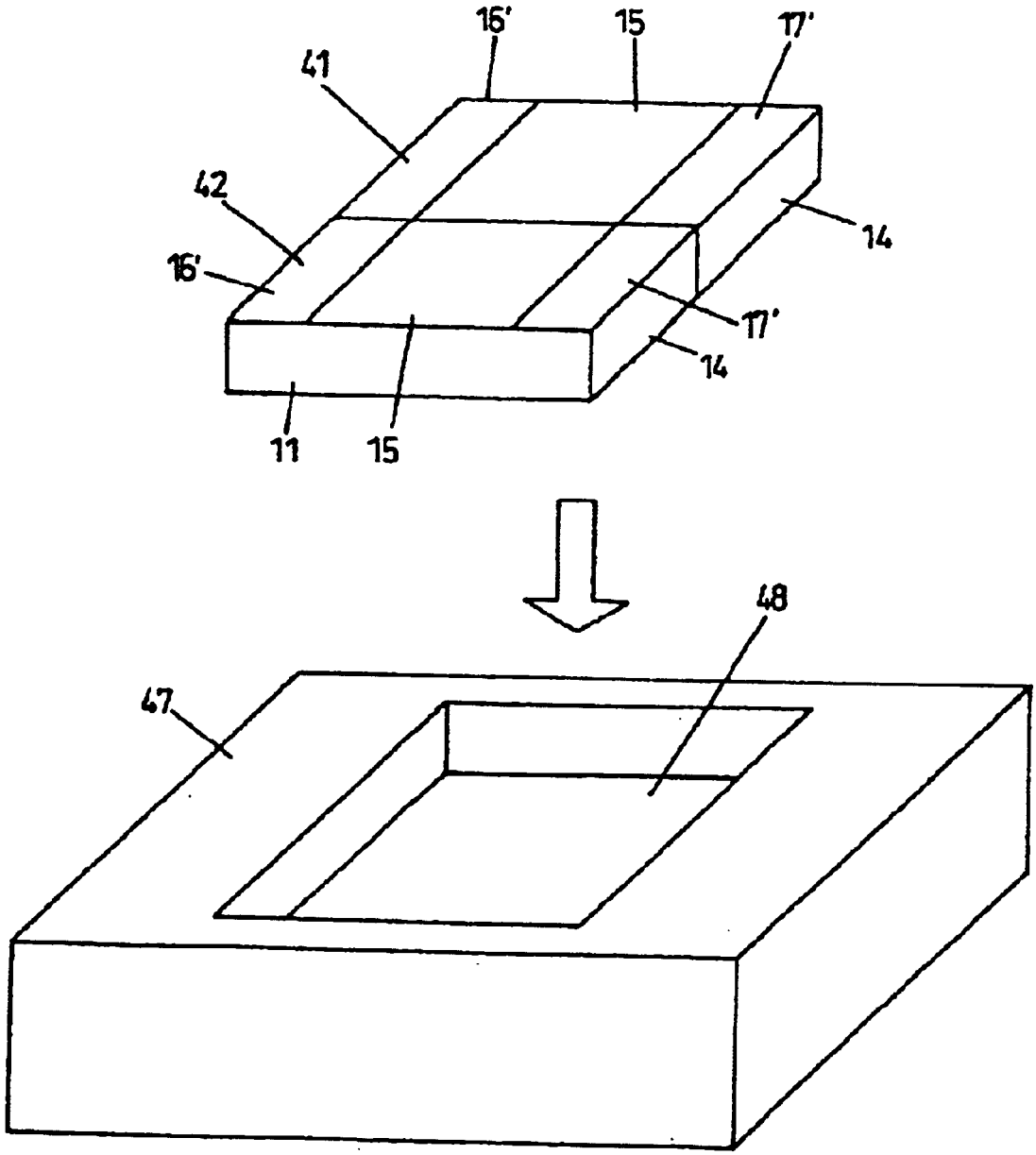
FIG. 23 is an exploded perspective view showing the structure of the radio equipment described in the eighth embodiment of the present invention.

FIGS. 22 and 23 show the structure of the radio equipment in the eighth embodiment. These figures illustrate a signal transmission cable 33, antennas 41 and 42, filters 43 and 44 as an example of frequency selection means, amplification circuits 45 and 46, a cabinet 47, and a concave portion 48. The filters 43 and 44 and the amplification circuits 45 and 46 are arranged inside the cabinet 47. The concave portion 48 is formed on the surface of the cabinet 47, and the antenna 41 and 42 are embedded in the concave portion 48 of the cabinet 47 as shown in FIG. 23. The antennas 41 and 42 are those described in the first to seventh embodiments. The signal transmission cable 33 is made of an electric signal transmission cable such as a coaxial cable.

The behavior of the system will be described as follows. In FIG. 21, a circuit system for supplying signals from the control unit 34 to the radio equipment and transmitting radio waves from the antenna 41 of the radio equipment is referred to as a down system. The circuit system for receiving radio waves from the antenna 42 of the radio equipment and sending signals to the control unit 34 is referred to as an up system. FIG. 22 shows a structural example of the radio equipment in FIG. 21. In the down system, the power supply part of the antenna 41 is connected to the filter 43 that is connected to the amplification circuit 45. In the up system, a power supply part of the antenna 42 is connected to the filter 44, which is connected to the amplification circuit 46.

As for the flow of signals, in the down system, the signals processed in the control unit 34 are sent to the amplification circuit 45 in the radio equipment via the electric signal transmission cable 33 and amplified by the amplification circuit 45. After this, the signals corresponding to the usable frequency band are exclusively sent from the filter 43 to the antenna 41 due to its passage band limitations and radiated out as radio waves from the antenna 41 into space.

In the up system, on the other hand, the signals received from the antenna 42 are sent to the filter 44. The signals corresponding to the usable frequency band are exclusively sent to the amplification circuit 46 due to the passage band limitations of the filter 44, and amplified by the amplification circuit 46. After this, they are sent to the control unit 34 via the electric signal transmission cable 33.

In the monopole antennas described in the first to seventh embodiments, the openings 16 and 17 for radiating waves are arranged on the antenna ceiling portion, and the antenna element 13 as a radiation source is surrounded by the ground conductor 11 and the side conductor 14, so that the radiation waves are not strongly affected by the antenna arrangement environment in the antenna side and bottom directions. That is, when the radio equipment 35 is installed in a room where it is difficult to embed the cabinet 47, the antennas (the monopole antennas of the first to seventh embodiments) are embedded in the concave portion 48. This eliminates the projection from the cabinet 47, making the antenna inconspicuous. As a result, the environmental appearance is less spoiled by the radio equipment.

Figure 24:
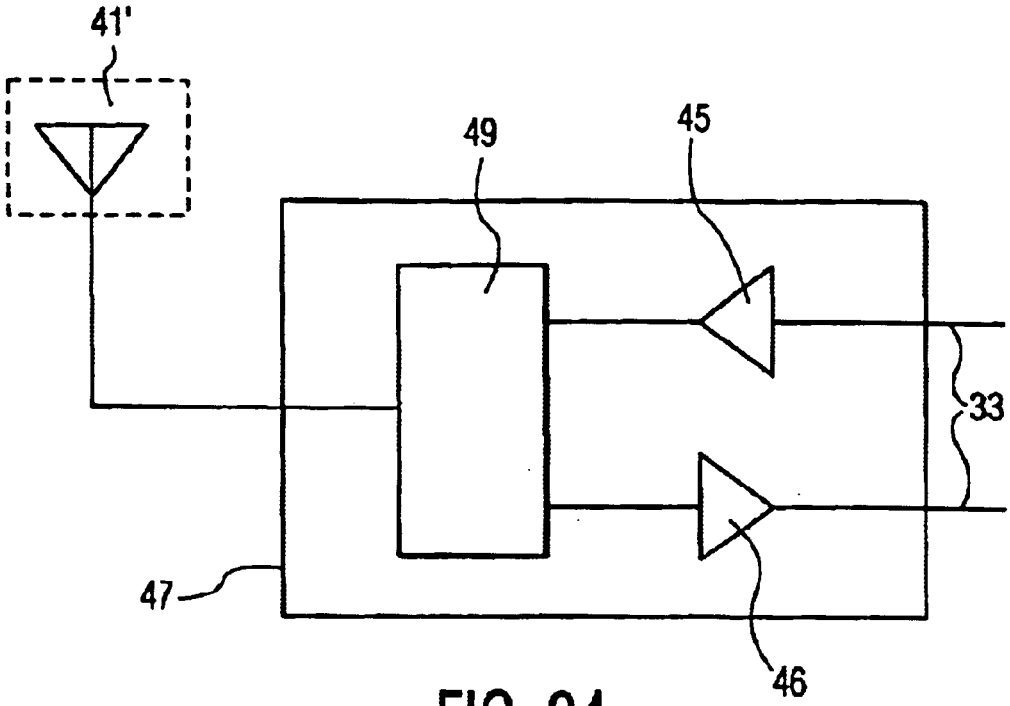
FIG. 24 is a block diagram showing another example of the structure of the radio equipment described in the eighth embodiment of the present invention.

Although the radio equipment of the eighth embodiment comprises the two antennas 41 and 42 of the up and down systems and two filters 43 and 44, the present invention is not restricted to this structure. For example, it is also possible to employ the antenna 41' which operates in both an up system usable frequency band and a down system usable frequency band, and a shared device 49 as shown in FIG. 24.

The use of one antenna 41' and one filter (shared device 49) reduces the radio equipment in size.

Figure 25:
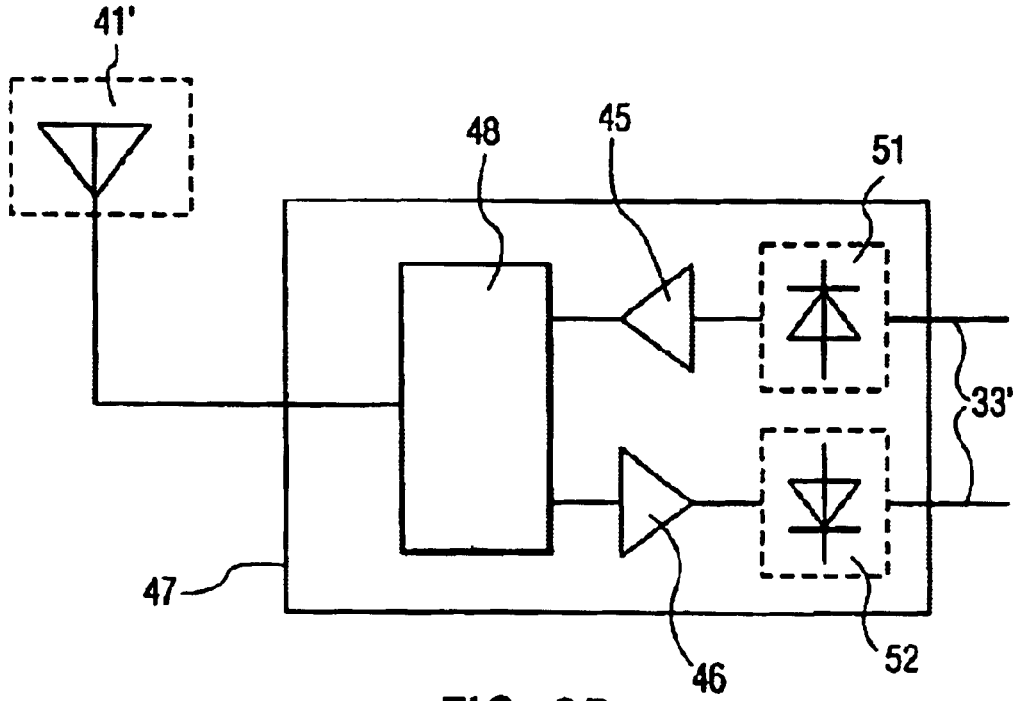
FIG. 25 is a block diagram showing another example of the structure of the radio equipment described in the eighth embodiment of the present invention.

The eighth embodiment employs an electric signal transmission cable as the signal transmission cable 33; however, the present invention is not restricted to this structure. For example, FIG. 25 shows the signal transmission cable made of an optical signal transmission cable 33' such as an optical fiber. Besides the shared device 48 used in FIG. 25, a pair of filters 43 and 44 shown in FIG. 22 can be used, which requires to convert electric signals into optical signals for transmission. Consequently, as shown in FIG. 25 it is required to provide a photo diode 51 for converting optical signals into electric signals between the optical signal transmission cable 33' and the amplification circuit 45 in the down system, and a laser 52 for converting electric signals into optical signals between the amplification circuit 47 and the optical signal transmission cable 33' in the up system. In the control unit 34, a photo diode (not shown) is required for the connection with the optical signal transmission cable 33' in the up system and a laser (not shown) is required for the connection with the optical signal transmission cable 33' in the down system. Such a structure reduces the cost to install the optical signal transmission cable 33' or attenuation of signals due to the transmission length of the cable 3', thereby realizing a long distance signal transmission. Furthermore, the use of optical signals having different wavelengths for the up and down systems to perform wavelength multiplexing makes it possible to compose the optical signal transmission cable 50 with a single optical fiber. This structure requires to provide an optical coupler 60 between the optical signal transmission cable 33' and the laser 52 and between the cable 33' and the photo diode 51.

Figure 26:
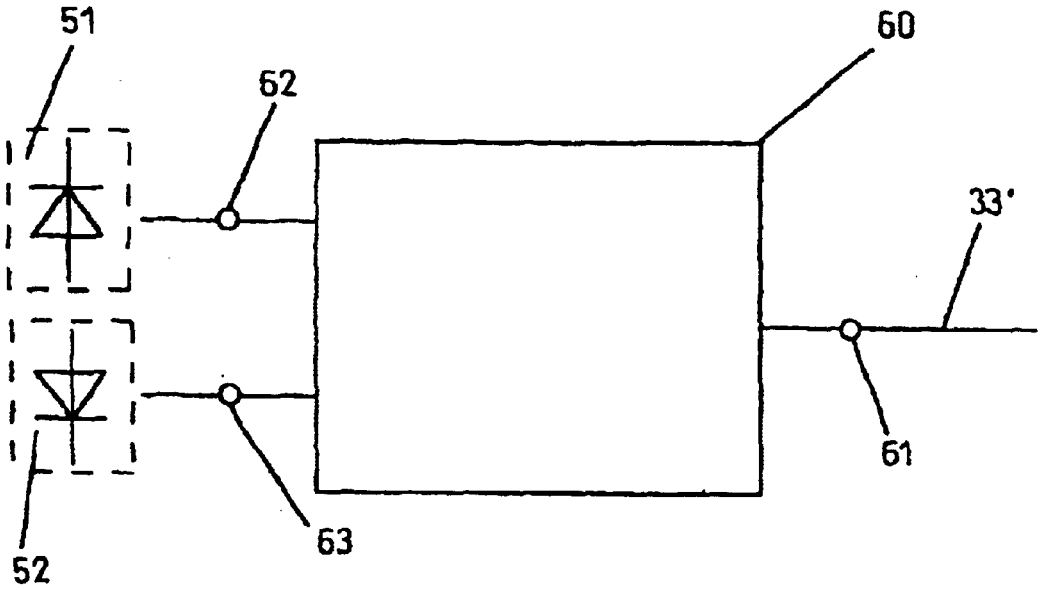
FIG. 26 is a block diagram showing an example of the structure of an optical coupler embedded in the radio equipment according to the eighth embodiment of the present invention.

As shown in FIG. 26 the optical coupler 60 comprises three terminals 61, 62, and 63, which are connected to the optical signal transmission cable 33', the photo diode 51, and the laser 52, respectively. The provision of the optical coupler 60 makes optical signals of the up and down systems transmitted as follows: Down system transmission signals received by the antennas 41 and 41' are converted into optical signals by the laser 52, and sent to the optical signal transmission cable 33' via the optical coupler 60. Up system transmission signals, on the other hand, are sent via the optical coupler 60 from the cable 33' to the photo diode 51 where they are converted into electric signals so as to be sent to the antennas 42 and 41'. This structure requires only one optical signal transmission cable, thereby reducing the cost of the cable itself required for transmission and also the cost to install it.

In addition, in each of above-described embodiments, the ground conductor 11 is an example of the bottom member of the present invention; the coaxial power supply part 12 is an example of the feeding point of the present invention; an antenna element 12 is an example of the conductive member of the present invention; the side conductor 14 is an example of the side member of the present invention; and the ceiling conductors 15, 15A, and 15B are examples of the ceiling member of the present invention. Moreover, the openings 16, 17, 16', and 17' are examples of the remainder of the space according to the present invention which are not covered with the ceiling portion of the present invention.

In addition, the present invention is not restricted to each of the above-described embodiments; each of the above-mentioned embodiments can be modified variously as follows.

(1) Although the monopole antennas of the first to seventh embodiments are symmetric with respect to the Z-Y plane and the Z-X plane, the present invention is not restricted to this structure. In order to achieve desired radiation directivity or input impedance characteristics, an antenna of the present invention can also be designed to be symmetric with respect to the Z-Y plane only, or to be asymmetric with respect to the Z-Y plane and Z-X plane. In addition, only the openings 16 and 17 can be symmetric with respect to the Z-Y plane or to both the Z-Y and Z-X planes. Only the ground conductor 11 can be symmetric with respect to the Z-Y plane or to both the Z-Y and Z-X planes. Only the ceiling conductor 15 can be symmetric with respect to the Z-Y plane or to both the Z-Y and Z-X planes. Only the side conductor 14 can be symmetric with respect to the Z-Y plane or to both the Z-Y and Z-X planes. Alternatively, combinations of these are possible to achieve an antenna having radiation directivity optimal for the radiation target space. In short, the antenna of the present invention should just have the structure of having a space surrounded by a bottom member and a side member.

(2) In the monopole antennas of the first to seventh embodiments, the ground conductor 11, the side conductor 14, and the ceiling conductor 15 are electrically connected to each other; however the present invention is not restricted to this structure. For example, in order to achieve desired radiation directivity or input impedance characteristics, the ceiling conductor 15 and the side conductor 14 can be electrically separated; the ground conductor 11 and the side conductor 14 can be electrically separated; or all of these conductors 11, 14, and 15 can be electrically separated.

(3) Although the monopole antennas of the first to seventh embodiments have two openings 16 and 17, the present invention is not restricted to this structure. For example, in order to achieve desired radiation directivity or input impedance characteristics, one or more than two openings 16 and 17 can be provided.

(4) In the monopole antennas of the first to seventh embodiments, the openings 16 and 17 are rectangles; however, the present invention is not restricted to this structure. For example, in order to achieve desired radiation directivity or input impedance characteristics, the openings 16 and 17 can be circles, squares, polygons, and semicircles, combinations of these shapes, rings, or other shapes. When the openings 16 and 17 are circular, oval, or any curved shapes, the corner formed in the conductive position constituting the antenna becomes round in the radiation directivity. As a result, the corner has less diffraction effects, which desirably reduces the cross-polarized conversion loss of the radiation waves.

(5) In the monopole antennas of the first to seventh embodiments, two openings 16 and 17 are arranged on the antenna ceiling portion; however, the present invention is not restricted to this structure. For example, in order to achieve desired radiation directivity or input impedance characteristics, the openings 16 and 17 can be arranged on the side conductor 14 or on the ground conductor 11, or these structures can be combined. Moreover, each opening may be constituted as a mesh of a net, and for example, the ceiling conductor 15 having a meshed structure can be provided so as to cover the entire periphery of the side conductor 14. And the size of a mesh is preferable to be larger than a half of wavelength of the radio wave radiated from the antenna element 12.

(6) In the monopole antennas of the first to seventh embodiments, the ground conductor 11 is a rectangle; however, the present invention is not restricted to this structure. For example, in order to achieve desired radiation directivity or input impedance characteristics, the ground conductor 11 can be any other polygon, a semicircle, or a combination thereof, or other shapes. The ground conductor 11 can be circular, oval, or any curved shapes, or any curved surfaces. In these cases, the corner of the conductive portion constituting the antenna becomes round in the radiation directivity, and as a result, the corner has less diffraction effects, which desirably reduces the cross-polarized conversion loss of the radiation waves.

(7) In the monopole antennas of the first to seventh embodiments, the ceiling conductor 15 is a rectagle; however, the present invention is not restricted to this structure.

For example, in order to achieve desired radiation directivity or input impedance characteristics, the ceiling conductor 15 can be any other polygon, a semicircle, or a combination thereof, or other shapes, further can be circular, oval, or any curved shapes, or any curved surfaces. In these cases, the corner of the conductive portion constituting the antenna becomes round in the radiation directivity, and as a result, the corner has less diffraction effects, which desirably reduces the cross-polarized conversion loss of the radiation waves. Furthermore, when the entire structure of the monopole antenna is shaped like a disk, the following advantage can be obtained. Since the installment environment of the monopole antenna varies widely, there are cases that the designed radiation directivity cannot be actually exerted. In that case, the direction to install the antenna is adjusted in the horizontal direction. In contrast, desired radiation directivity is generally so designed as to be exerted under the conditions that the four sides of the monopole antenna are equal to the fundamental direction (the plane direction of a side wall in a room) regulated in the installment environment. For this reason, a minor adjustment of the installment direction may put the four side directions of the antenna out of the fundamental direction, causing the antenna to be installed in an undesired manner from the viewpoint of appearance. On the other hand, when the monopole antenna is designed to be circular, there is no fixed direction in the side of the monopole antenna, so that the side direction of the antenna never becomes out of the fundamental direction by a minor adjustment of the installment direction.

(8) In the monopole antennas of the first to seventh embodiments, the side conductor 14 is perpendicular to the ground conductor 11; however, the present invention is not restricted to this structure. For example, in order to achieve desired radiation directivity or input impedance characteristics, the side conductor 14 can be diagonal to the ground conductor 11.

(9) In the monopole antennas of the first to seventh embodiments, the side conductor 14 is provided on the frame formed along the outline of the ground conductor 11; in other words, the frame formed by the side conductor 14 is approximately equal to the ground conductor 11 in size. However, the present invention is not restricted to this structure. For example, in order to achieve desired radiation directivity or input impedance characteristics, the frame formed by the side conductor 14 can be larger or smaller than the ground conductor 11, or the frame can be larger or smaller than the ceiling conductor 15.

Moreover, the side conductor 14 does not need to be formed so that the side conductor 14 may cover the entire profile of a ground conductor 11. For example, in each of the above-described embodiments, although four side conductors 14 are provided, the number of the side conductors 14 can be three or two. In this case, so long as a space surrounded by the three side conductors 14 and ground conductor 11 that face each other or a space surrounded by the two side conductors 14 and the ground conductor 11 that adjoin or face each other is formed, an antenna of the present invention can be obtained by arranging the antenna element 12 (conductive member of the present invention) as a space of the present invention. Furthermore, when a side conductor has a curved surface, the number of the side conductors can be one, and the space surrounded by the curved surface and ground conductor should just be formed.

Figure 27:
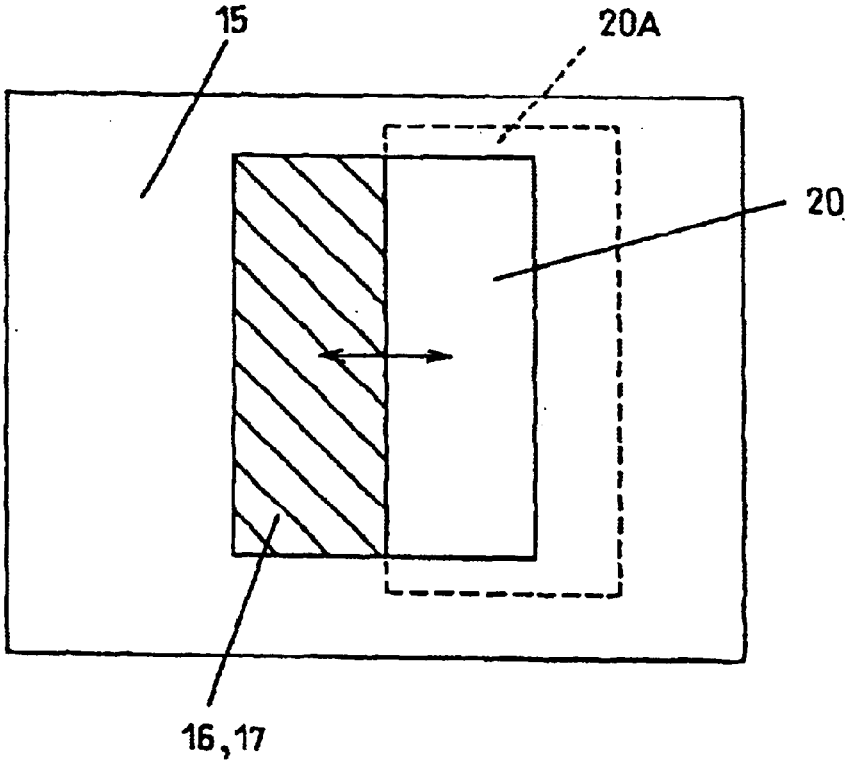
FIG. 27 is a schematic diagram showing an example of the structure of an opening control device embedded in the monopole antenna of each embodiment of the present invention.

(10) In the monopole antennas of the first to seventh embodiments, the openings 16 and 17 have a fixed size; however, the present invention is not restricted to this structure. For example, as shown in FIG. 27, the openings 16 and 17 can be provided with an opening adjustment device 20 that can vary the size of the openings 16 and 17. The opening adjustment device 20 can be achieved by providing a sliding conductive plate 20*a* for changing the size of the openings 16 and 17 along them. Varying the size of the openings 16 and 17 as desired by means of the opening adjustment device 20 makes it possible to obtain desired radiation directivity. Moreover, even when an opening is provided in a side conductor or a ground conductor, the size of the opening can also be adjusted.

(11) In the monopole antennas of the first to seventh embodiments, the antenna element 13 is made of a linear conductor; however, it can be a different antenna element. For example, it can be a helical type monopole antenna element made of a coiled conductive wire, or a reverse L type or a reverse F type monopole antenna by folding the conductive wire in the form of letter L or F. It also can be a top loading type monopole antenna element having a capacitive load such as a conductive plate at the end portion of a conductive wire. Alternatively, these can be combined to form a different antenna element. Furthermore, the antenna element is not limited to the monopole antenna, and other antenna elements such as Planner Inversal F Antenna may be used. These structures make the antenna element small and low-profile, and the antenna as a whole becomes small and low-profile.

(12) The monopole antennas of the first to seventh embodiments each comprise the ground conductor 11, the ceiling conductor 15, the side conductor 14, the antenna element 13, the coaxial power supply part 12, and the openings 16 and 17; however, the present invention is not restricted to this structure. For example, in order to achieve desired radiation directivity or input impedance characteristics, the antenna ceiling portion can be entirely open without the ceiling conductor 15. According to this structure, when the antenna is symmetric with respect to the Z-Y plane and the Z-X plane, the directivity on the vertical plane can be changed to obtain approximately non-directional characteristics on the horizontal plane of the antenna. Alternatively, it is possible to provide the openings 16 and 17 on the ground conductor 11 and the side conductor 14. In this case, in order to achieve desired radiation directivity or input impedance characteristics, the antenna can be symmetric with respect to the Z-Y plane and the Z-X plane, only to the Z-Y plane, or asymmetric with respect to Z-V plane and Z-X plane. Only the openings 16 and 17 can be symmetric with respect to the Z-Y plane or to both the Z-Y and Z-X planes. Only the ground conductor 11 can be symmetric with respect to the Z-Y plane or to both the Z-Y plane and Z-X planes. Only the side conductor 14 can be symmetric with respect to the Z-Y plane or to both the Z-Y and Z-X planes. Also a combination of these features can be possible. All these structures can achieve an antenna having radiation directivity optimal for a radiation target space.

(13) The monopole antennas of the first to seventh embodiments can be arranged in an array so as to constitute a phased array antenna and an adaptive antenna array. Consequently, the control of the directivity of radiation waves is facilitated.

Figure 28A:
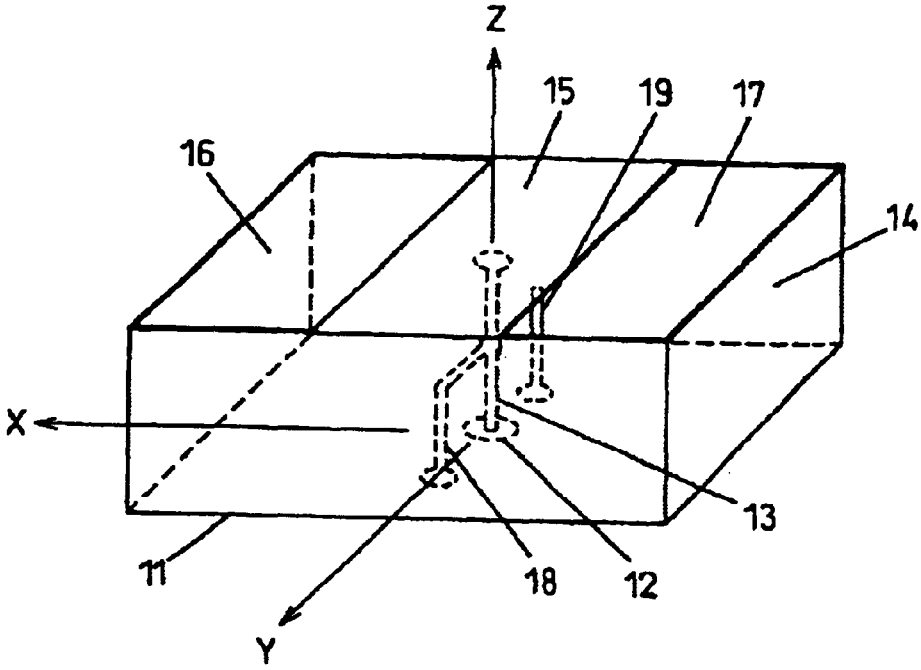
FIG. 28A is a schematic perspective view showing a modified example of the present invention.
Figure 28B:
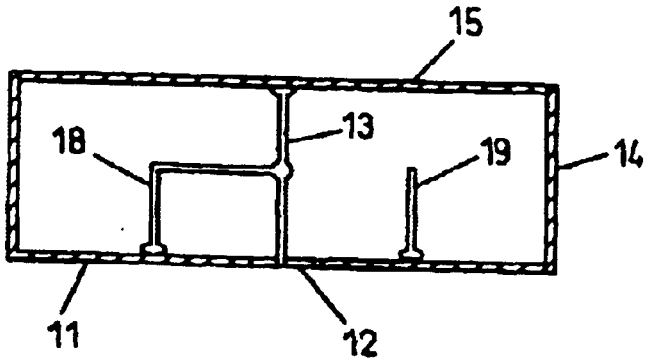
FIG. 28B is a cross section of the modified example of the present invention.

(14) The third embodiment shows the structure where the antenna element 13 is electrically separated from the ceiling conductor 15; however, the present invention shown in the third embodiment is not restricted to this structure. For example, as shown in FIGS. 28A and 28B, one end of the antenna element 13 can be electrically connected to the ceiling conductor 15. In this case, the antenna element 13 is not necessarily a linear conductor but can be a helical type monopole antenna element made of a coiled conductive wire or the like. This makes the antenna element 13 small and low-profile, thereby making the antenna as a whole small and low-profile.

(15) The monopole antenna in the third embodiment has two matching conductors 18 and 19; however, the present invention is not restricted to this structure. For example, one or more than two openings can be provided. This structure increases the flexibility of the antenna structure, thereby further enhancing the matching conditions with the coaxial power supply part 12.

(16) The monopole antenna in the third embodiment has two matching conductors 18 and 19 arranged away by a predetermined distance from the antenna element 13 in the Z-Y plane; however, the present invention is not restricted to this structure. For example, the matching conductors 18 and 19 can be arranged at any position parallel to the Z-axis. This structure increases the flexibility of the antenna structure, thereby further enhancing the matching conditions with the coaxial power supply part 12.

(17) The monopole antenna in the third embodiment has the matching conductors 18 and 19 made of a linear conductor; however, they can be made of a conductor having other shapes. For example, they can be helical type matching conductors made of a coiled conductive wire, or can be made of a conductive wire folded in the form of letter L. This makes the matching conductors small and low-profile, thereby making the antenna as a whole small and low-profile.

Figure 29A:
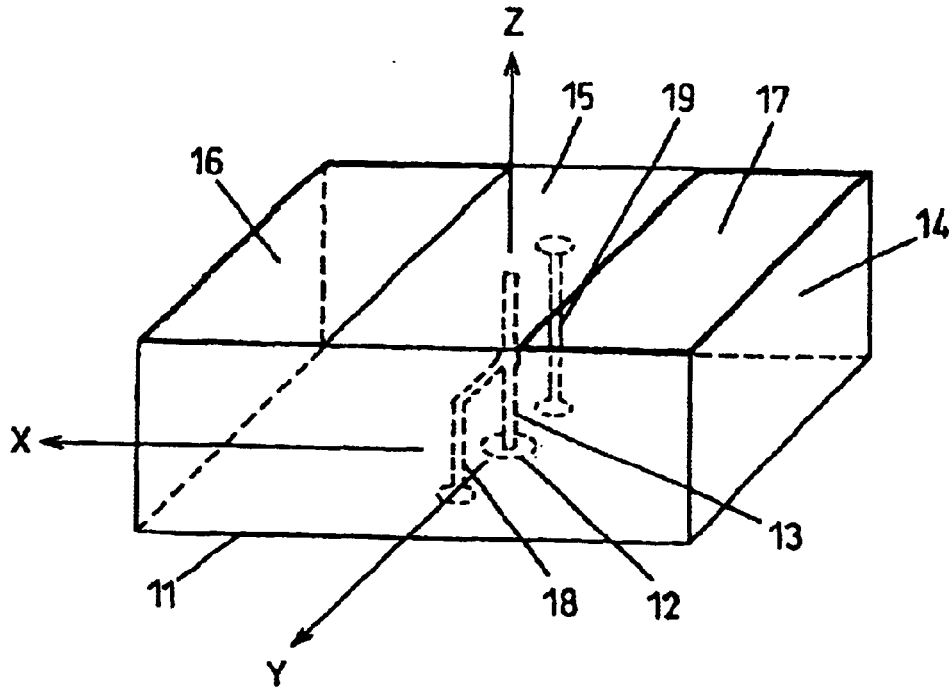
FIG. 29A is a schematic perspective view of another modified example of the present invention.
Figure 29B:
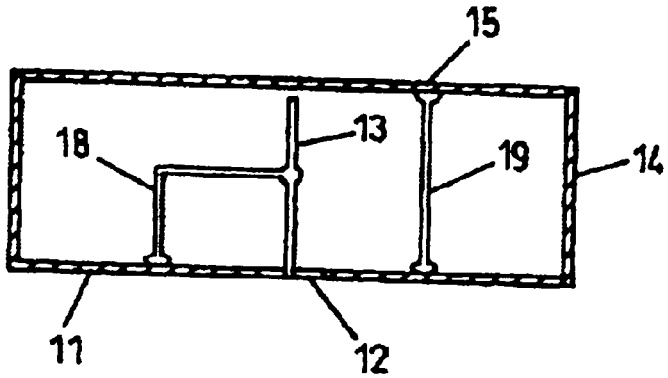
FIG. 29B is a cross section of the other modified example of the present invention.

(18) The monopole antenna in the third embodiment has the matching conductors 18 and 19 arranged away from the antenna element 13; however, the present invention is not restricted to this structure. For example, as shown in FIGS. 29A and 29B, one end of either or both of the matching conductors 18 and 19 can be electrically connected to one end or in the middle of the antenna element 13. This structure enhances the impedance of the monopole antenna, thereby improving the matching conditions between the monopole antenna and the coaxial power supply part 12 particularly when the impedance is low.

(19) The monopole antenna in the third embodiment has the matching conductors 18 and 19 arranged away by a predetermined distance from the ceiling conductor 15; however, the present invention is not restricted to this structure. For example, as shown in FIGS. 29A and 29B, one end of either or both of the matching conductors 18 and 19 can be electrically connected to the ceiling conductor 15. This structure can change the impedance of the monopole antenna, thereby improving the matching conditions between the monopole antenna and the coaxial power supply part 12.

Figure 30:
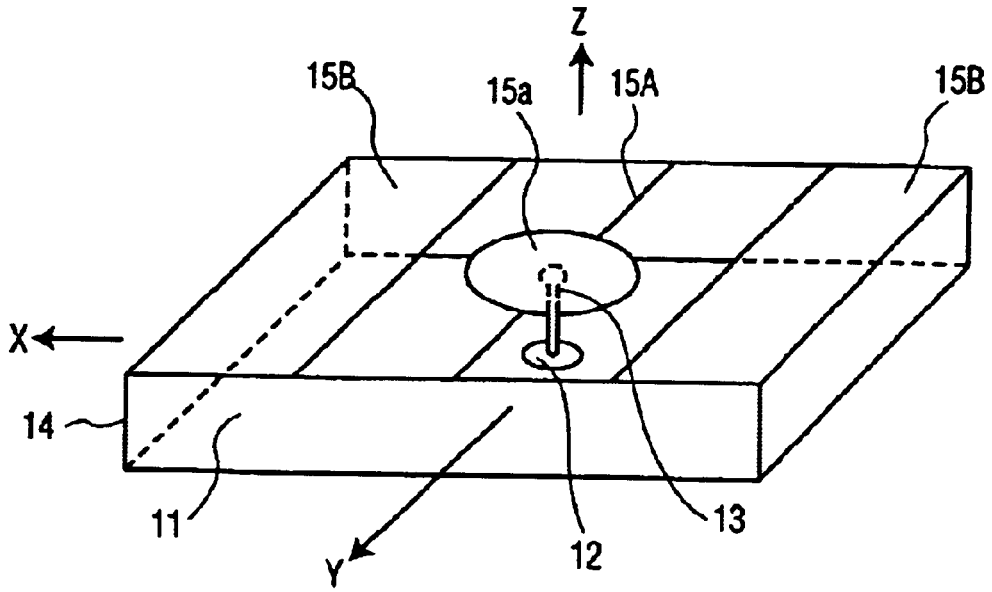
FIG. 30 is a schematic perspective view showing further another modified example of the present invention.
Figure 31:
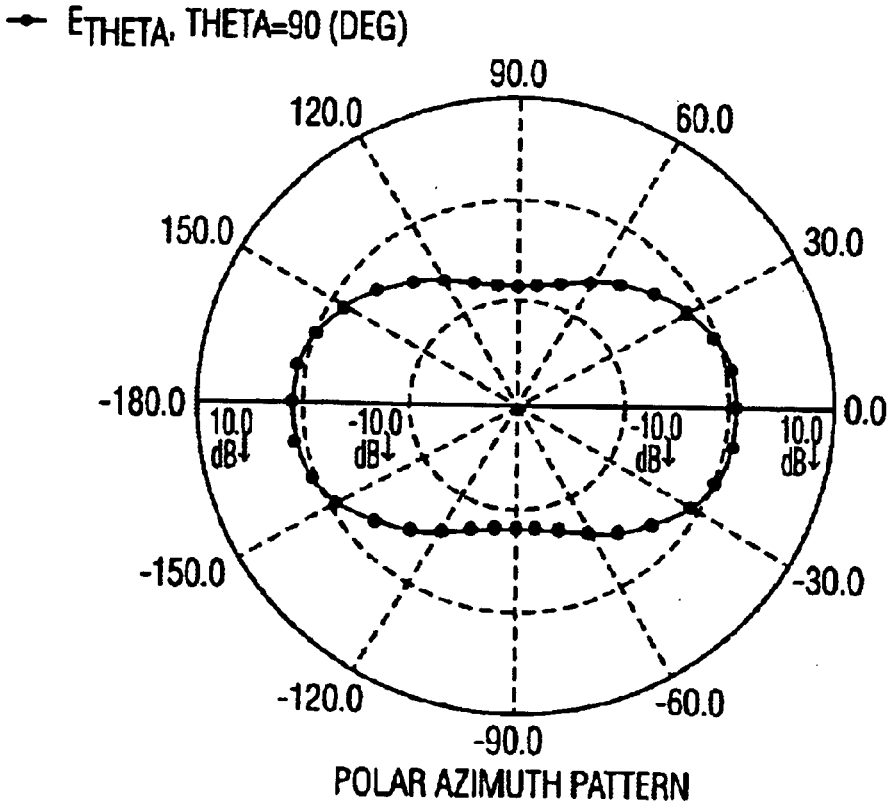
FIG. 31 is a diagram showing the radiation directivity of the modified example shown in FIG. 30.

(20) In the first to seventh embodiments, both ends of the ceiling conductor 15 are electrically connected to the side conductor 14, which undesirably produces a minimum point in the radiation directivity of the horizontal plane along the line extending between both ends of the ceiling conductor 15. This results from the fact that the current leakage caused from the connection point of the ceiling conductor 15 and the side conductor 14 makes it almost impossible to transmit and receive radio waves in that direction. When such a minimum point needs to be eliminated, the antenna should be designed to have a circular portion 15*a* on the ceiling conductor 15 as shown in FIG. 30. The circular portion 15*a* is provided in the center of the line extending between both ends of the ceiling conductor 15. Since the circular portion 15*a* radiates radio waves from the entire periphery, it can radiate waves under almost non-directional conditions along the horizontal plane. Therefore, the ceiling conductor 15 as a whole radiates a mixture of radio waves having the minimum point and radio waves non-directional along the horizontal plane. This allows radio waves to be radiated on the minimum point, thereby forming oval radiation directivity along the horizontal plane, as shown in FIG. 31. The amount of wave radiation at the minimum point can be adjusted by changing the size of the circular portion 15*a*.

Moreover, it is not necessary to limit the shape of the ceiling conductor 15 to a complete circular shape since the wave radiation should just be non-directional on a horizontal plane. Hence the shape can be oval or the edge of the ceiling conductor 15 can be wavy. In short, as for a ceiling member of the present invention, the periphery should just be at least curvilinear.

Figure 32:
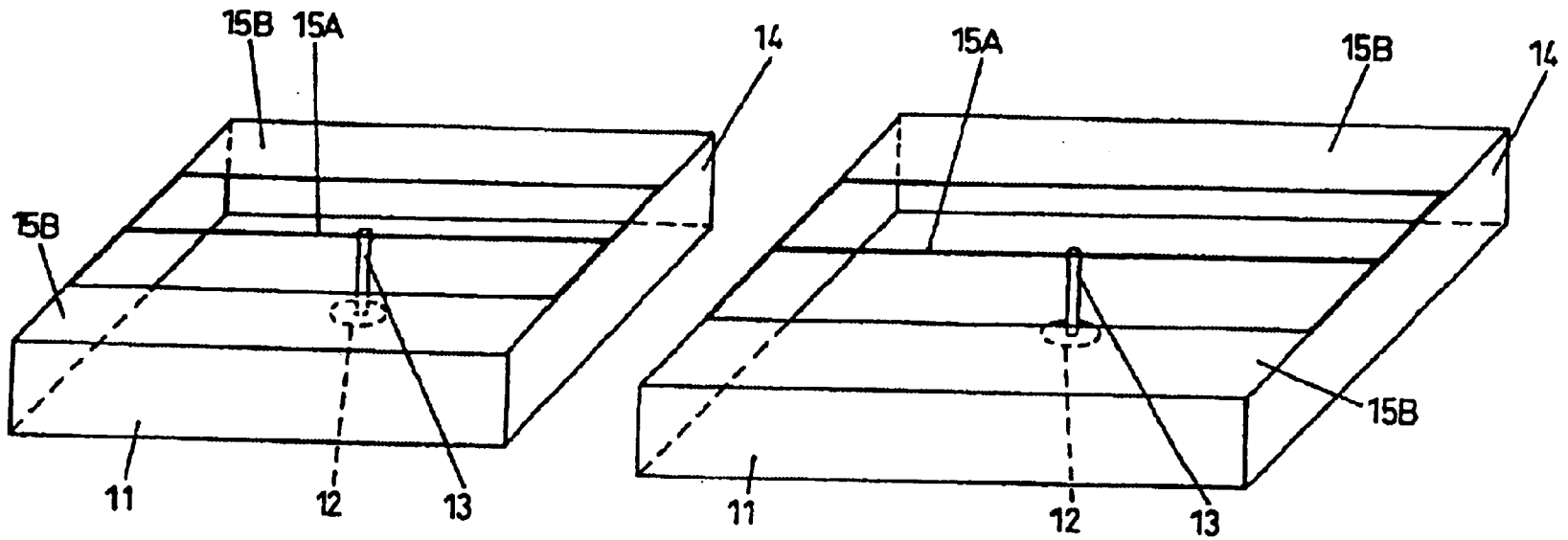
FIG. 32 is perspective views showing an arrangement example of a monopole antenna of the present invention.

(21) When the monopole antennas of the first to seventh embodiments perform radio wave transmission and reception, plural (for example, two) monopole antennas are arranged in parallel. In this case, the isolation between adjacent antennas must be secured. It is usually done by providing isolation elements such as filters, but can be facilitated as follows. In the monopole antennas, in those of the present invention in particular, the directivity on the horizontal plane has a minimum point, which is formed in the direction along the connection point of the ceiling conductor 15 and the side conductor 14. Adjacent monopole antennas are aligned so as to make the direction to form the minimum points of radio waves on the same line. This arrangement minimizes the influences of the radio waves transmitted/received between the monopole antennas, thereby facilitating the security of isolation. For example, in the monopole antenna shown in FIG. 7, both ends of the ceiling conductor 15 in the longitudinal direction are electrically connected to the side conductor 14, so that the longitudinal direction of the ceiling conductor 15 becomes the direction to form the minimum point of radio waves. As shown in FIG. 32, adjacent monopole antennas are arranged so as to make the longitudinal direction of each of the ceiling conductors 15 on the same line. This arrangement minimizes the influences of the radio waves transmitted/received between the monopole antennas, thereby facilitating the security of isolation.

Figure 33:
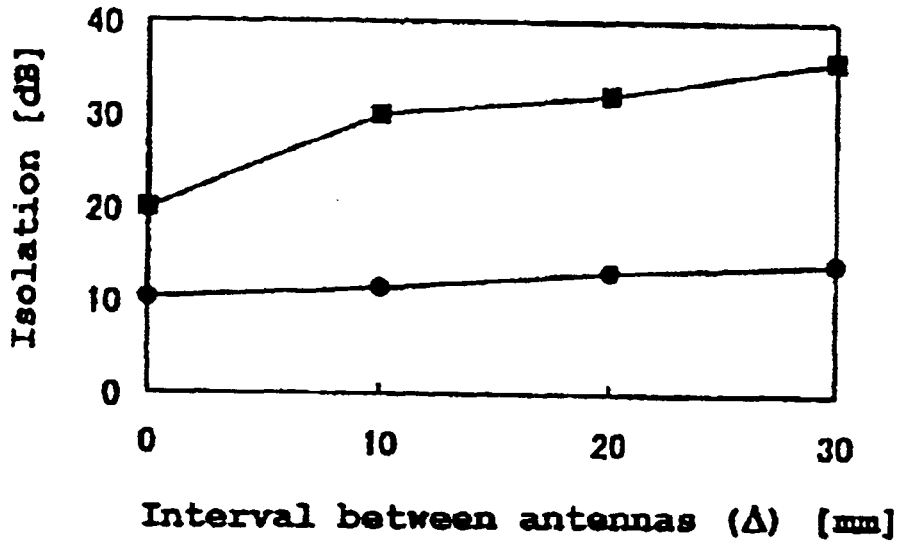
FIG. 33 is a graph showing the result of isolation measurement in an arrangement example shown in FIG. 32.

Isolation was measured when the monopole antennas were arranged as above (hereinafter referred to as influence exclusion arrangement). Similarly, isolation was measured when adjacent monopole antennas were arranged in the direction perpendicular to the longitudinal direction of the ceiling conductors 15 (hereinafter referred to as influence non-exclusion arrangement). These measurement results are shown in FIG. 33 where the line with black squares indicates the measurement results of the influence exclusion arrangement and the line with black circles indicates the measurement results of the influence non-exclusion arrangement. The horizontal axis indicates the interval (mm) between adjacent monopole antennas and the vertical axis indicates the measurement results of isolation (dB).

The graph of FIG. 33 reveals that the influence exclusion arrangement is superior in isolation. Since isolation can be secured easier in the influence exclusion arrangement, sufficient isolation can be obtained when low-performing isolation elements (filters) are employed. As a result, the production cost can be reduced.

When plural monopole antennas are used, they are arranged on a metallic base plate in order to reinforce the structure; however, in that case, the ground conductors 11 are short-circuited by the metallic base plate, deteriorating the isolation even with the influence exclusion arrangement. For this reason, it is better not to use a metallic base plate.

Figure 34:
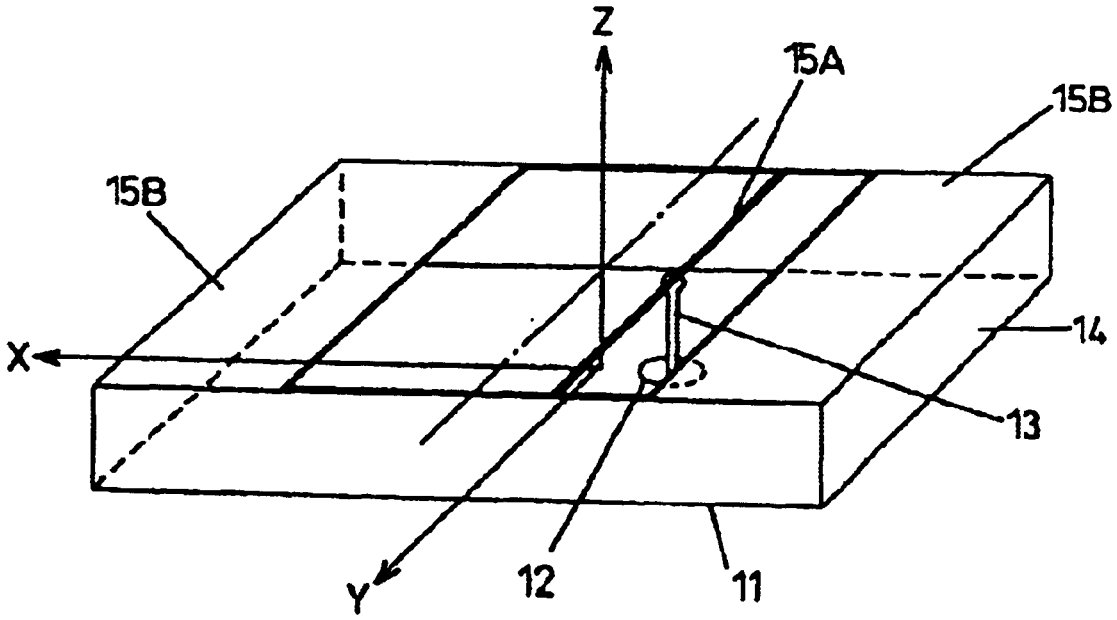
FIG. 34 is a schematic perspective view showing further another modified example of the present invention.
Figure 35:
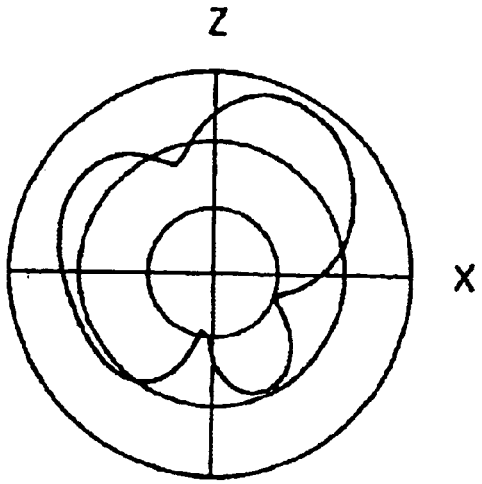
FIG. 35 is a diagram showing the radiation directivity of the modified example shown in FIG. 34.
Figure 36:
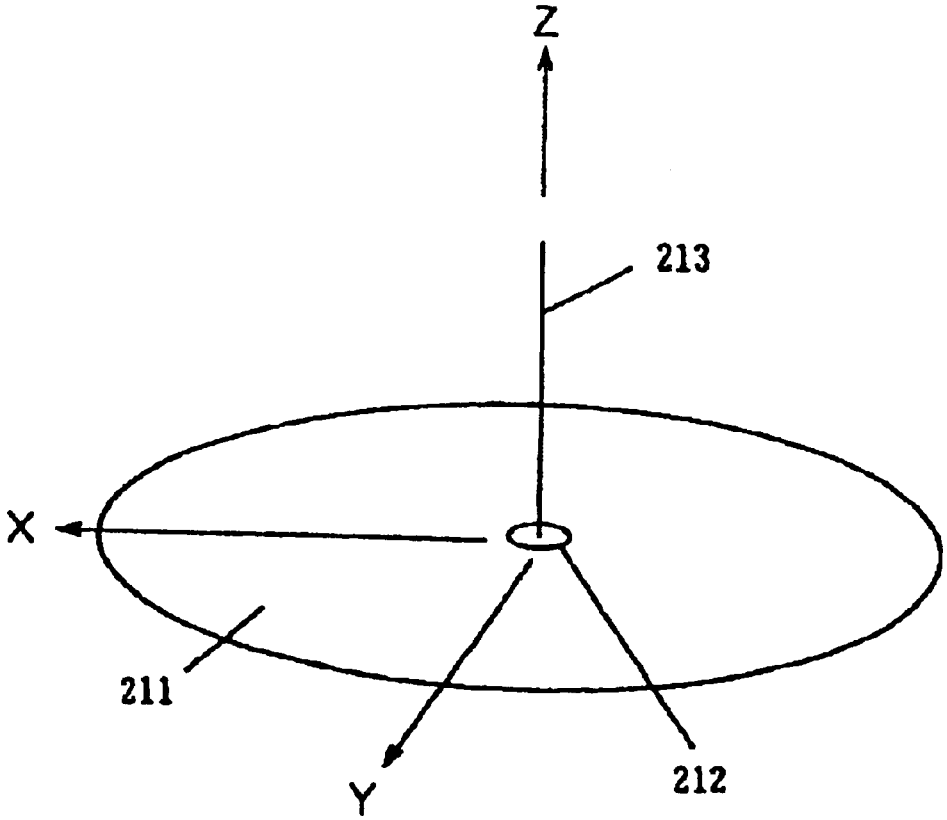
FIG. 36 is a perspective view showing the structure of a first conventional monopole antenna.

(22) In the first to seventh embodiments, the monopole antennas are symmetric with respect to the Z-X plane and the Z-Y plane, and the coaxial feeding point 12 is arranged in the origin point so as to make the radiation directivity along the horizontal plane non-directional. However, the present invention is not restricted to this structure; the coaxial feeding point 12 can be arranged out of the origin point in the direction of the horizontal plane, so as to adjust the directivity of radio waves along the horizontal plane. For example, as shown in FIG. 34, if the coaxial feeding point 12 is slightly shifted in the + direction along the X-axis, the directivity along the horizontal plane becomes as shown in FIG. 35. Thus the directivity along the Z-X plane is not symmetric with respect to the Z-Y plane, and becomes symmetric with respect to the slightly diagonal direction that connects the second and fourth quadrants.

(23) In the first to seventh embodiments, the coaxial feeding point 12 is on the ground conductor 11, which is not connected to the antenna element 13 electrically that is connected to the coaxial feeding point 12. However, the present invention is not restricted to such a structure, but as long as a conductive member of the present invention is in a space formed with the ground conductor 11 and side conductor 14, the conductive member can be arranged in arbitrary positions. Moreover, it is not necessary to provide a feeding point of the present invention on the ground conductor 11. That is, the antenna element 13 can be fixed so that it may be supported by members such as an insulator in an antenna space floating from the ground conductor 11. For example, in an antenna device according to an embodiment mentioned later, since a circuit having a feeding point is provided in an antenna, an antenna element is fixed in a space surrounded by the ground conductor 11 and the side conductor 14.

Although the aforementioned description shows the effects of the present invention in sending radio waves, it goes without saying that the same effects can be secured in receiving radio waves.

(Embodiment 9)

The antenna device of a ninth embodiment of the present invention is an antenna device which provided the circuit in the antenna of the present invention. As also described in the eighth embodiment previously, when the antenna of the present invention is connected to a radio circuit and is used, the antenna and the radio circuit are achieved as different structures.

Figure 55:
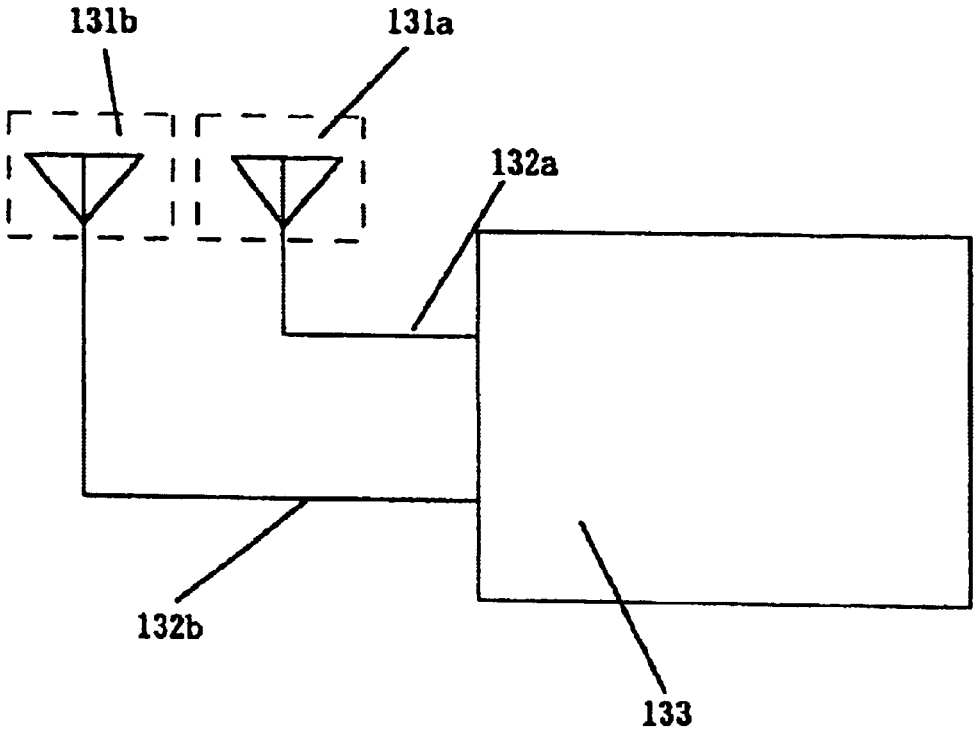
FIG. 55 is a block diagram showing the structure of a general antenna device.

Here, a case where the antenna consists of two antennas for transmission and reception respectively is shown in FIG. 55. FIG. 55 illustrates a transmitting antenna 131*a*, a receiving antenna 131*b*, signal transmission cables 132*a* and 132*b*, and a radio circuit 133. The transmitting antenna 131*a* and the radio circuit 133 are connected via the signal transmission cable 132*a*. Moreover, the receiving antenna 131*b* and the radio circuit 133 are connected via signal transmission cable 132*b*.

In this structure, a transmitter signal is sent to the transmitting antenna 131*a* via the signal transmission cable 132*a* from the radio circuit 133, and is radiated as radio waves. Moreover, the receiver signal received by the receiving antenna 131*b* is sent to the radio circuit 33 via the signal transmission cable 132*b*.

However, in a structural example shown in FIG. 55, when installing an antenna and a radio circuit, an inconspicuous, small, and low-profile structure is requested. Nevertheless, for example as described in the eighth embodiment, the antenna is arranged out of a cabinet (not shown) that stores the radio circuit 133. This is because it is desirable to install the antenna so that the antenna element faces a space, to which radio waves are radiated, for better wave radiation efficiently of the antenna. Furthermore, that is because it is desirable that there is nothing that interferes the propagation of radio waves between the antenna and all the radiation spaces, and that all the radiation target spaces can be overlooked from the antenna element.

Moreover, when a cabinet is constituted with metal, an antenna is arranged out of the cabinet. For this reason, a signal transmission cable for installing the antenna in the exterior of the radio circuit cabinet is needed.

However, as described above, it is requested that the antenna and radio circuit are to be inconspicuously installed from the viewpoint of appearance if possible. Nevertheless, for example, the structural example shown in FIG. 55 cannot meet such a request since the antenna and radio circuit exist separately and there is further the signal transmission cable for connection. Moreover, in such a structure as that of the eighth embodiment, a cabinet becomes large since an antenna is stored in the cabinet.

Then, this embodiment achieves an inconspicuous antenna device, maintaining effects of the antenna of the present invention by incorporating a circuit in the interior of an antenna.

Figure 40:
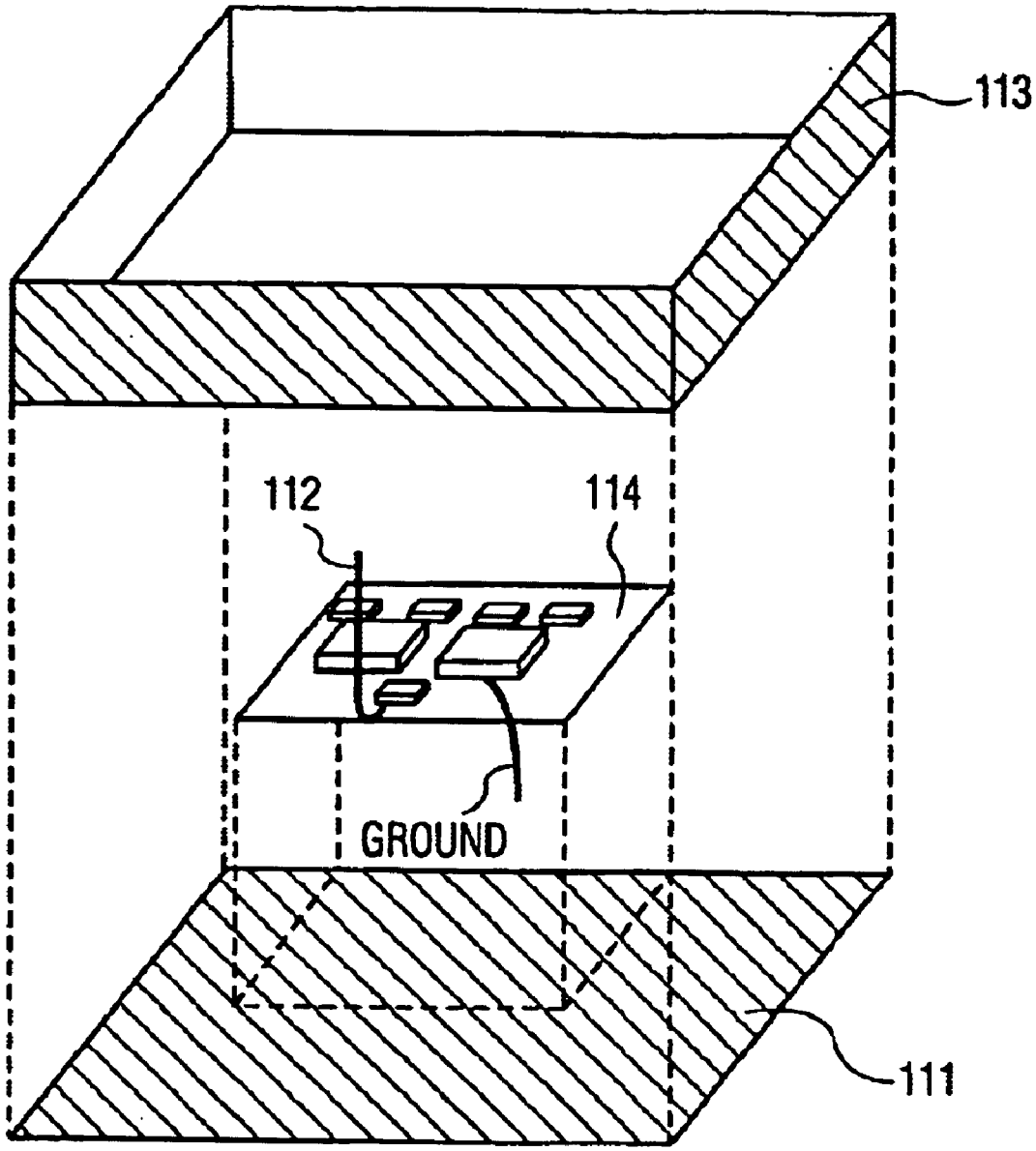
FIG. 40 is a schematic diagram showing an example of the structure of the antenna device described in the ninth embodiment of the present invention.

FIG. 40 shows the structure inside the antenna device in the ninth embodiment of the present invention. FIG. 40 illustrates the ground conductor 111, antenna element 112, side conductor 113, and circuit 114. In this embodiment like this, the antenna consists of the ground conductor 111, the antenna element 112, and the side conductor 113. The circuit 114 is located inside the antenna, and the antenna element 112 is connected to the circuit 114.

Here, a space surrounded by the side conductor 113 and the ground conductor 111 is called the interior of an antenna. On the other hand, a space opposite to the interior of the antenna with respect to the side conductor 113 and ground conductor 111 is called the exterior of the antenna.

As an example, FIG. 40 shows a case that the antenna element 112 is constituted with a monopole antenna element, that the ground conductor 111 is a rectangular plate, and that a cavity is formed by the ground conductor 111 and side conductor 113 that are connected electrically.

Next, the operation of the antenna device according to this embodiment will be described with using FIG. 40. In this embodiment, the operation of a simple antenna is performed similarly to that of each antenna device in the first to eighth embodiments described above. That is, the excitation of radio waves is also performed by the antenna element 112; radio waves with the frequency of $f_0$ are radiated; the current having a phase opposite to that of the current flowing in the antenna element flows from the ground conductor 111 to the side conductor 113; and radio waves are also radiated from the upper end of the side conductor 113.

Therefore, the antenna of this embodiment mainly radiates radio waves from the antenna element 112 and the upper end portion of the side conductor 113. Hence, even if a low-profile obstruction exists in a space surrounded by the ground conductor 111 and the side conductor 113, radiation of the antenna is hardly affected.

In addition, if the circuit 114 is arranged inside an antenna and a ground of the circuit 114 is electrically connected to the ground conductor 111, the current flowing from the ground conductor 111 to the side conductor 113 is not intercepted. Hence, there is no influence on the radiation characteristics of the antenna. However, it is not always necessary to connect the ground of the circuit 114, and ground conductor 111 electrically.

Thus, the antenna device of this embodiment arranges a circuit inside an antenna, with keeping the radiation characteristics of the antenna according to the present invention. Hence, the inconspicuous small antenna device is achieved.

(Embodiment 10)

Hereafter, a tenth embodiment of the present invention will be described with referring to FIG. 41.

Figure 41:
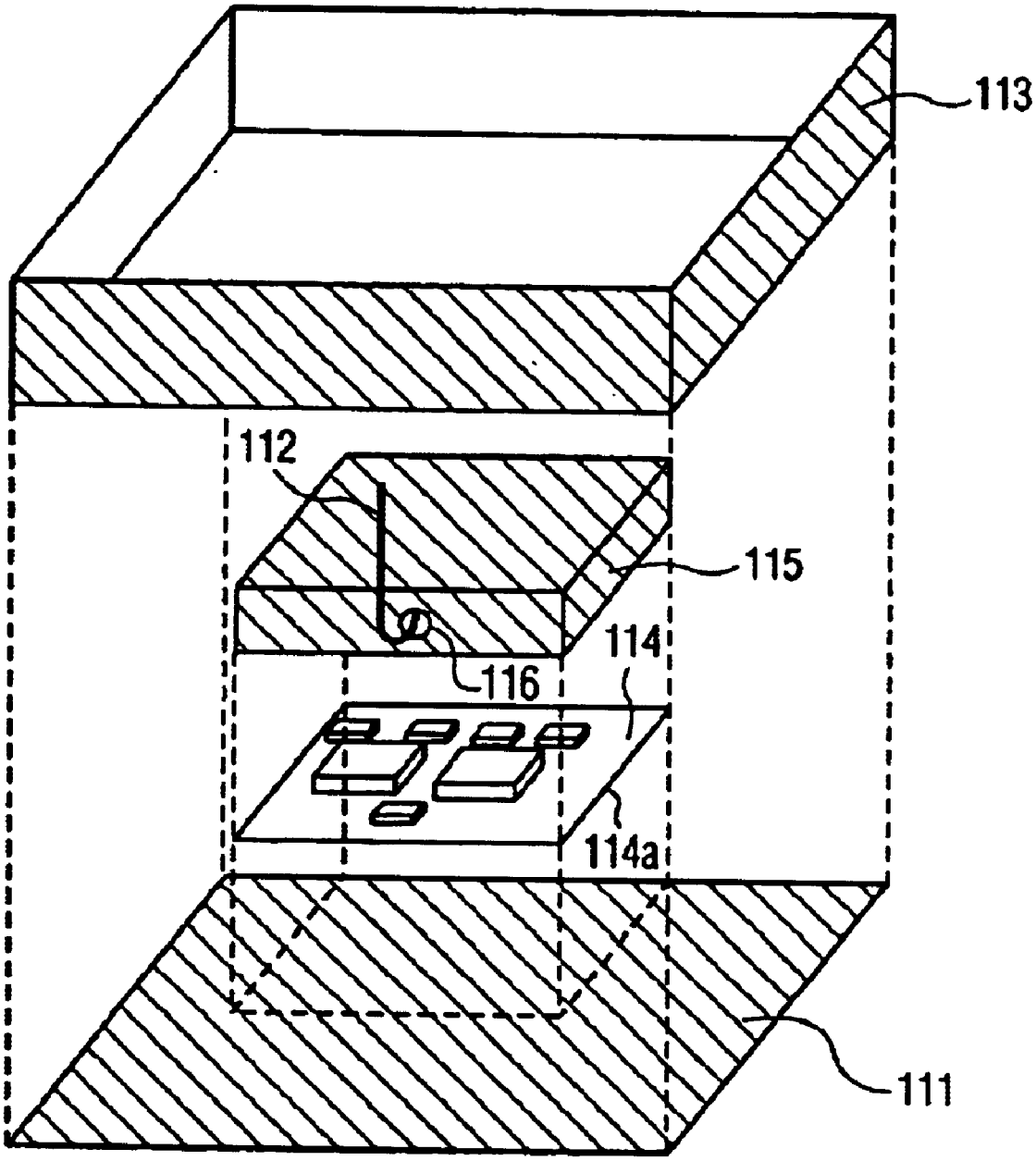
FIG. 41 is a schematic diagram showing an example of the structure of the antenna device described in the tenth embodiment of the present invention.

FIG. 41 shows the structure of an antenna device in the tenth embodiment of the present invention. FIG. 41 illustrates the ground conductor 111, antenna element 112, side conductor 113, circuit 114 including a substrate 114*a*, a boxlike shielding conductor 115 one of whose surface is opened, and a power supply part 116.

In this embodiment, the ground conductor 111, the antenna element 112, and the side conductor 113 constitute an antenna of the present invention.

The shielding conductor 115 is inside the antenna, and the circuit 114 is further arranged so that the circuit 114 including the substrate 114*a* is stored inside from an opening portion of the shielding conductor 115. Average of the opening portion of the shielding conductor 115 is connected to the ground conductor 111, and the circuit 114 is stored in a closed space formed by the shielding conductor 115 and ground conductor 111.

Moreover, the antenna element 112 is connected to the circuit 114 through the power supply part 116 set up on the shielding conductor 115. However, the antenna element 112 and shielding conductor 115 are isolated from each other through the power supply part 116. Moreover, the shielding conductor 115 and circuit 114 are also isolated.

Here, a space surrounded by the side conductor 113 and ground conductor 111 is called the interior of an antenna, and a space opposite to the interior of the antenna with respect to the side conductor 113 or ground conductor 111 is called the exterior of the antenna.

As an example, FIG. 41 shows a case that the antenna element 112 is constituted with a monopole antenna element, that the ground conductor 111 is a rectangular plate, and that a cavity is formed by the ground conductor 111 and side conductor 113 that are connected electrically.

Next, the operation of the antenna device according to this embodiment will be described with using FIG. 41. A radio wave having the frequency of $f_0$ is radiated from the antenna element 112. Furthermore, the current having a phase opposite to that of the current flowing in the antenna element flows from the ground conductor 111 to the side conductor 113, and radio waves are also radiated from the upper end of the side conductor 113.

Therefore, the antenna of this embodiment mainly radiates radio waves from the antenna element 112 and the upper end portion of the side conductor 113. Hence, even if a low-profile obstruction exists in a space surrounded by the ground conductor 111 and the side conductor 113, radiation of the antenna is hardly affected.

By the way, the radio waves radiated from the antenna may affect the element that is arranged on the circuit 114 to make the operation of the circuit unstable. In this embodiment, the circuit 114 is surrounded by the shielding conductor 115 and ground conductor 111, and a shielding conductor 115 and a ground conductor 111 are electrically connected completely. Thereby, the radio waves radiated from the antenna do not arrive at the circuit 114.

At this time, the current flowing in the ground conductor 111 flows from the ground conductor 111 to the side conductor 113, or flows from the ground conductor 111 to the side conductor 113 through the outside surface of the shielding conductor 115. Since the current flowing from the ground conductor 111 to the side conductor 113 is not intercepted at this time, there is no influence on the radiation characteristics of the antenna.

Moreover, since the current flowing from the ground conductor 111 to the side conductor 113 is not intercepted if the ground of the circuit 114 and the ground conductor 111 are electrically connected when the circuit 114 is arranged inside the antenna, there is no influence on the radiation characteristics of the antenna. At this time, as for the shielding conductor 115 and circuit 114, only the ground of the circuit 114 is connected electrically. However, it is not always necessary to connect the ground of the circuit 114, and ground conductor 111 electrically.

Thus, the antenna device of this embodiment arranges a circuit inside an antenna, with keeping the radiation characteristics of the antenna according to the present invention and further not affecting the operation of a circuit. Hence, the inconspicuous small antenna device is achieved.

(Embodiment 11)

Hereafter, an eleventh embodiment of the present invention will be described with referring to FIG. 42.

Figure 42:
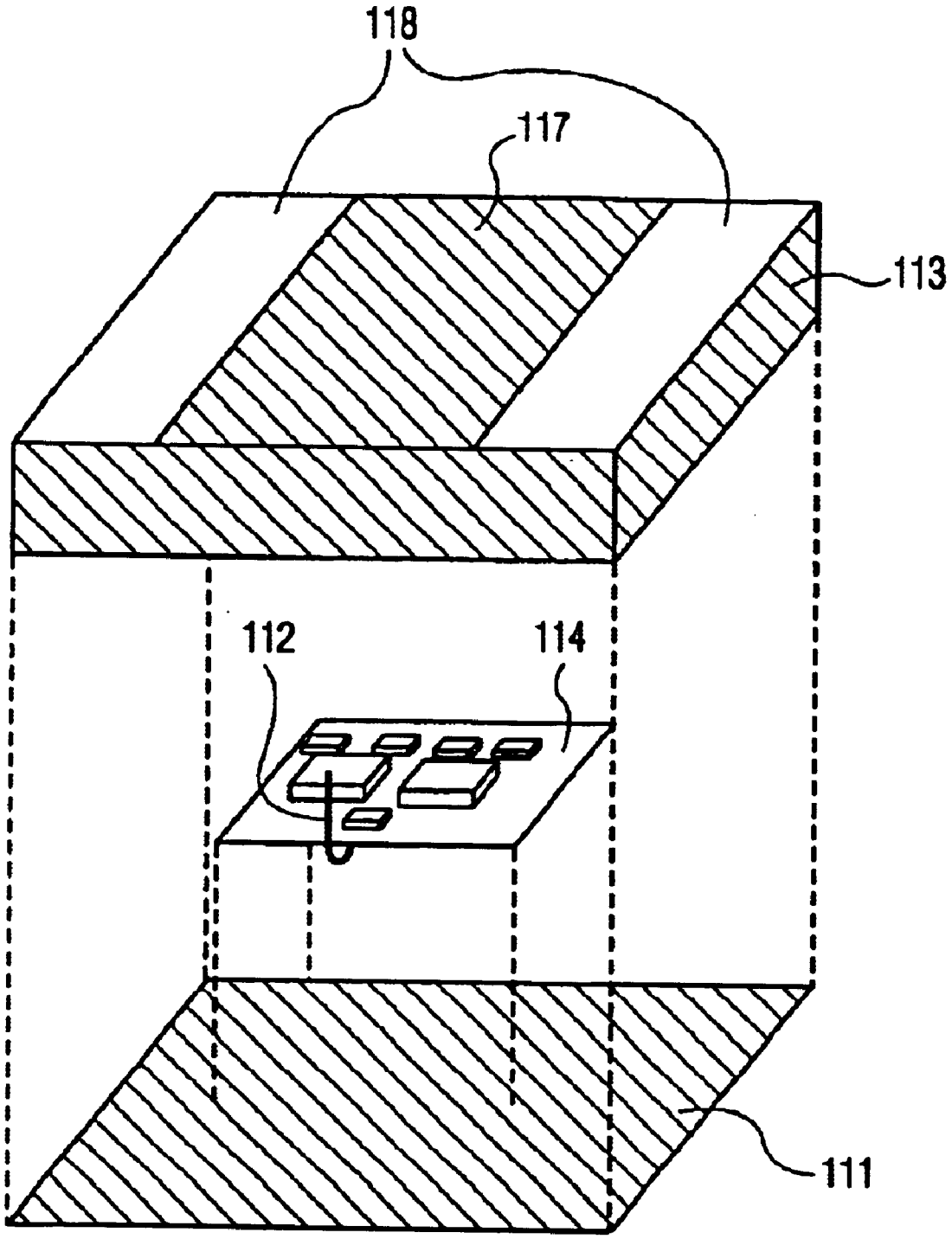
FIG. 42 is a schematic diagram showing an example of the structure of the antenna device described in the eleventh embodiment of the present invention.

FIG. 42 shows the structure of an antenna device in the eleventh embodiment of the present invention. FIG. 42 illustrates the ground conductor 111, antenna element 112, side conductor 113, circuit 114, a ceiling conductor 117, and openings 118. In this embodiment, an antenna of the present invention consists of the ground conductor 111, antenna element 112, side conductor 113, and ceiling conductor 117, and the structure is substantially the same as that of the antenna in the first embodiment.

Moreover, the circuit 114 is located in the interior of the antenna, and the antenna element 112 is connected to the circuit 114. Furthermore, the openings 118 are on the ceiling conductor 117.

Here, a space surrounded by the side conductor 113, ground conductor 111, and ceiling conductor 117 is called the interior of an antenna. On the other hand, a space opposite to the interior of the antenna with respect to the side conductor 113, ground conductor 111, or ceiling conductor 117 is called the exterior of the antenna.

As an example, FIG. 42 shows a case that the antenna element 112 is constituted with a monopole antenna element, that the ground conductor 111 is a rectangular plate, that the ground conductor 111 and side conductor 113 are electrically connected, and that a cavity is formed by the side conductor 113 and ceiling conductor 117 that are connected electrically.

Next, the operation of the antenna device according to this embodiment will be described with using FIG. 42.

A radio wave having the frequency of $f_0$ is radiated from the antenna element 112. This wave is radiated out into an external space through the openings 118. Also, in this case, the current having a phase opposite to that of the current flowing in the antenna element 112 flows in the ground conductor 111.

Therefore, the antenna of this embodiment mainly radiates radio waves from the openings 118 similarly to the antenna in the first embodiment. Hence, even if a low-profile obstruction exists in a space surrounded by the ground conductor 111, the side conductor 113, and the ceiling conductor 117, radiation of the antenna is not affected.

Since the current flowing from the ground conductor 111 to the side conductor 113 is not intercepted if the ground of the circuit 114 and the ground conductor 111 are electrically connected when the circuit 114 is arranged inside the antenna, there is no influence on the radiation characteristics of the antenna. However, it is not always necessary to connect the ground of the circuit 114, and ground conductor 111 electrically.

Furthermore, in the antenna of the antenna device of this embodiment, it is possible to obtain the desired directivity by adequately determining the number and positions of openings according to the structure of a ceiling conductor such as a shape and a number thereof.

Thus, the antenna device of this embodiment makes it possible to obtain the desired directivity with keeping the characteristics of the antenna according to the present invention and makes it possible to arrange a circuit in the antenna without changing the radiation directivity of the radio waves. Hence, the inconspicuous small antenna device is achieved.

Figure 43:
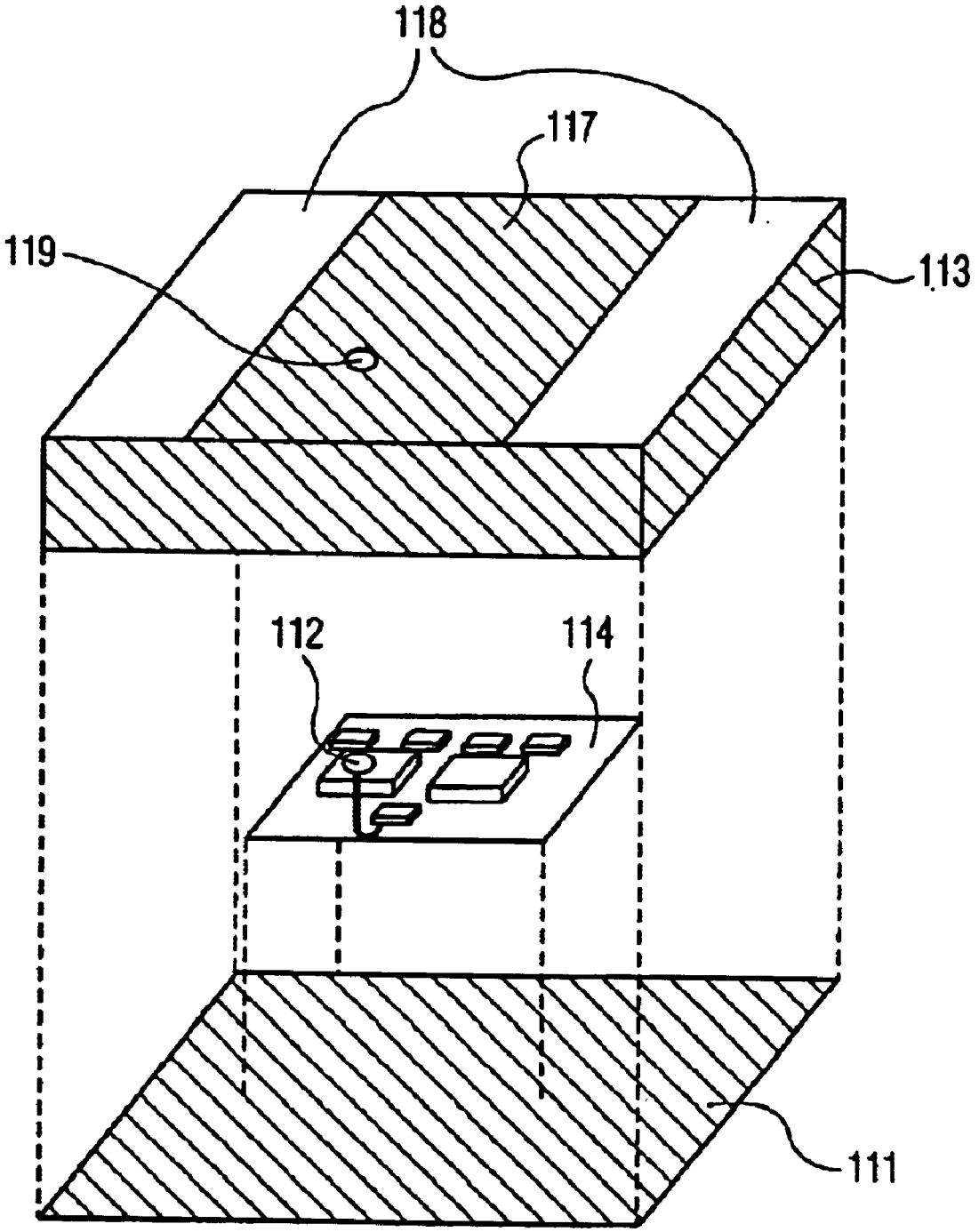
FIG. 43 is a schematic diagram showing an example of the structure of the antenna device described in the eleventh embodiment of the present invention.

In addition, in this embodiment, as shown in FIG. 43, it is also possible to make an end portion of the antenna element 112 electrically connect to the ceiling conductor 117 at a connection point 119. While it becomes possible to adjust the input impedance of an antenna owing to this, mechanical strength improves, and hence the outstanding antenna can be achieved. That is, the same effect as the antenna of the second embodiment can be acquired.

Moreover, in this embodiment, the antenna device having the structure where the antenna element 112 and ceiling conductor 117 are electrically connected is described as an example. Nevertheless, the present invention is not restricted to the antenna device with this structure. For example, in order to obtain the desired input impedance characteristics, the structure where a ceiling conductor and an antenna element are separated electrically is also possible. For example, the antenna element can be a helical type monopole antenna element made of a coiled conductive wire, or can be a reverse L type or a reverse F type monopole antenna by folding the conductive wire in the form of letter L or F. It also can be a top loading type monopole antenna element having a capacitive load such as a conductive plate at the end portion of a conductive wire. Alternatively, these can be combined to form a different antenna element.

This makes the antenna element small and low-profile, thereby making the antenna as a whole small and low-profile.

(Embodiment 12)

Hereafter, a twelfth embodiment of the present invention will be described with referring to FIG. 44.

Figure 44:
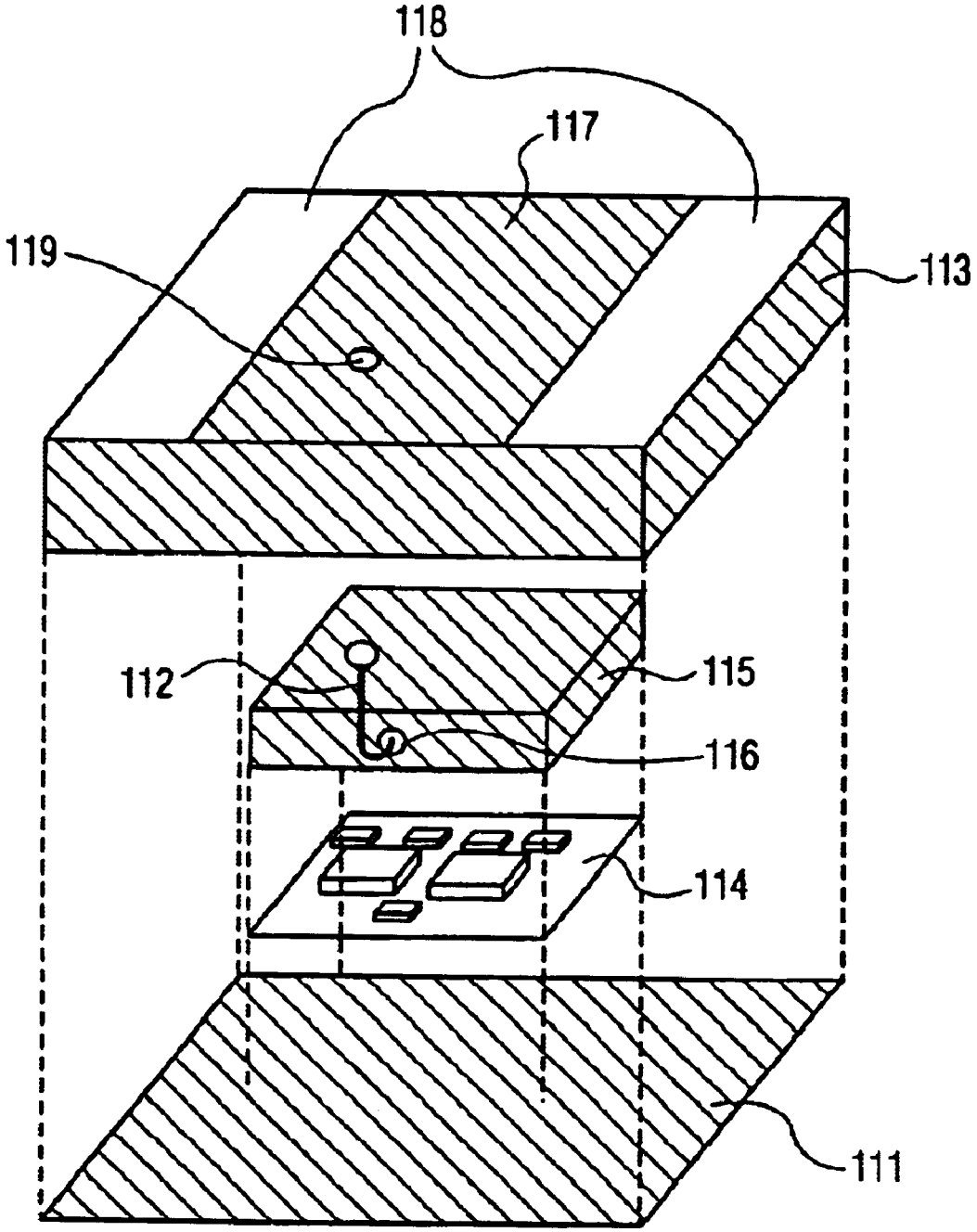
FIG. 44 is a schematic diagram showing an example of the structure of the antenna device described in the twelfth embodiment of the present invention.

FIG. 44 shows the structure of an antenna device in the twelfth embodiment of the present invention. FIG. 44 illustrates the ground conductor 111, antenna element 112, side conductor 113, circuit 114, a shielding conductor 115, power supply part 116, ceiling conductor 117, openings 118, and a connection point 119 provided on the ceiling conductor 117. In this embodiment, the ground conductor 111, the antenna element 112, the side conductor 113, and the ceiling conductor 117 constitute an antenna of the present invention.

Moreover, the circuit 114 is located on the ground conductor 111, and the antenna element 112 is connected to the circuit 114. Moreover, the openings 118 are portion surrounded by the ceiling conductor 117 and the side conductor 113.

Here, a space surrounded by the side conductor 113, ground conductor 111, and ceiling conductor 117 is called the interior of an antenna, and a space opposite to the interior of the antenna with respect to the side conductor 113, ground conductor 111, or ceiling conductor 117 is called the exterior of the antenna. Therefore, the circuit 114 is arranged in the interior of the antenna.

As an example, FIG. 44 shows a case that the antenna element 112 is constituted with a monopole antenna element and electrically connected to the ceiling conductor 117 at the connection point 119, that the ground conductor 111 is a rectangular plate, that the ground conductor 111 and side conductor 113 are electrically connected, and that a cavity is formed by the ground conductor 113 and ceiling conductor 117 that are connected electrically. That is, the structure of the antenna of this embodiment is substantially the same as the antenna in the second embodiment.

Next, the operation of the antenna device according to this embodiment will be described with using FIG. 44. The excitation of a radio wave is performed like the operation of the antenna in the second embodiment. A radio wave having the frequency of $f_0$ is radiated from the antenna element 112. This wave is radiated out into an external space through the openings 118. Also, in this case, the current having a phase opposite to that of the current flowing in the antenna element 112 flows in the ground conductor 111.

Therefore, the antenna of this embodiment mainly radiates a radio wave from opening 118. Hence, even if a low-profile obstruction exists in a space surrounded by the ground conductor 111, side conductor 113, and ceiling conductor 117, radiation of the antenna is not affected.

By the way, the radio waves radiated from the antenna may affect the element that is arranged on the circuit 114 to make the operation of the circuit unstable. In this embodiment, the circuit 114 is surrounded by the shielding conductor 115 and ground conductor 111, and the shielding conductor 115 and a ground conductor 111 are electrically connected completely. Thereby, the radio wave radiated from the antenna does not arrive at the circuit 114.

At this time, the current flowing in the ground conductor 111 flows from the ground conductor 111 to the side conductor 113, or flows from the ground conductor 111 to the side conductor 113 through the outside surface of the shielding conductor 115. Since the current flowing from the ground conductor 111 to the side conductor 113 is not intercepted at this time, there is no influence on the radiation characteristics of the antenna.

Furthermore, since the current flowing from the ground conductor 111 to the side conductor 113 is not intercepted if the ground of the circuit 114 and the ground conductor 111 are electrically connected when the circuit 114 is arranged inside the antenna, there is no influence on the radiation characteristics of the antenna. At this time, as for the shielding conductor 115 and circuit 114, only the ground of the circuit 114 is connected electrically. However, it is not always necessary to connect the ground of the circuit 114, and ground conductor 111 electrically.

Furthermore, in the antenna of the antenna device of this embodiment, it is possible to obtain the desired directivity by adequately determining the number and positions of openings according to the structure of a ceiling conductor such as a shape and a number thereof.

Figure 45:
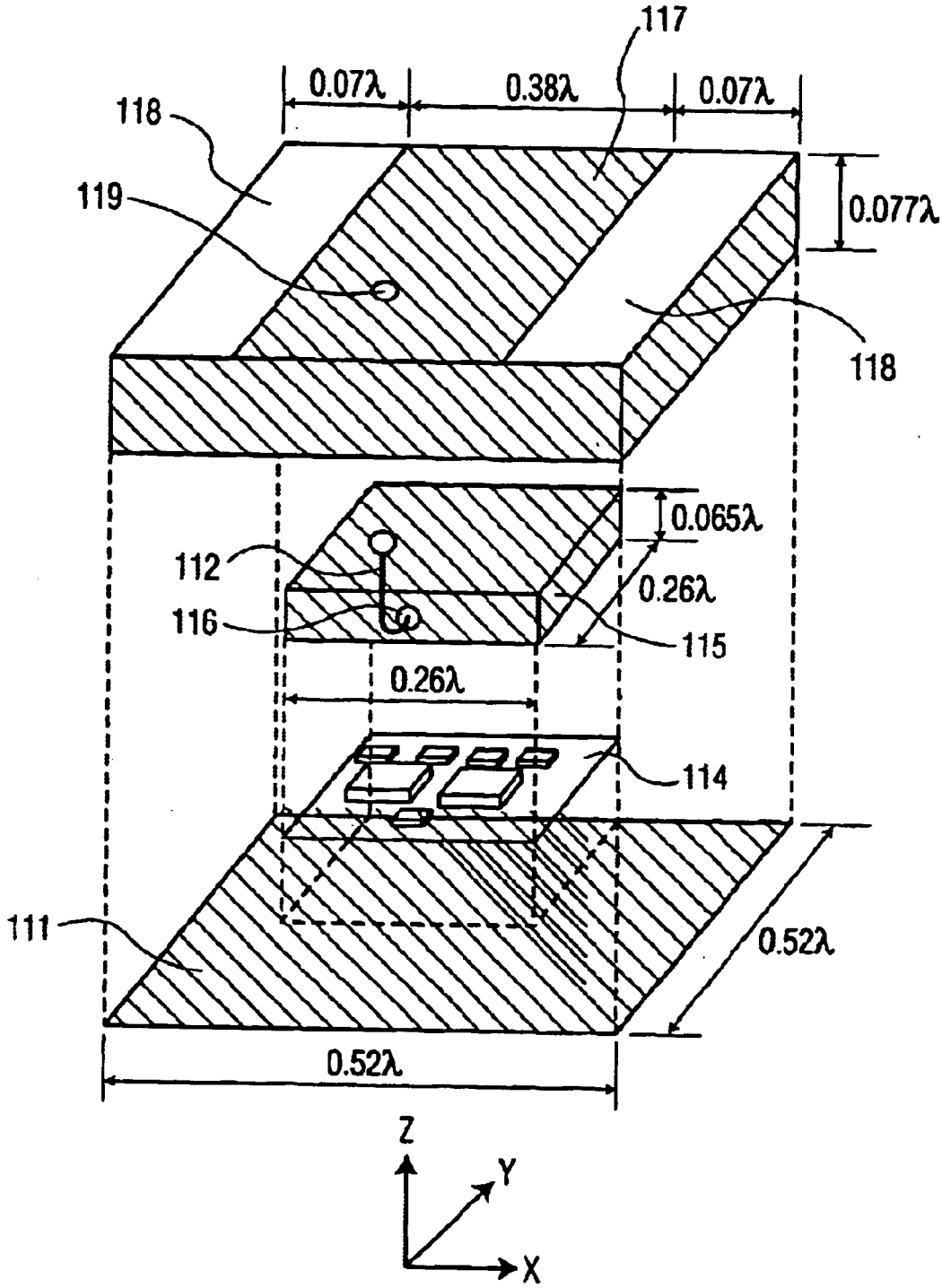
FIG. 45 is a schematic diagram showing an example of a working prototype of the antenna device described in the twelfth embodiment of the present invention.
Figure 46:
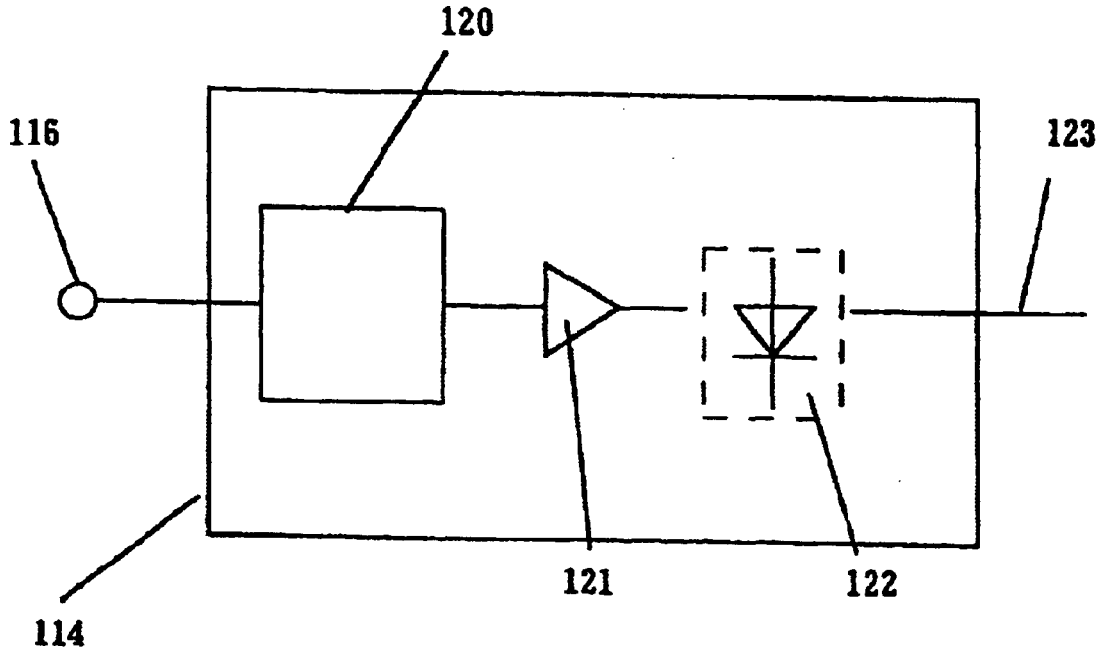
FIG. 46 is a block diagram showing a structural example of a working prototype circuit of the antenna devices described in the ninth to fourteenth embodiments of the present invention.
Figure 47:
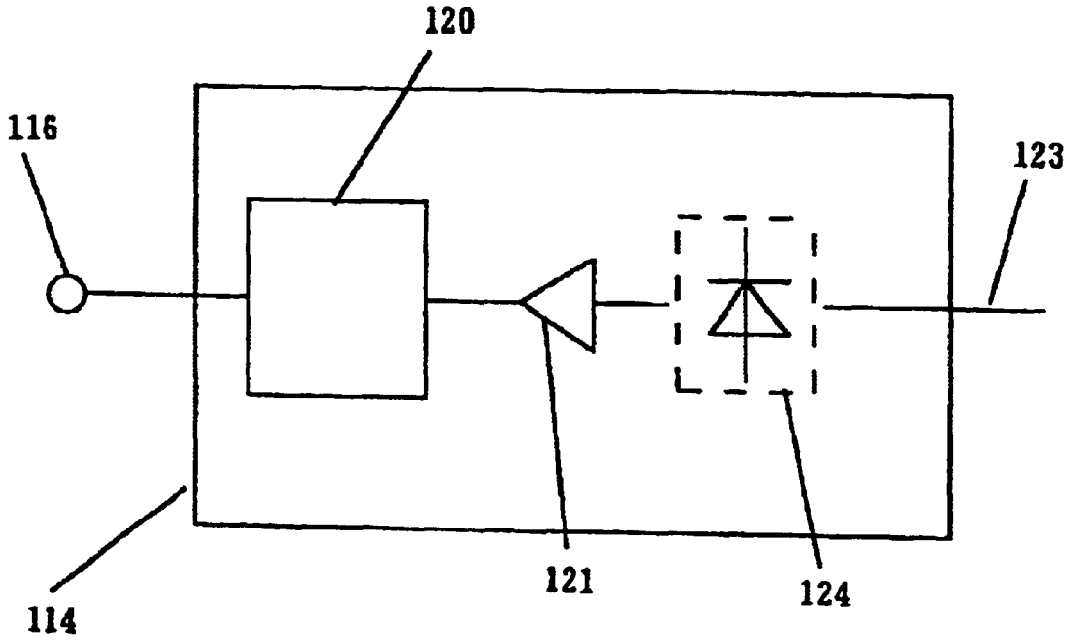
FIG. 47 is a block diagram showing a structural example of a working prototype circuit of the antenna devices described in the ninth to fourteenth embodiments of the present invention.
Figure 48:
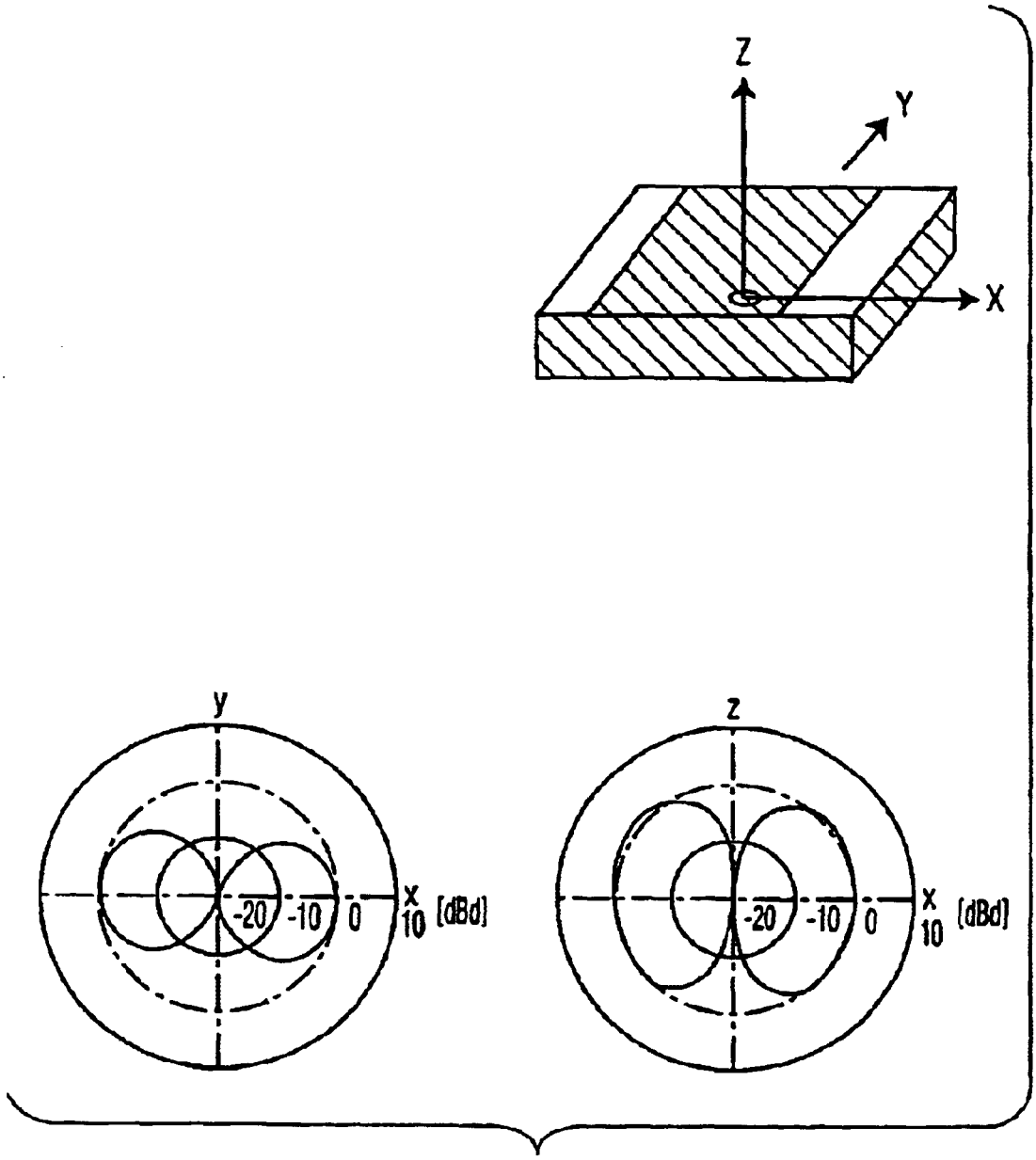
FIG. 48 is a diagram showing the radiation characteristics of the working prototype of the antenna device described in the twelfth embodiment of the present invention.
Figure 49:
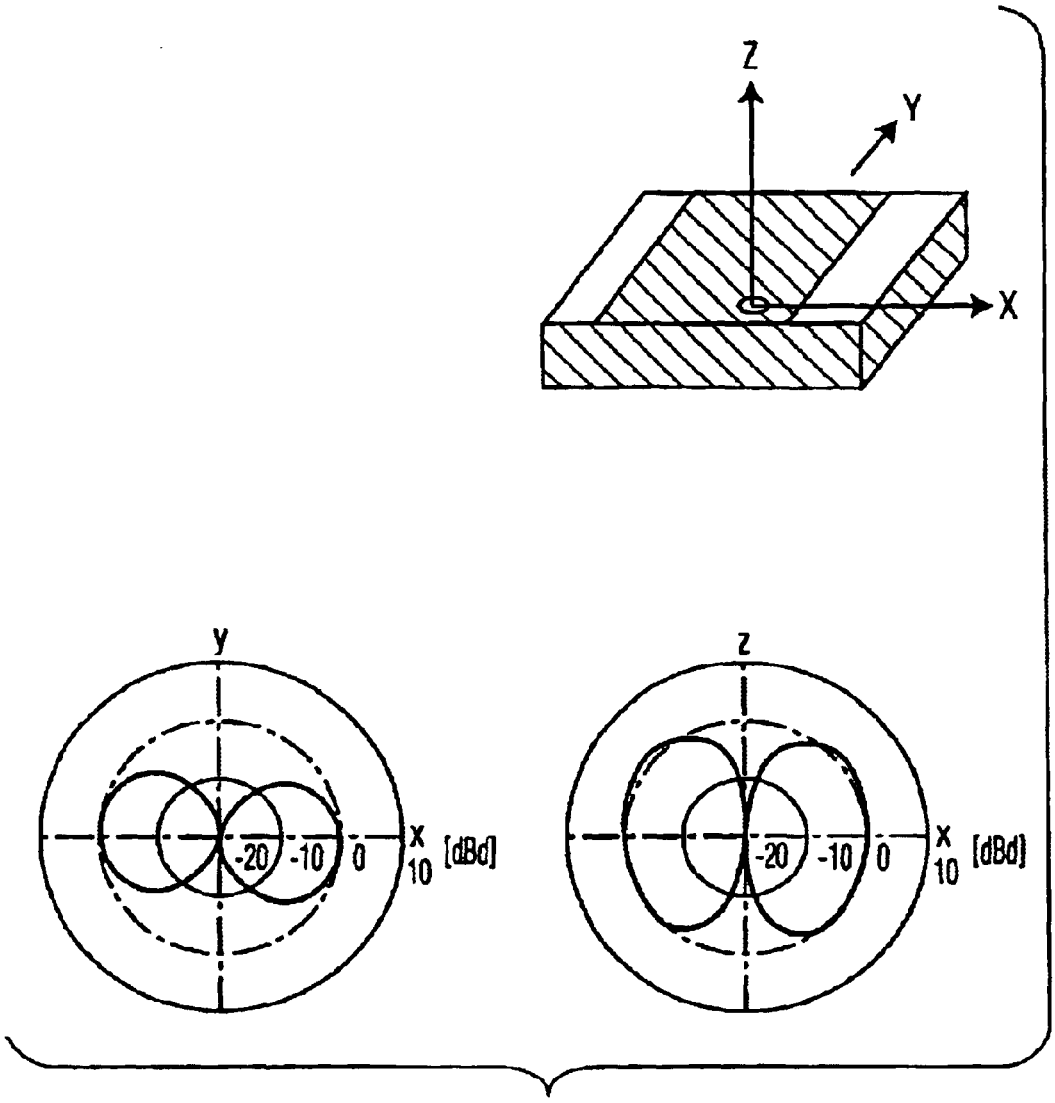
FIG. 49 is a diagram showing the radiation characteristics at the time of a simple antenna of the antenna device described in the twelfth embodiment of the present invention.
Figure 50:
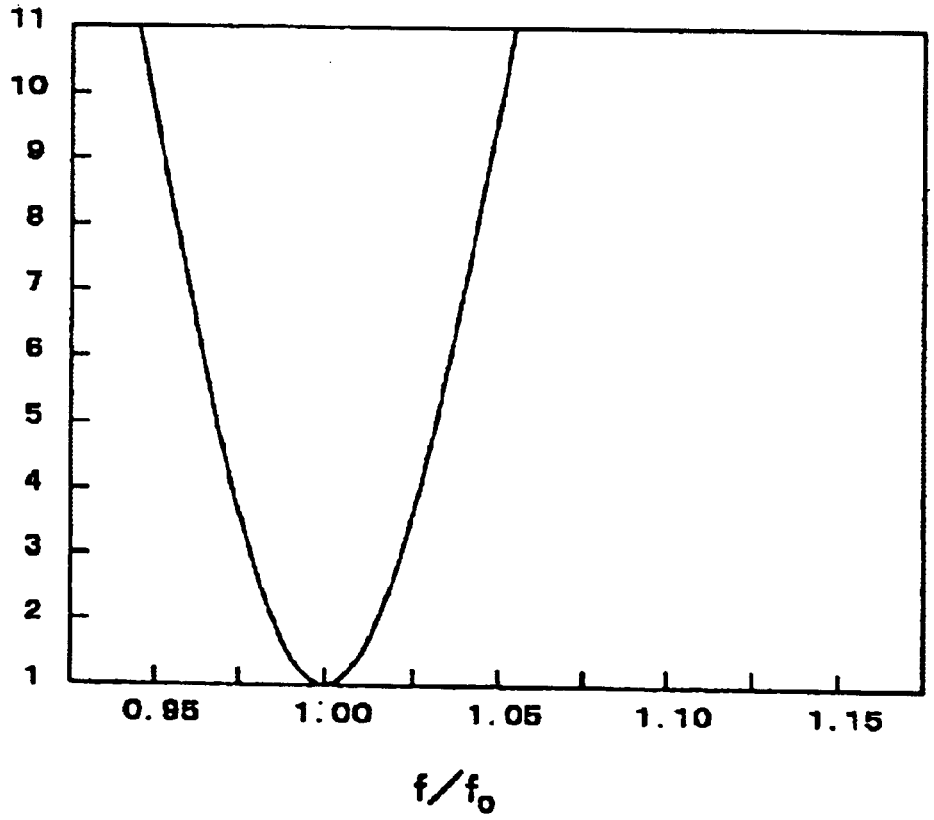
FIG. 50 is a graph showing the impedance characteristics of the working prototype of the antenna device described in the twelfth embodiment of the present invention.

Next, the working prototype antenna device of this embodiment is shown in FIG. 45, and the structure of its circuit is shown in FIGS. 46 and 47. Moreover, the radiation characteristics of the working prototype antenna device is shown in FIG. 48, and the radiation characteristics at the time of a simple antenna without the circuit 114 and shielding conductor is shown in FIG. 49. Furthermore, the input impedance characteristic in the power supply part of the working prototype antenna device is shown in FIG. 50.

The ground conductor 111 was made to be a square having each side with the length of 0.52 wavelength, referred to the free space wavelength. The height of the side conductor 113 was made 0.077 wavelength. The ceiling conductor 117 was made to be a rectangle having a side with the length of 0.38 wavelength parallel to the X-axis and the other side with the length of 0.52 wavelength parallel to the Y-axis. The two openings 18 each were a rectangle having a side with the length of 0.07 wavelength parallel to the X-axis and the other side with the length of 0.52 wavelength parallel to the Y-axis, and were arranged in both ends of an antenna ceiling portion in the X direction.

Moreover, the circuit 114 faced an edge of the antenna device in the positive direction of the Y-axis, and was arranged symmetrically with reference to the Y-axis. The shielding conductor 115 was a cuboid that had a bottom face that is a square having each side with the length of 0.26 wavelength, and each conductive side face that was a rectangle having the height of 0.065 wavelength, and was arranged so that the shielding conductor 115 might cover the circuit 114.

The following drawings will show the characteristics of the antenna of the antenna device according to this embodiment having the above structure when the antenna is symmetrical with respect to the Z-X and Z-Y planes.

FIG. 48 shows the radiation directivity of the working prototype antenna device of this embodiment. Moreover, FIG. 49 shows the radiation characteristics in the structure consisting of only a simple antenna without the circuit and shielding conductor. The radiation directivity is calibrated in 10 dB, and the unit is dBi, referred to the electric power value of a radiation wave of a radio wave source.

As shown in FIGS. 48 and 49, it can be seen that the radiation characteristics of the antenna device according to this embodiment is completely equal to that at the time of the simple antenna without the circuit and shielding conductor. That is, the radiation characteristics do not change with the circuit 114 and shielding conductor 115.

Next, FIG. 50 shows the input impedance characteristic in the power supply part 116 of the working prototype antenna device according to this embodiment. FIG. 50 is the voltage standing wave ratio (VSWR) in a 50-ohm power supply path. Thus, it can be seen that good matching is performed with the center frequency $f_0$ as the center.

In addition, although the high frequency filter and amplification circuit that were easy to influence by a radio wave from an antenna were included in the circuit 114, they were shielded completely by the shielding conductor 115 and ground conductor 111. Hence, stable operation was confirmed without degradation of the operation.

Thus, the antenna device of this embodiment makes it possible to obtain the desired directivity and to arrange a circuit in the antenna with keeping the wave radiation characteristics. Hence, the inconspicuous small antenna device is achieved.

(Embodiment 13)

Hereafter, a thirteenth embodiment of the present invention will be described with referring to FIG. 51.

Figure 51:
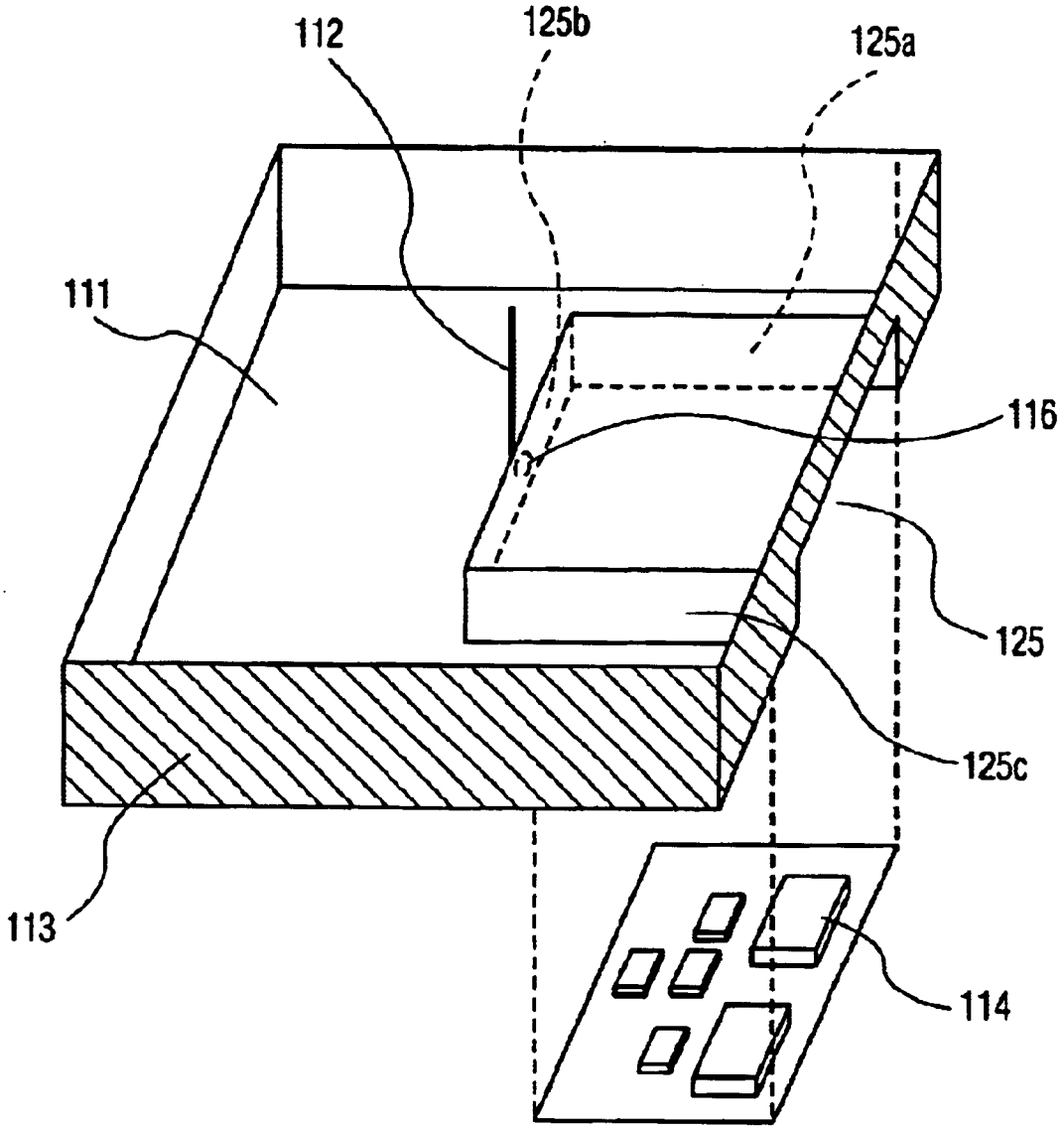
FIG. 51 is a schematic diagram showing an example of the structure of the antenna device described in the thirteenth embodiment of the present invention.

FIG. 51 shows the structure of an antenna device in the thirteenth embodiment of the present invention. FIG. 51 illustrates the ground conductor 111, antenna element 112, side conductor 113, circuit 114, a power supply part 116, and a concave portion 125.

Moreover, the concave portion 125 is an area surrounded by side walls 125*a*, 125*b*, and 125*c* formed by depressing each part of the ground conductor 111 and side conductor 113, joined to the ground conductor 111, from the outside to the inside. In addition, the power supply part 116 is provided on the side wall 125*b*.

In this embodiment, the ground conductor 111, the antenna element 112, and the side conductor 113 constitute an antenna of the present invention. The circuit 114 is arranged in the concave portion 125 of the antenna. Its circumference is connected to the antenna element 112 through the power supply part 116 while it is covered by side walls 125*a* to 125*c*. At this time, the antenna element 112 and side walls 125 are isolated from each other through the power supply part 116.

Here, a space surrounded by the side conductor 113 and ground conductor 111 is called the interior of an antenna, and a space opposite to the interior of the antenna with respect to the side conductor 113 or ground conductor 111 is called the exterior of the antenna.

As an example, FIG. 51 shows a case that the antenna element 112 is constituted with a monopole antenna element, that the ground conductor 111 is a rectangular plate, and that a cavity is formed by the ground conductor 111 and side conductor 113 that are connected electrically.

Next, the operation of the antenna device according to this embodiment will be described with using FIG. 51. A radio wave having the frequency of $f_0$ is radiated from the antenna element 112. Furthermore, the current having a phase opposite to that of the current flowing in the antenna element flows from the ground conductor 111 to the side conductor 113, and radio waves are also radiated from the upper end of the side conductor 113.

Therefore, the antenna of this embodiment mainly radiates radio waves from the antenna element 112 and the upper end portion of the side conductor 113. Hence, even if a low-profile obstruction exists in a space surrounded by the ground conductor 111 and the side conductor 113, radiation of the antenna is hardly affected. That is, even if the concave portion 125 exists in the interior of the antenna, radiation of an antenna is hardly affected.

Furthermore, the radiation characteristics are not affected even if the circuit 114 is arranged inside the concave portion 125. In this case, it is not always necessary to connect the circuit 114 with the ground conductor 111 electrically, but ground of the circuit 114 and ground conductor 111 can be connected electrically so as to make grounds of the antenna and circuit 114 common.

Here, in a case of using the tenth embodiment in a high frequency band, if a clearance is between the shielding conductor 115, and ground conductor 111 or side conductor 113, the clearance operates as a capacitor and there is a possibility of an impedance characteristic shifting.

However, this embodiment forms the concave portion 125 by the side walls 125*a* to 125*c* that are formed by depressing the ground conductor 111 and side conductor 113. Hence, it becomes possible to form in one piece the shielding conductor, ground conductor, and side conductor that are shown in the tenth embodiment. For this reason, since the shielding conductor, ground conductor, and side conductor are electrically connectable completely, the impedance characteristic does not shift and the antenna performance does not deteriorate.

Figure 52:
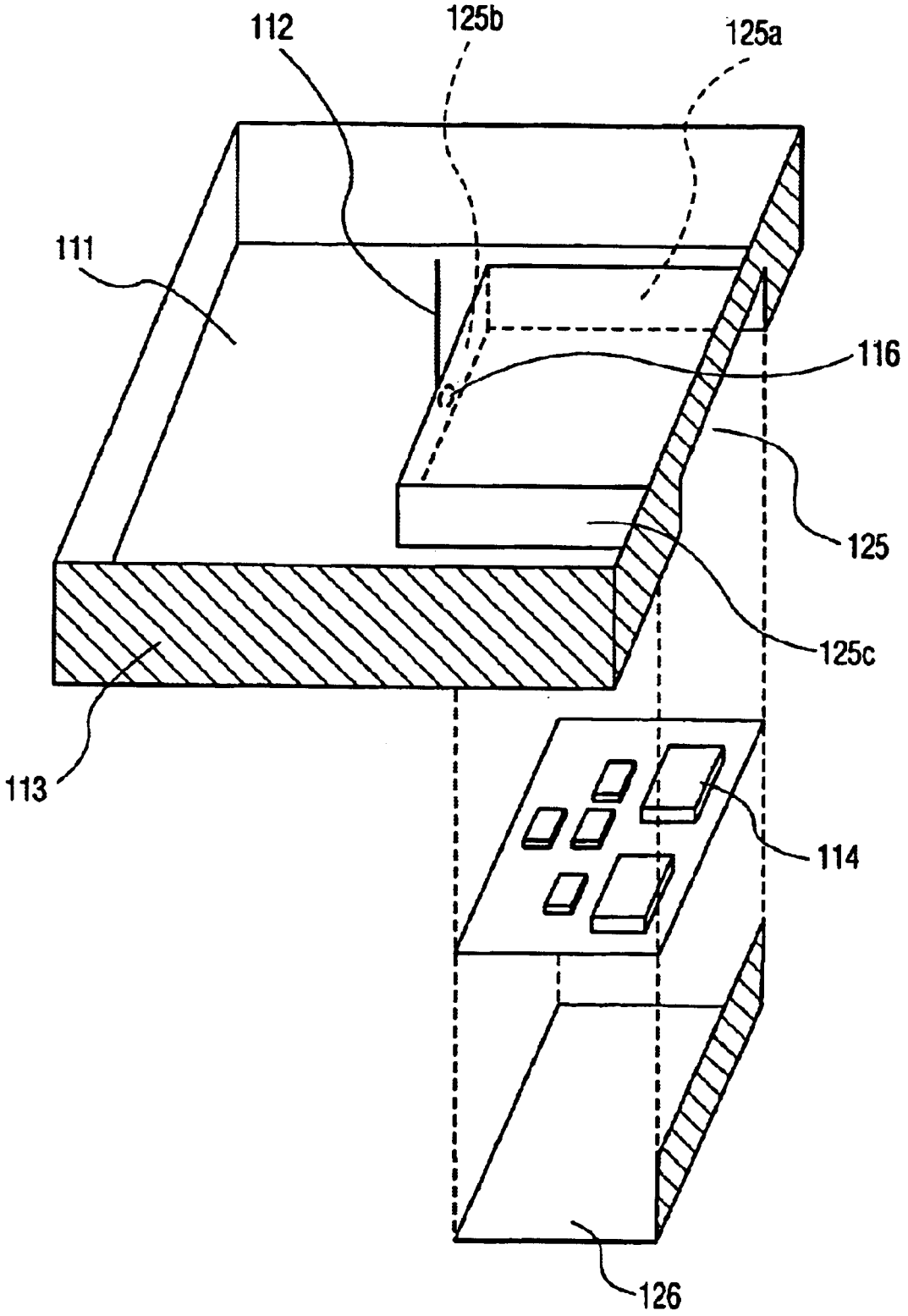
FIG. 52 is a schematic diagram showing another example of the structure of the antenna device described in the thirteenth embodiment of the present invention.

By the way, the radio waves radiated from the antenna may affect the element that is arranged on the circuit 114 to make the operation of the circuit unstable. In this case, as shown in FIG. 52, the concave portion 125 is covered by a lid conductor 126, and the lid conductor 126 and ground conductor 111 are electrically connected completely. Thereby, radio waves radiated from the antenna do not arrive at the circuit 114, and hence it becomes possible to stabilize the operation of the circuit 114. Since current does not flow in the exterior of the antenna at this time, there is no influence on the radiation characteristics of the antenna. Here, the lid conductor 126 is equivalent to a lid member of the present invention.

Thus, the antenna device of this embodiment arranges a circuit inside an antenna, with keeping the radiation characteristics of the antenna according to the present invention. Hence, the inconspicuous small antenna device is achieved.

(Embodiment 14)

Hereafter, a fourteenth embodiment of the present invention will be described with referring to FIG. 53.

Figure 53:
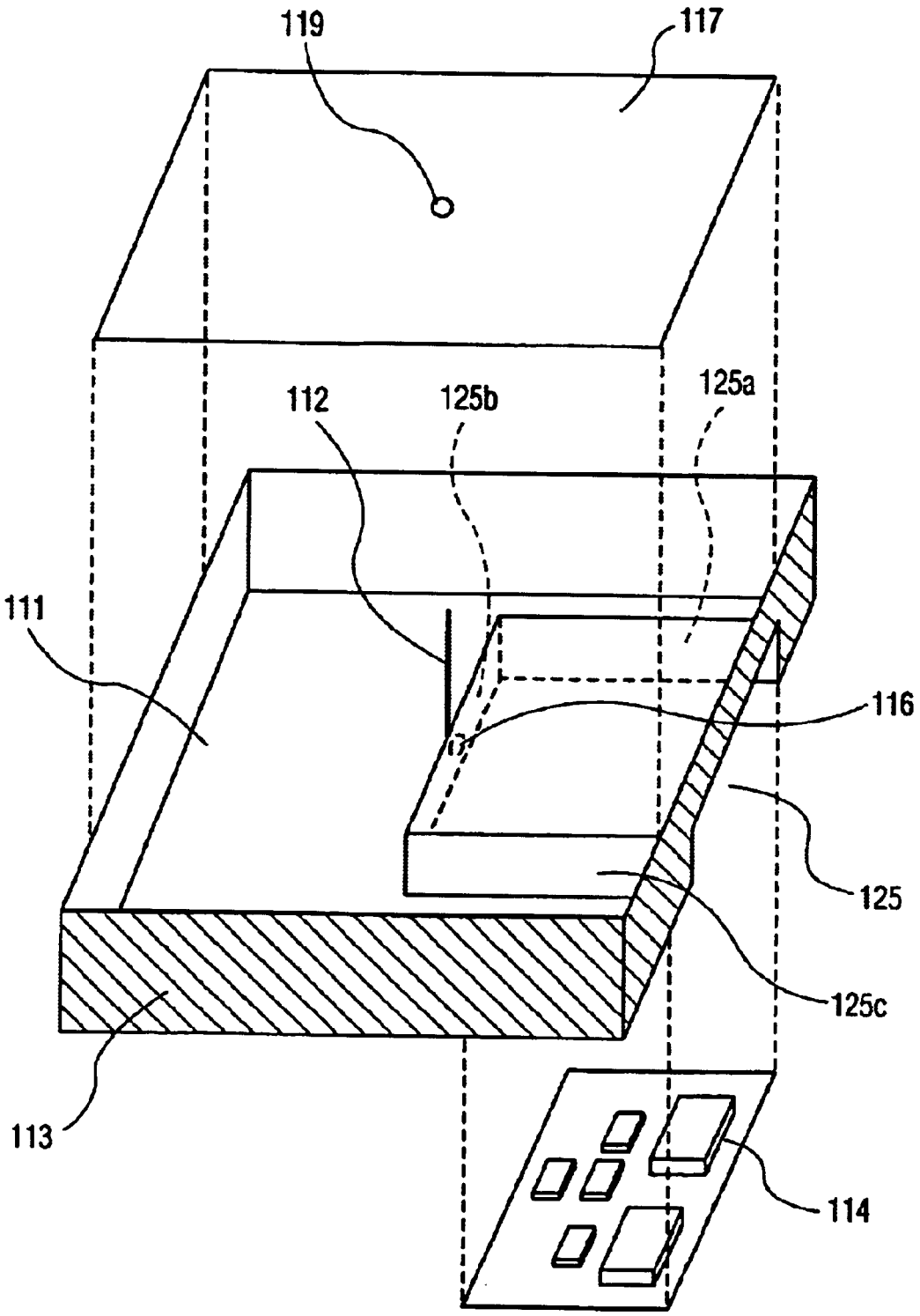
FIG. 53 is a schematic diagram showing an example of the structure of the antenna device described in the fourteenth embodiment of the present invention.

FIG. 53 shows the structure of an antenna device in the fourteenth embodiment of the present invention. FIG. 53 illustrates the ground conductor 111, antenna element 112, side conductor 113, circuit 114, power supply part 116, ceiling conductor 117, openings 118, connection point 119, and concave portion 125.

Moreover, the concave portion 125 is an area surrounded by side walls 125*a*, 125*b*, and 125*c* formed by depressing each part of the ground conductor 111 and side conductor 113, joined to the ground conductor 111, from the outside to the inside. In addition, the power supply part 116 is provided on the side wall 125*b*.

In this embodiment, the ground conductor 111, the antenna element 112, the side conductor 113, and the ceiling conductor 117 constitute an antenna of the present invention. The circuit 114 is in the concave portion 125 of the antenna 114, and arranged in the concave portion 125 of the antenna. Its circumference is connected to the antenna element 112 through the power supply part 116 while it is covered by side walls 125*a* to 125*c*. At this time, the antenna element 112 and side walls 125 are isolated from each other through the power supply part 116. Moreover, the openings 118 are in an area surrounded by the ceiling conductor 117 and the side conductor 113.

Here, a space surrounded by the side conductor 113, ground conductor 111, and ceiling conductor 117 is called the interior of an antenna, and a space opposite to the interior of the antenna with respect to the side conductor 113, ground conductor 111, or ceiling conductor 117 is called the exterior of the antenna.

As an example, FIG. 53 shows a case that the antenna element 112 is constituted with a monopole antenna element, that the ground conductor 111 is a rectangular plate, and that a cavity is formed by the ground conductor 111 and side conductor 113 that are connected electrically.

Next, the operation of the antenna device according to this embodiment will be described with using FIG. 53. A radio wave having the frequency of $f_0$ is radiated from the antenna element 112. Furthermore, the current having a phase opposite to that of the current flowing in the antenna element flows from the ground conductor 111 to the side conductor 113, and radio waves are also radiated from the upper end of the side conductor 113.

Therefore, the antenna of this embodiment mainly radiates radio waves from the antenna element 112 and the upper end portion of the side conductor 113. Hence, even if a low-profile obstruction exists in a space surrounded by the ground conductor 111 and the side conductor 113, radiation of the antenna is hardly affected. That is, even if the concave portion 125 exists in the interior of the antenna, radiation of an antenna is hardly affected.

Furthermore, the radiation characteristics are not affected even if the circuit 114 is arranged inside the concave portion 125. In this case, it is not necessary to connect the circuit 114 with the ground conductor 111 electrically. However, the ground of the circuit 114 and ground conductor 111 can be connected electrically so as to make grounds of the antenna and circuit 114 common. Moreover, since the antenna terminal 112 and ceiling conductor 117 are electrically connected through the conductor 119, the same effect as the antenna of the second embodiment is acquired.

Here, in a case of using the twelfth embodiment in a high frequency band, if a clearance is between the shielding conductor 115, and ground conductor 111 or side conductor 113, the clearance operates as a capacitor and there is a possibility of an impedance characteristic shifting.

However, this embodiment forms the concave portion 125 by the side walls 125*a* to 125*c* that are formed by depressing the ground conductor 111 and side conductor 113. It becomes possible to form in one piece the shielding conductor, ground conductor, and side conductor that are shown in the tenth embodiment. For this reason, since the shielding conductor, ground conductor, and side conductor are electrically connectable completely, the impedance characteristic does not shift and the antenna performance does not deteriorate.

Figure 54:
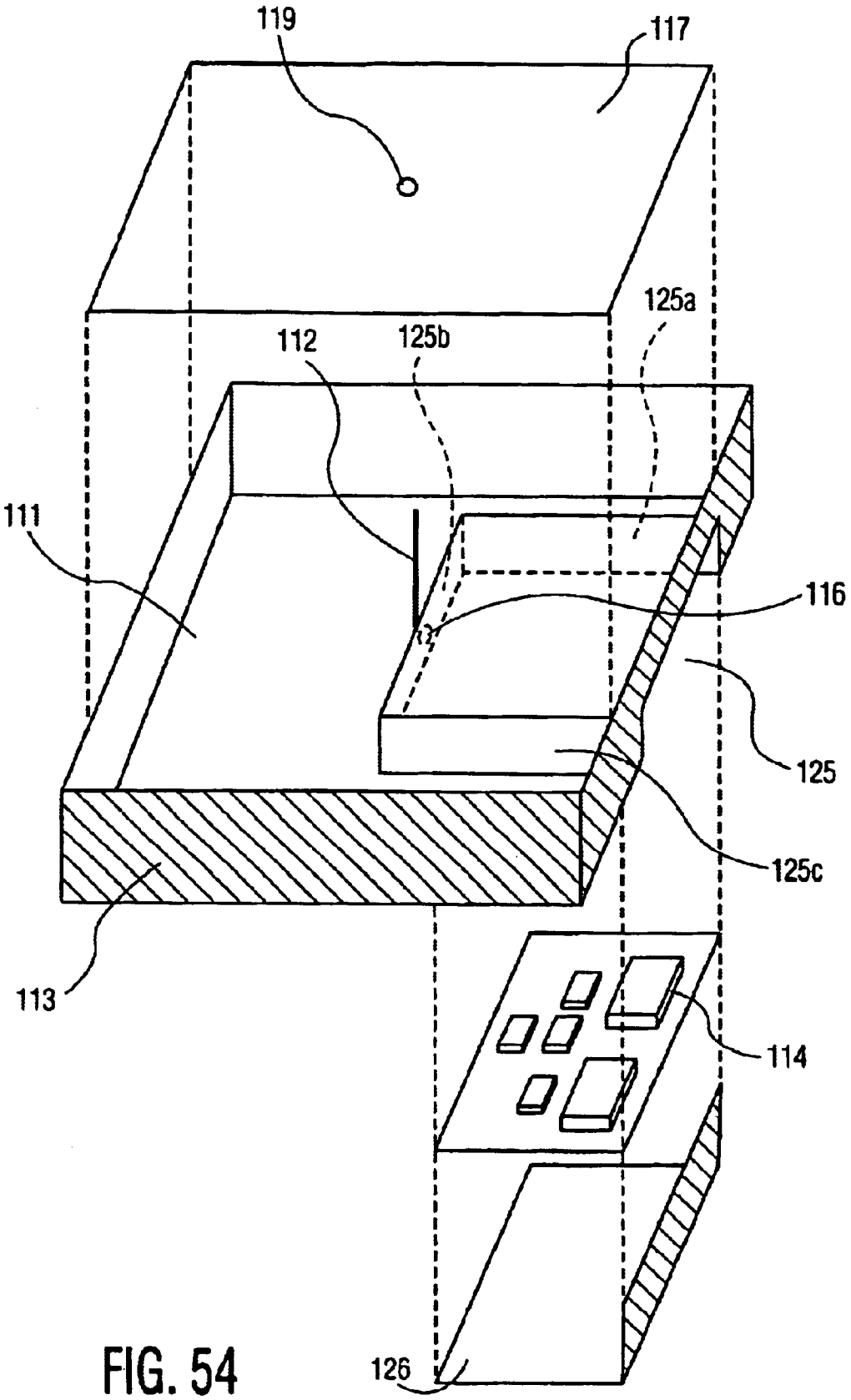
FIG. 54 is a schematic diagram showing another example of the structure of the antenna device described in the fourteenth embodiment of the present invention.

By the way, the radio waves radiated from the antenna may affect the element that is arranged on the circuit 114 to make the operation of the circuit unstable. In this case, as shown in FIG. 54, the concave portion 125 is covered by the lid conductor 126, and the lid conductor 126 and ground conductor 111 are electrically connected completely. Thereby, radio waves radiated from the antenna do not arrive at the circuit 114, and hence it becomes possible to stabilize the operation of the circuit 114. Since current does not flow in the exterior of the antenna at this time, there is no influence on the radiation characteristics of the antenna. Here, the lid conductor 126 is equivalent to a lid member of the present invention.

In addition, in the above-described ninth to fourteenth embodiments, the structure containing only passive elements, the structure containing only active elements, or the structure in which both the active elements and passive elements are contained can be considered as the structure of the circuit 114. For example, as the structure containing only passive elements, an impedance matching circuit, a high frequency filter, an optical passive element, or the like which a resistor(s), a coil(s), and a capacitor(s) constitute are mentioned. Moreover, as the active elements, high frequency active elements such as an amplification circuit and a mixer, and optical active elements such as a laser diode and a photo diode are mentioned. Moreover, the circuit 114 may contain IC.

Figure 56:
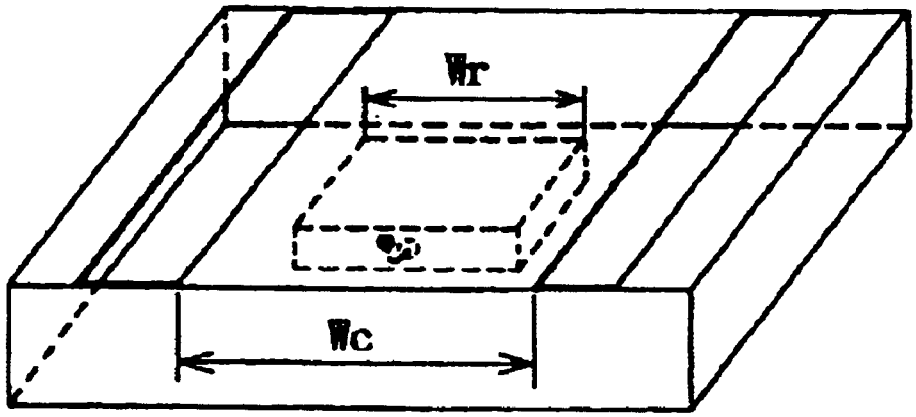
FIG. 56 is a schematic diagram for explaining the size circuit in the antenna device of the present invention.

Moreover, as shown in FIG. 56, it is more desirable for the breadth Wr of the circuit 114 to become smaller than the breadth Wc of the ceiling conductor 117 when the antenna device contains the ceiling conductor 117. In short, it is desirable that the circuit has such size that the circuit is hidden behind the ceiling member, when viewing the antenna device from the ceiling member side in the direction perpendicularly to the ceiling member.

Figure 57A:
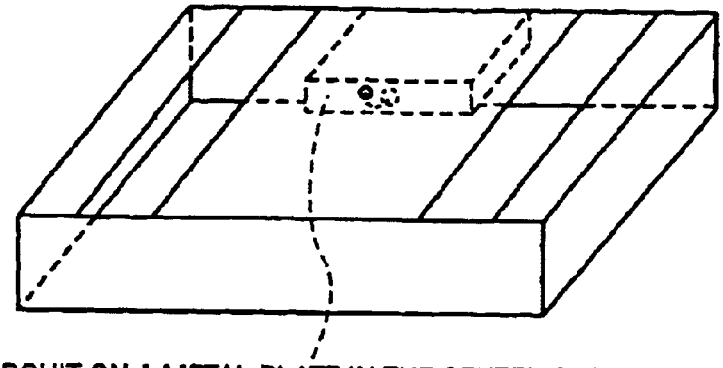
FIG. 57A is a schematic diagram for explaining the arrangement of a circuit in the antenna device of the present invention.
Figure 57B:
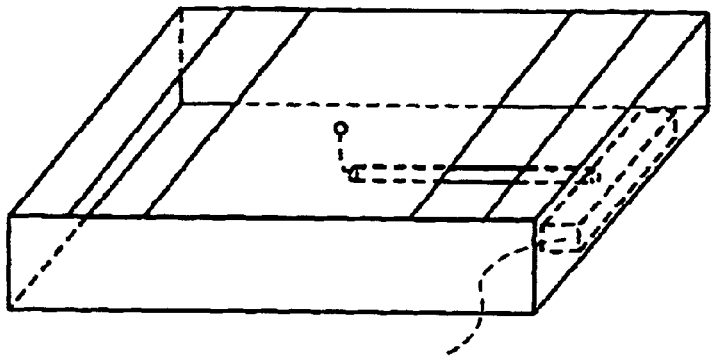
FIG. 57B is a schematic diagram for explaining the arrangement of a circuit in the antenna device of the present invention.
Figure 57C:
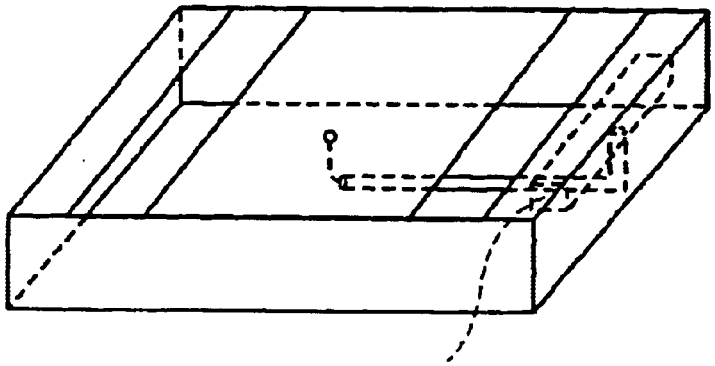
FIG. 57C is a schematic diagram for explaining the arrangement of a circuit in the antenna device of the present invention.

Moreover, as shown in FIGS. 57A and 57B, the circuit 114 in the interior of an antenna can be arranged at a corner formed by a ceiling conductor and a side conductor, or as shown in FIG. 57C, the circuit 114 can be arranged directly under a ceiling conductor at a corner formed by a side conductor and a ground conductor. In short, it is desirable that the circuit is arranged in the position that hides the circuit behind the ceiling member, when viewing the antenna device from the ceiling member side in the direction perpendicularly to the ceiling member.

Moreover, for example when the circuit 114 is constituted by high frequency active elements and passive elements like a microwave circuit, the antenna device of this embodiment can be operated as a radio equipment. Furthermore, when an optical active element or an optical passive element is further included, an electric signal received with the antenna is converted into an optical signal by the optical active element like a laser diode, and it becomes possible to transmit the signal by optical communication such as an optical fiber. Conversely, it becomes possible to convert into an electric signal the optical signal sent by optical communication with the optical active element like a photo diode, and to radiate waves from the antenna. Moreover, the circuit 114 can be achieved as the structure containing a power supply circuit, and in this case, the antenna device of these embodiments can be used as a radio equipment.

Furthermore, in the above-described ninth to fourteenth embodiments, as shown in FIG. 46 as an example of the circuit 114, a receiving circuit amplifies a signal sent from the antenna element by an amplification circuit through a high frequency filter, and converts the signal into an optical signal with a laser diode to transmit the signal with the optical fiber. Here, FIG. 46 illustrates a high frequency filter 120, an amplification circuit 121, a laser diode 122, and an optical fiber 123. In addition, as shown in FIG. 47 as an example of a transmitting circuit, a transmitting circuit can convert into an electric signal the optical signal, transmitted via the optical fiber, by replacing the laser diode 122 with a photo diode 124, and can amplify the signal by an amplification circuit to radiate a radio wave from the antenna through a high frequency filter.

Moreover, in the above-described ninth to fourteenth embodiments, as the antenna element 112, a monopole antenna element is constituted from a linear conductor, but it is possible to constitute this antenna element with another antenna element. For example, the antenna element can be a helical type monopole antenna element made of a coiled conductive wire, or can be a reverse L type or a reverse F type monopole antenna by folding the conductive wire in the form of letter L or F. It also can be a top loading type monopole antenna element having a capacitive load such as a conductive plate at the end portion of a conductive wire. Alternatively, these can be combined to form a different antenna element. This makes the antenna element small and low-profile, thereby making the antenna as a whole small and low-profile.

In the antenna devices of the ninth to fourteenth embodiments, the ground conductor 111 and the side conductor 113 are electrically connected to each other; however the present invention is not restricted to this structure. For example, in order to obtain the desired radiation directivity or input impedance characteristics, the structure where the ground conductor 111 and the side conductor 113 are separated electrically is also possible.

In the antenna devices of the ninth to fourteenth embodiments, the ground conductor 111 is a rectangle; however, the present invention is not restricted to this structure. For example, in order to achieve desired radiation directivity or input impedance characteristics, the ground conductor 111 can be any other polygon, a semicircle, or a combination thereof, or other shapes. Moreover, the ground conductor can be circular, oval, any curved shapes or any curved surfaces, or in other shapes. Thus, the corner of the conductive portion constituting the antenna becomes round in the radiation characteristic, and as a result, the corner has less diffraction effects, which desirably reduces the cross-polarized conversion loss of the radiation waves.

In the antenna devices of the ninth to fourteenth embodiments, the side conductor 113 is constituted as a frame along the periphery of the ground conductor 111; however, the present invention is not restricted to this structure. For example, in order to achieve desired radiation directivity or input impedance characteristics, the frame formed by the side conductor can be larger or smaller than the ground conductor, or the frame can be larger or smaller than the ceiling conductor.

Moreover, in the above-described ninth to fourteenth embodiments, it is also possible to insert a dielectric member in the interior of the antenna. Thereby, the miniaturization of the antenna can be attained. This is because wavelength becomes $(\in\gamma)^{-1/2}$ times the original one in a dielectric member (relative permittivity: $\in\gamma>1$) with a permittivity higher than that of a vacuum. Depending on the installment environment of the antenna, openings may undesirably bring dust or humid air into the antenna, thereby deteriorating its characteristics. It becomes possible to prevent characteristics degradation by air with much dust and moisture entering by using the lid of the dielectric member layer whose profile is the upper end of the side conductor. As for this, the same effect is also acquired with the lid of an insulator layer. At this time, the form of insertion of the dielectric member to the interior of the antenna can be the same as those of the fourth and sixth embodiments and the like.

In the antenna devices of the ninth to fourteenth embodiments, the number of the openings formed by the ceiling conductor 117 is two; however, the present invention is not restricted to this structure. For example, in order to achieve desired radiation directivity or input impedance characteristics, one or more than two openings cane provided.

In the antenna devices of the ninth to fourteenth embodiments, the openings formed by the ceiling conductor 117 are arranged in an antenna ceiling portion; however, the present invention is not restricted to this structure. For example, in order to achieve desired radiation directivity or input impedance characteristics, the openings can be arranged on the side conductor or on the ground conductor, or these structures can be combined.

In the antenna devices of the ninth to fourteenth embodiments, the antenna element 112 and the ceiling conductor 117 are electrically connected to each other; however the present invention is not restricted to this structure. For example, in order to obtain the desired input impedance characteristics, the structure where the ceiling conductor 117 and the antenna element 112 are separated electrically is also possible. For example, the antenna element can be a helical type monopole antenna element made of a coiled conductive wire, or can be a reverse L type or a reverse F type monopole antenna by folding the conductive wire in the form of letter L or F. It also can be a top loading type monopole antenna element having a capacitive load such as a conductive plate at the end portion of a conductive wire. Alternatively, these can be combined to form a different antenna element. This makes the antenna element small and low-profile, thereby making the antenna as a whole small and low-profile.

In the antenna devices of the ninth to fourteenth embodiments, the ground conductor 111, the side conductor 113, and the ceiling conductor 117 are electrically connected to each other; however the present invention is not restricted to this structure. For example, in order to obtain the desired radiation directivity or input impedance characteristics, the structure where the ceiling conductor and the side conductor are separated electrically is also possible. Alternatively, the structure where the ground conductor and the side conductor are separated electrically is also possible. Furthermore, the structure where all of the ground conductor, side conductor, and ceiling conductor are separated electrically is also possible.

In the antenna devices of the ninth to fourteenth embodiments, the ceiling conductor 117 is a rectangle; however, the present invention is not restricted to this structure. For example, in order to achieve desired radiation directivity or input impedance characteristics, the ceiling conductor can be any other polygon, a semicircle, or a combination thereof, or other shapes. Moreover, the ceiling conductor can be circular, oval, any curved shapes any curved surfaces, or in other shapes. Thus, the corner of the conductive portion constituting the antenna becomes round in the radiation characteristics, and as a result, the corner has less diffraction effects, which desirably reduces the cross-polarized conversion loss of the radiation waves.

Moreover, in the ninth to fourteenth embodiments, the concave portion 125 is an area surrounded by side walls 125*a*, 125*b*, and 125*c* formed by depressing each part of the ground conductor 111 and side conductor 113, joined to the ground conductor 111, from the outside to the inside. Nevertheless, sidewalls can be formed by depressing only the ground conductor 111. In addition, side walls can be formed by depressing only the side conductor 113.

Figure 58:
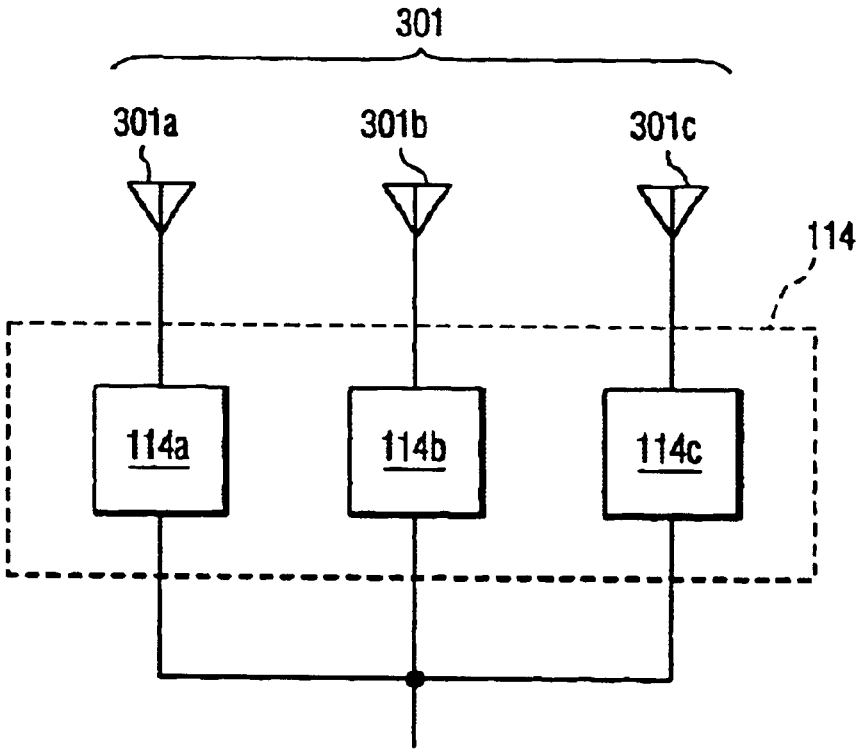
FIG. 58 is a schematic diagram showing the structure of an antenna array device of the present invention.

Moreover, as shown in FIG. 58, the present invention can also be achieved as an antenna array device which has the antenna array 301 which has plural antennas 301*a* to 301*c* according to the present inventions, and the radio circuits 114 perform correspondence to this antenna array 301. At this time, plural circuits 114*a*, 114*b*, and 114*c* constitute the radio circuit 114, each of the circuits 114*a* to 114*c* has each of the antennas 301*a* to 301*c* corresponding to each. Hence, each circuit 114*a*–114*c* input or output the same signal, thereby the antenna device of the present invention is formed. Furthermore, the antenna array device of the present invention is an array antenna device where each antenna device has only to input or output the same signal and is not limited by the number of antenna devices.

Moreover, in regard to a circuit of the antenna device of the present invention, so long as a portion in which at least the antenna element 112 as a conductive member of the present invention is contained is arranged in the antenna, the remaining portions can be provided out of the antenna. Hence, it is not necessary to contain all the structures of the circuit in the antenna.

Moreover, in the antenna device of the present invention, a circuit part can be detached from the antenna as a cartridge. For example, in the fifth embodiment shown in FIG. 31, it becomes possible to change the circuit 114 to another kind of circuit for and to connect the circuit to the same antenna by using a connector in the power supply part 116. When using an antenna device as a switching base station for cellular phones, for PHS, etc., this has an advantage of making one switching base station correspond to two or more different communication devices by exchanging circuits as cartridges.

Figure 59:
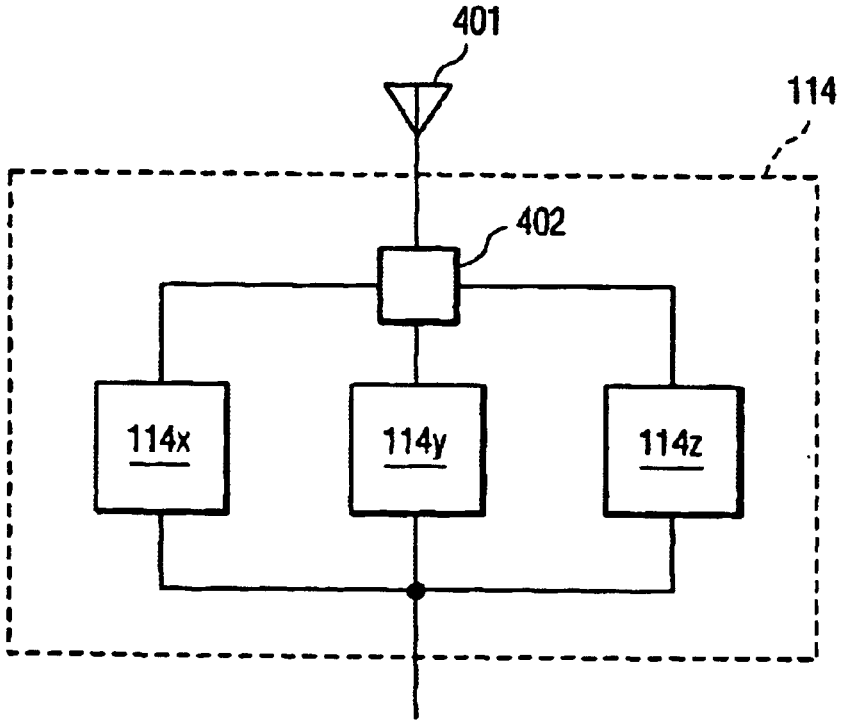
FIG. 59 is a schematic diagram showing another structural example of a n antenna array device of the present invention.
Figure 60A:
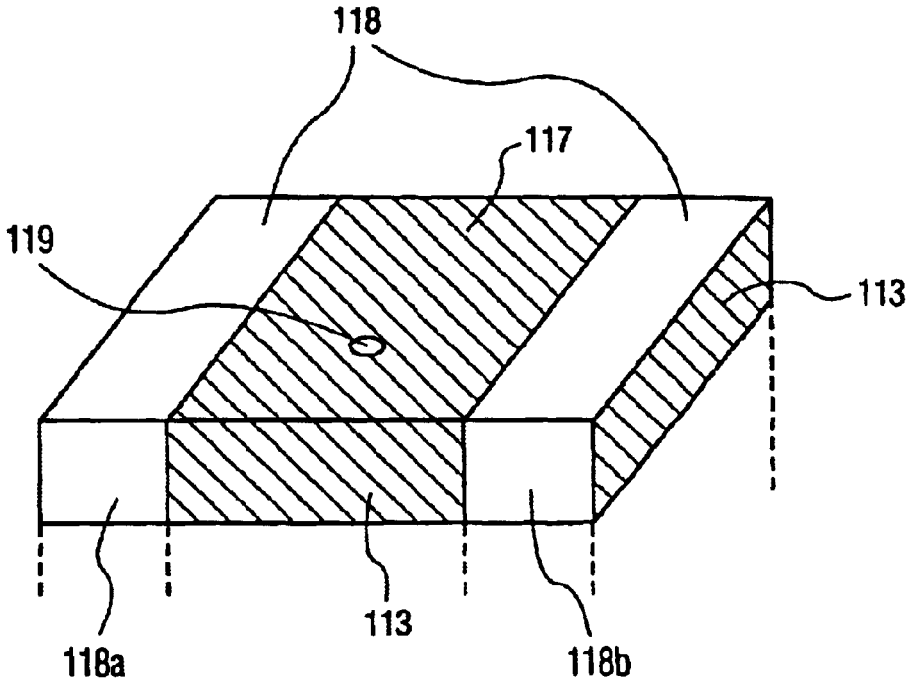
FIGS. 60*a–c* are perspective views showing other examples of the present invention.
Figure 60B:
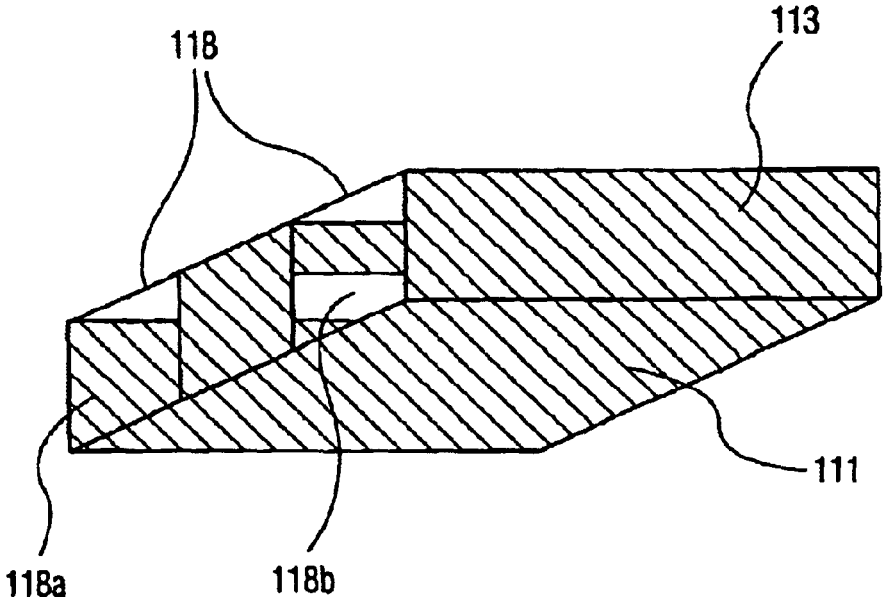
Figure 60C:
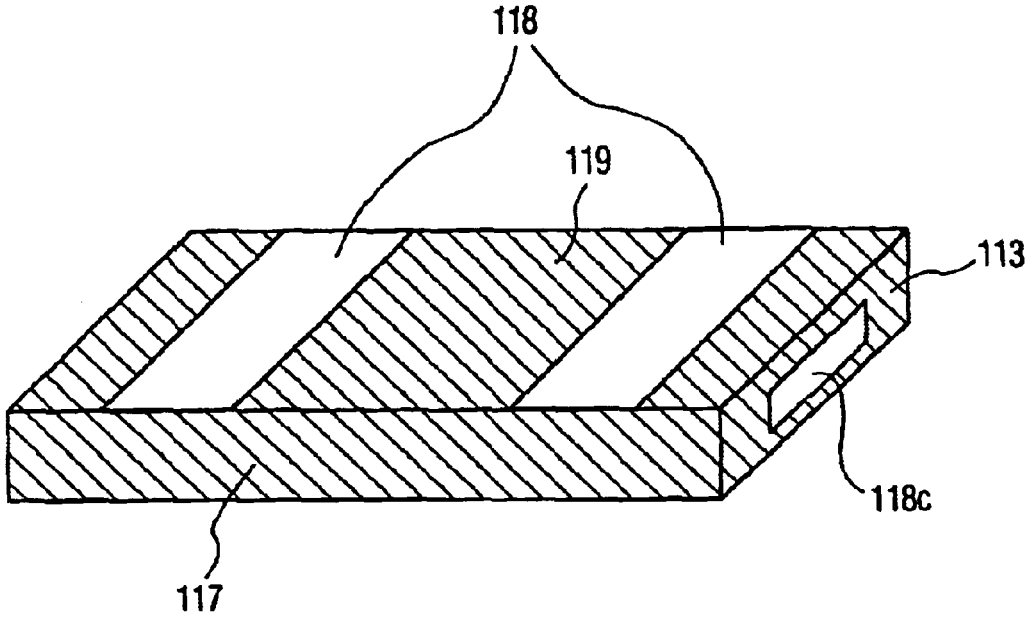

Furthermore, the circuit arranged in a space surrounded by the bottom member and the side member in the antenna device of the present invention, as shown in FIG. 59, can comprise switching means 402 of switching and connecting any one of the sub-circuits 114*x*, 114*y*, and 114*z*, which have mutually different radio systems, and the antenna 401 of the present invention. In this case, one antenna device can deal with plural radio systems.

In addition, in each of the above-described embodiments, the ground conductor 111 is an example of the bottom member of the present invention. The power supply part 116 is an example of the feeding point of the present invention, and the antenna element 112 is an example of the conductive member of the present invention. Furthermore, the side conductor 113 is an example of the side member of the present invention, and the ceiling conductor 117 is an example of the ceiling member of the present invention. Moreover, the openings 118 are an example of the remaining portion of the space according to the present invention that is not covered by the ceiling portion of the present invention. In addition, the concave portion 125 is an example of the concave portion of the present invention.

Therefore, each antenna device of the ninth to fourteenth embodiments can also be embodied as the antenna of the present invention that has the structure of excluding the circuit 114. In this case, each embodiment becomes an embodiment of the antenna of the present invention that has the conductive member fixed in a space surrounded by the bottom member and the side member. Moreover, the antenna device of the present invention can also be embodied that all or a part of the circuit 114 is comprised in the antenna of the first to seventh embodiment.

The present invention described above has, for example, a ground conductor, a power supply part located on a surface of the ground conductor, an antenna element connected to the power supply part, and a side conductor which surrounds the circumference of a space, containing the antenna element, apart from the antenna element. Thereby, it is possible to strengthen radio wave radiation along a horizontal plane of the antenna with hardly enlarging two-dimensional size. The reason for this is as follows.

Since the side conductor functions as a peripheral part of the ground conductor, it is possible to strengthen the radio wave radiation in a horizontal direction of the antenna by effectively preventing the diffraction of a radio wave. In addition, since the side conductor is arranged in the direction where the side conductor stands to the ground conductor, the two-dimensional size of the monopole antenna does hardly become large.

Moreover, in the present invention, for example, the monopole antennas of the above-described present invention, the present invention has the ceiling conductor that faces the ground conductor with sandwiching the antenna element. Thereby, it becomes possible to make the size in a perpendicular direction of the antenna small. The reason for this is as follows. Since the ceiling conductor functions as an end portion of the antenna element, it becomes possible to make the length of the antenna element short. In connection with it, the size of the antenna in the perpendicular direction becomes small.

Moreover, in the present invention, for example, the monopole antennas of the above-described present invention, an end portion of the ceiling conductor is connected to the side conductor electrically. Thereby, the radio wave directivity along a horizontal plane can be adjusted arbitrarily. The reason for this is as follows. If the end portion of the ceiling conductor is connected to the side conductor, current leaks from there towards the ground conductor. Therefore, a radio wave is hardly radiated in the direction of extending outside along the connection point of the ceiling conductor from the ceiling conductor. Then, the radio wave directivity along a horizontal plane can be arbitrarily set by setting a direction where the connection point of the ceiling conductor and the side conductor is provided.

Moreover, in the present invention, for example, the monopole antennas of the above-described present invention, a central portion of the ceiling conductor is made to be circular. Thereby, the radio wave directivity along a horizontal plane can be adjusted still more arbitrarily. The reason for this is as follows. It is possible to adjust the radio wave directivity since a minimum point of a radio wave is formed in the direction of extending outside along the connection point of the ceiling conductor if an end portion of the ceiling conductor is connected to the side conductor. However, depending on the case, the radiation level in the minimum point of a radio wave may become smaller than a request level excessively. On the other hand, since a radio wave is radiated from the perimeter of a circular portion if a central portion of the ceiling conductor is made to be circular, radio wave radiation in the portion becomes almost non-directional. Therefore, since radio wave radiation becomes the mixture of the radiation from the circular portion and the radiation from other portions, it is possible to compensate the minimum point of a radio wave. In addition, the radiant quantity of radio waves from this circular portion can be adjusted by changing the size of the circular portion.

Moreover, in the present invention, for example, the monopole antennas of the above-described present invention, the side conductor is connected to the ground conductor electrically. Thereby, it becomes possible to match the input impedance. The reason for this is as follows. If the size of an antenna perpendicular direction is made to be small by providing the ceiling conductor, the ceiling conductor and the ground conductor are arranged with mutually approaching. Hence, there is a possibility that a capacitive component may arise and hence the mismatching of the input impedance may occur between both conductors. On the other hand, the ceiling conductor is electrically connected to the ground conductor through the side conductor in the present invention. Hence, as a result of a conductive loop arising among these conductors, inductance occurs. Therefore, the capacitive component is offset by the generated inductance and the mismatching of impedance is canceled.

Moreover, in the present invention, for example, the monopole antennas of the above-described present invention, at least one of the ground conductor, the side conductor, and the ceiling conductor has openings. In addition, the radio wave directivity can be arbitrarily set up by arbitrarily adjusting a position, size, etc. of the openings at the time of opening formation.

Furthermore, in the present invention, for example, the monopole antennas of the above-described present invention, the present invention has adjusting means of adjusting the size of the openings. Hence, the fine adjustment of the directivity and impedance can be arbitrarily performed by adjusting the size of the openings with this adjusting means even if the openings have already been formed.

Moreover, in the present invention, for example, the monopole antennas of the above-described present invention, the power supply part is arranged at an origin point; the ground conductor is arranged at the X-Y plane; the ground conductor and the side conductor are made to be symmetrical with respect to the Z-Y plane; and the openings are symmetrically arranged with respect to the Z-Y plane. Thereby, the radio wave directivity can be made to be symmetrical with respect to the Z-Y plane.

Moreover, in the present invention, for example, the monopole antennas of the above-described present invention, the ground conductor and the side conductor are made to be symmetrical with respect to the Z-X plane, and the openings are arranged symmetrically with respect to the Z-X plane. Thereby, the radio wave directivity can be made to be symmetrical with respect to the Z-X plane.

Furthermore, in the present invention, for example, the monopole antennas of the above-described present invention, the present invention makes the antenna element electrically connect to the ceiling conductor. This enhances the stability of the structure and impedance characteristics of the monopole antenna and improves the characteristics of the antenna.

Moreover, in the present invention, for example, the monopole antennas of the above-described present invention, the dielectric member with a permittivity higher than air is provided in a space surrounded by the ground conductor and the side conductor. Thereby, the antenna can be made to have smaller and low-profile structure.

Moreover, in the present invention, for example, the monopole antennas of the above-described present invention, the space is filled up with the dielectric member. This makes it possible to make the antenna smaller and low-profile, and also removes a space in the interior of the antenna. Hence, this prevents dust from entering the space of the interior of the antenna and also makes condensation rare, thereby improving reliability.

Furthermore, in the present invention, for example, the monopole antennas of the above-described present invention, the dielectric member is constituted as a lid of a space surrounded by the side conductor, and the ground conductor or the ceiling conductor is provided on this dielectric member. Hence, this prevents dust from entering the space of the interior of the antenna and also makes condensation rare, thereby improving reliability. Furthermore, this makes it possible to easily seal the space inside by making the dielectric member the lid.

Moreover, in the present invention, for example, the monopole antennas of the above-described present invention, the side conductor is constituted from the via hole formed in the dielectric member. Thereby, formation of the side conductor becomes easy. This is because the via hole can be formed comparatively easily by a general-purpose substrate production method.

In addition, the present invention, for example, the monopole antennas of the above-described present invention each have at least one matching element arranged apart from the antenna element, and this matching element is connected to the ground conductor electrically. This makes it possible to improve the matching status by changing the impedance of the antenna.

Furthermore, in the present invention, for example, the monopole antennas of the above-described present invention, at least one of the matching elements is electrically connected to the antenna element. Thereby, it becomes possible to make the input impedance of the monopole antenna high.

In addition, in the present invention, for example, the monopole antennas of the above-described present invention, at least one of the matching elements is electrically connected to the ceiling conductor. Thereby, it becomes possible to change the impedance of the monopole antenna.

Furthermore, the present invention constitutes a radio equipment comprising, for example: a monopole antenna; amplification means of amplifying a transmitter signal supplied to the monopole antenna, and a receiver signal supplied from the monopole antenna; frequency selection means of selecting a frequency of transceiver and receiver signals; and a cabinet which stores the monopole antenna, the amplification means, and the frequency selection means, the monopole antenna comprising: a ground conductor; a power supply part located in a surface of the ground conductor; an antenna element connected to the power supply part; a side conductor which surrounds the circumference of a space, containing the antenna element, apart from the antenna element; a ceiling conductor which faces the ground conductor with sandwiching the antenna element; a dielectric member with a permittivity higher that air that is provided in a space surrounded by the ground conductor and the side conductor; and openings which are provided in at least one of the ground conductor, the side conductor, and the ceiling conductor, wherein a concave portion is provided in the cabinet surface; and wherein the monopole antenna is contained and arranged in this concave portion. Thereby, it becomes possible to constitute a radio equipment excellent from viewpoint of appearance in addition to the maintenance and enhancement of a small and low-profile form. The reason for this is as follows. This is because the monopole antenna can be hardly seen from the outside since the monopole antenna is stored in the concave portion of a surface of the cabinet. Furthermore, the monopole antenna which this radio equipment has becomes smaller and lower-profile similarly to the antenna according to the invention mentioned above. In spite of embedding the monopole antenna in one piece, a small and low-profile form of the radio equipment is hardly disturbed.

Moreover, the present invention has two or more monopole antennas, these monopole antennas comprising: a ground conductor; a power supply part located in a surface of the ground conductor; an antenna element connected to the power supply part; aside conductor which surrounds the circumference of a space, containing the antenna element, apart from the antenna element; and a ceiling conductor which faces the ground conductor with sandwiching the antenna element, wherein the arrangement structure of the monopole antenna is constituted by aligning and arranging these monopole antennas so that the directions where the directivity along horizontal planes of respective monopole antennas becomes minimum may coincide with each other. This makes an interaction, caused by the transmission and reception of radio waves that each adjoining monopole antenna performs, minimum, thereby making the isolation between the monopole antennas satisfactory.

As mentioned above, since the present invention can change radiation directivity in simple structure, it is possible to achieve an antenna excellent in machining precision. In addition, it becomes possible to achieve a small antenna device and a small radio equipment by arranging a circuit inside an antenna

What is claimed is:

1. An antenna comprising:

a conductive bottom member;

a conductive side member; and a conductive member arranged in a space surrounded by the bottom member and the side member, wherein the conductive member is connected to a signal line for transmission and/or reception; and a conductive ceiling member covering a part of the space, wherein the conductive member extends its entire length normally of the conductive bottom member and the ceiling member, and the ceiling member has at least one opening and a periphery having a curved shape.

2. An antenna comprising:

a conductive bottom member;

a conductive side member; and a conductive member arranged in a space surrounded by the bottom member and the side member, wherein the conductive member is connected to a signal line for transmission and/or reception; and at least one of the bottom member and the side member has an opening other than an opening for the signal line.

3. The antenna according to claim 2, wherein the openings have means of adjusting their size.

4. An antenna comprising:

a conductive bottom member;

a conductive side member;

a conductive member arranged in a space surrounded by the bottom member and the side member, wherein the conductive member is connected to a signal line for transmission and/or reception; and a conductive ceiling member covering a part of the space, wherein the ceiling member has openings, and a projection of the conductive member onto the bottom member is an origin point and the bottom member is arranged in an X-Y plane, the bottom member and the side member are symmetric with respect to a Z-Y plane, and the openings are symmetrically arranged with respect to a Z-Y plane.

5. The antenna according to claim 4, wherein the bottom member and the side member are symmetric with respect to a Z-X plane, and the openings are symmetrically arranged with respect to a Z-X plane.

6. An antenna comprising:

a conductive bottom member;

a conductive side member; and a conductive member arranged in a space surrounded by the bottom member and the side member, wherein the conductive member is connected to a signal line for transmission and/or reception; and a circuit for transmission and/or reception connected to the signal line and arranged in the space.

7. The antenna device according to claim 6, further comprising a shielding member of covering all or part of the circuit, wherein the shielding member does not contact to the conductive member electrically.

8. The antenna device according to claim 7, wherein the shielding member is formed as a concave portion that is part of at least one of the bottom member and the side member; and all or part of the circuit is arranged in the concave portion.

9. The antenna device according to claim 8, further comprising a lid member which covers the concave portion and stores all or part of the circuit, wherein the lid member is electrically connected to at least one of the bottom member and the side member.

10. The antenna device according to claim 6, wherein the circuit is constituted with a passive circuit.

11. The antenna device according to claim 6, wherein an active element is contained in the circuit.

12. The antenna device according to claim 6, wherein a microwave circuit is contained in the circuit.

13. The antenna device according to claim 6, wherein an optical passive element is contained in the circuit.

14. The antenna device according to claim 6, wherein an optical active element is contained in the circuit.

15. The antenna device according to claim 6, wherein the circuit has an IC.

16. The antenna device according to claim 6, wherein the circuit has such size that the circuit is hidden behind the ceiling member, when viewing the antenna device from the ceiling member side in the direction perpendicularly to the ceiling member.

17. An array antenna device that is an array antenna device where the plural antenna devices according to claim 6 are arrayed, wherein the circuits in the plural antenna devices each input or output the same signal.

18. The array antenna device according to claim 6, wherein the circuit has a cartridge form so as to be detachable from the antenna.

19. The antenna device according to claim 6, wherein the circuit comprises plural sub-circuits having radio systems different from each other, and switching means of switching the connection between anyone of the sub-circuits and the antenna.

20. The antenna device according to claim 6, wherein the circuit is arranged in the position that hides the circuit behind the ceiling member, when viewing the antenna device from the ceiling member side in the direction perpendicularly to the ceiling member.

21. The antenna device according to claim 6, wherein the circuit comprises: amplification means of amplifying the signal for the transmission and/or reception; and frequency selection means of selecting a frequency of the signal for transmission or the signal for reception.

22. A radio equipment comprising the antenna device according to any one of claims 6, and a power supply circuit provided in the circuit.

23. An antenna comprising:

a conductive bottom member;

a conductive side member;

a conductive member arranged in a space surrounded by the bottom member and the side member, wherein the conductive member is connected to a signal line for transmission and/or reception;

a circuit for transmission and/or reception connected to the signal line and arranged in the space.

24. An antenna comprising:

a conductive bottom member;

a conductive side member;

a conductive member arranged in a space surrounded by the bottom member and the side member, wherein the conductive member is connected to a signal line for transmission and/or reception; and a conductive ceiling member covering a part of the space, wherein the ceiling member has openings, and the openings have means of adjusting their size.

* * * * *

UNITED STATES PATENT AND TRADEMARK OFFICE

CERTIFICATE OF CORRECTION

PATENT NO. : 6,906,677 B2
DATED : June 14, 2005
INVENTOR(S) : Atsushi Yamamoto et al.

It is certified that error appears in the above-identified patent and that said Letters Patent is hereby corrected as shown below:

Column 46,
Between lines 18 and 19, insert -- a conductive ceiling member covering a part of the space; and --.

Signed and Sealed this

Eighth Day of November, 2005

JON W. DUDAS
*Director of the United States Patent and Trademark Office*